US006826930B2

(12) United States Patent
Frullini et al.

(10) Patent No.: US 6,826,930 B2
(45) Date of Patent: Dec. 7, 2004

(54) METHOD AND APPARATUS FOR MOVING THE STITCHES OF A KNITTED TUBULAR ARTICLE TO AN OPERATING STATION

(75) Inventors: Paolo Frullini, Florence (IT); Alberto Frullini, Florence (IT)

(73) Assignees: Fabritex S.R.L., Florence (IT); (part interest); Sangiacomo S.p.A., Brescia (IT); (part interest)

( * ) Notice: Subject to any disclaimer, the term of this patent is extended or adjusted under 35 U.S.C. 154(b) by 0 days.

(21) Appl. No.: 10/484,853

(22) PCT Filed: Jul. 19, 2002

(86) PCT No.: PCT/IT02/00475

§ 371 (c)(1),
(2), (4) Date: Jan. 21, 2004

(87) PCT Pub. No.: WO03/010377

PCT Pub. Date: Feb. 6, 2003

(65) Prior Publication Data

US 2004/0211226 A1 Oct. 28, 2004

(30) Foreign Application Priority Data

Jul. 24, 2001 (IT) ..... FI2001A0143

(51) Int. Cl.[7] ..... D04B 9/40
(52) U.S. Cl. ..... 66/148
(58) Field of Search ..... 66/147, 148, 58, 66/59, 8, 13, 14, 17, 18

(56) References Cited

U.S. PATENT DOCUMENTS 5,487,281 A 1/1996 Frullini et al.
5,551,260 A 9/1996 Frullini et al.
5,570,591 A 11/1996 Frullini et al.
5,606,876 A * 3/1997 Sangiacomo ..... 66/148
5,617,744 A * 4/1997 Conti ..... 66/148
5,727,400 A * 3/1998 Lonati et al. ..... 66/148
5,761,931 A * 6/1998 Lonati et al. ..... 66/148
6,164,091 A 12/2000 Frullini et al.
6,381,991 B2 5/2002 Ando'

FOREIGN PATENT DOCUMENTS

EP 0 679 746 A2 11/1995
EP 0 942 086 A2 9/1999

* cited by examiner

*Primary Examiner*—Danny Worrell
(74) *Attorney, Agent, or Firm*—McGlew and Tuttle, P.C.

(57) ABSTRACT

Method of handling or moving the stitches of a textile article, the method comprising removing the stitches from the needles of a textile machine by with the transferring article is formed at a first station, transferring the article from said first station to a second operating station, said transfer being operated by engaging the said stitches with a plurality of members intended for the removal of same stitches form the needles of the textile machine and transferring said members from said first station to said second station, characterized in that it comprises the reversible transfer of at least one portion of said removal members from a first support or carrier which is being movable from said first and second stations to a second support or carrier intended for temporary retaining the said at least one portion of removal members along with the stitches being removed by them, and/or the reversible transfer of a plurality of members, intended for the temporary retention of the stitches and not involved in the removal of same stitches from said needles, between two movable supports or carriers.

43 Claims, 70 Drawing Sheets

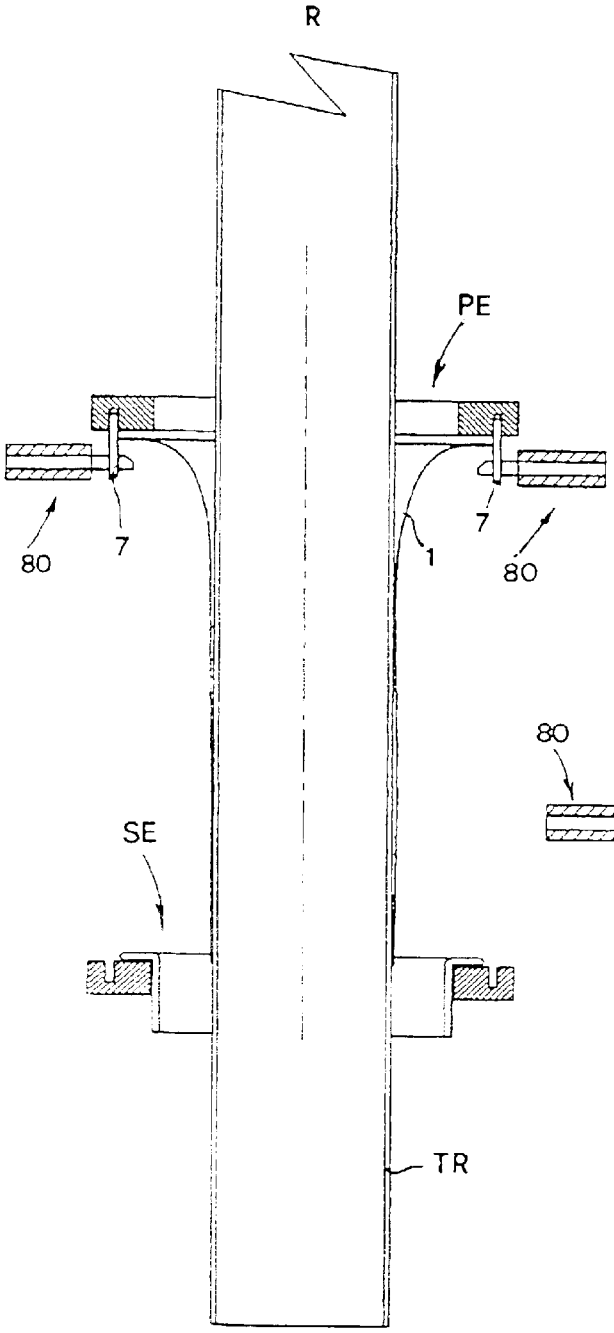
FIG. 75
FIG. 76
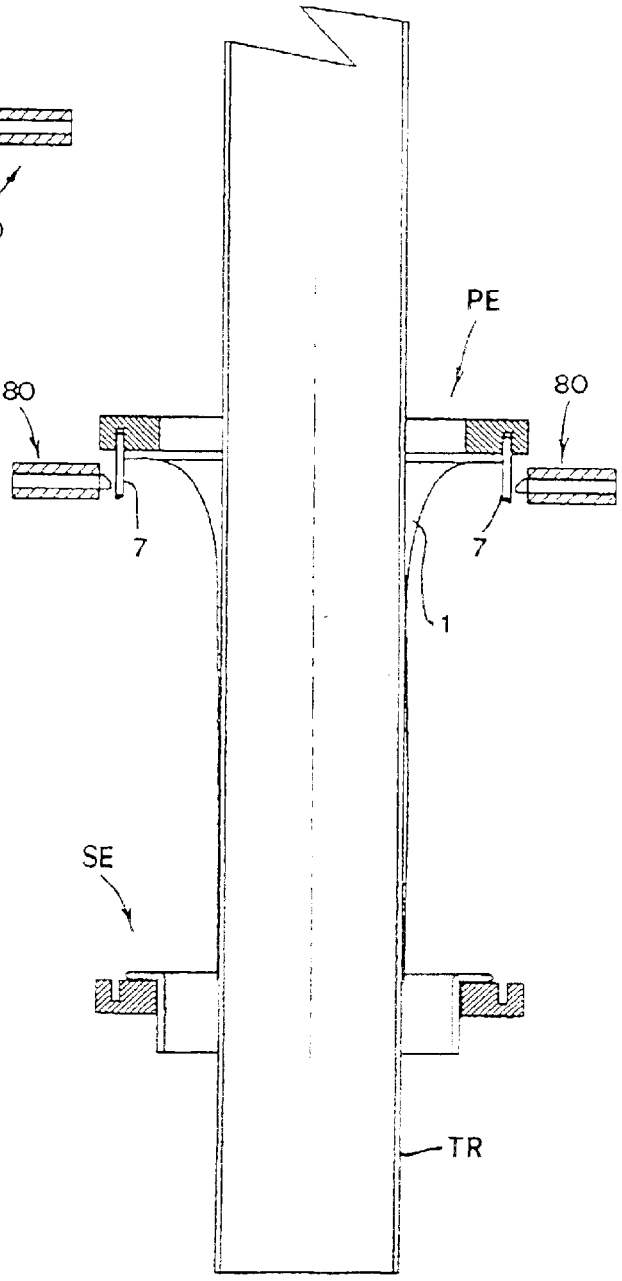

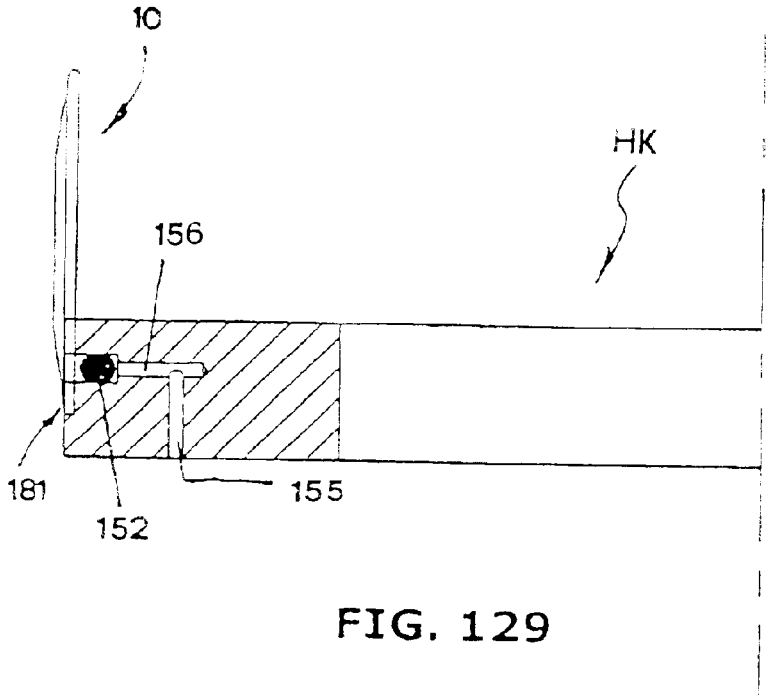
FIG. 129
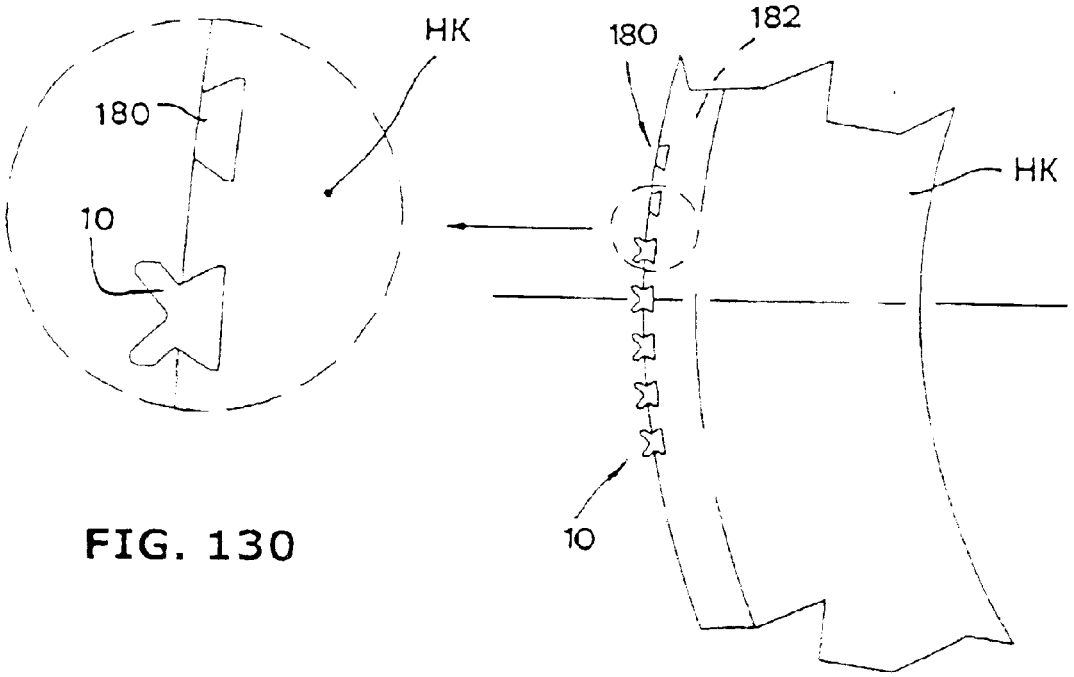
FIG. 130
FIG. 128

METHOD AND APPARATUS FOR MOVING THE STITCHES OF A KNITTED TUBULAR ARTICLE TO AN OPERATING STATION

The present invention refers to a method and apparatus for handling or moving the stitches of a knitted article.

U.S. Pat. Nos. 5,570,591 and 5,487,281 deal with the joining of two end edges of a tubular knitted article through a hook-up operation performed onto the right-side out article in correspondence of the machine which knits the article and, respectively, in correspondence of a station for a hook-up operation distinct from the knitting operation.

U.S. Pat. No. 6,164,091 discloses a method of joining two terminal edges of tubular knitted article, which method makes it possible to carry out said junction by a hook-up operation involving either the right-side out or the inside-out part of the article. In particular, provision is made for possibly carrying out the hook-up operation on the inner or inside-out part of the article by removing the latter beforehand from the knitting machine and then moving it on to a hook-up station different from that for knitting. However, this known operating technique brings about some drawbacks deriving from the fact that provision is made for repeatedly transferring the stitches of the linked edges between a plurality of members for the removal and, more generally, the handling of same stitches. In particular, this technique implies that the said stitched are more likely to be missed or damaged and, in any case, of being subjected to mechanical stress which, especially when using yarns of lower quality, may be cause for unsuccessful operations. Moreover, the means used result somewhat complex and, accordingly, considered too expensive in relation to the outcome. The above holds true also in case the knitting is performed by either a one-cylinder or two-cylinder machine.

The main object of the present invention is to overcome the above drawbacks by ensuring in any case the possibility of joining two terminal edges of a tubular knitted machine through a hook-up operation which can be performed also on the inner or inside-out part of the article.

This result has been achieved, according to the invention, by devising an operating method and providing a device having the characteristics indicated in the independent claims. Further characteristics of the present invention being set forth in the dependent claims.

The advantages of the present invention lies essentially in that the stitches to be handled or moved result subjected to minor stresses, which allows using, where deeming it suitable or necessary for economy, yarns of lower quality. In addition, the risk of damaging the stitches, as well as of hold-failure or disengagement of them from the handling members handling in the course of treatment, is reduced. Also worth of being pointed out is the relative constructional simplicity of the present apparatus which allows reducing the manufacturing and operating costs thereof. Moreover, the invention makes it possible to perform a final hook-up operation both of the right-side out and inside-out part of the article, in correspondence of the two edges thereof to be united by a hook-up operation, such as in the case of stockings manufacturing, and this by knitting the stockings with machines of one-cylinder as well as two-cylinder type.

These and other advantages and characteristics of the invention will be best understood from a reading of the following description in conjunction with the attached drawings given as a practical exemplification of the invention, but not to be considered in a limitative sense, wherein:

FIG. 75 shows the first movable carrier and the said means acting as a safety device in the hook-up station, with an eversion tube being introduced into the article and with a second movable carrier disposed coaxial with the first movable carrier;

FIG. 76 shows a step which precedes the approach of the two movable carriers, this step being the one in which the said means acting as a safety device are deactivated;

Figure 81:
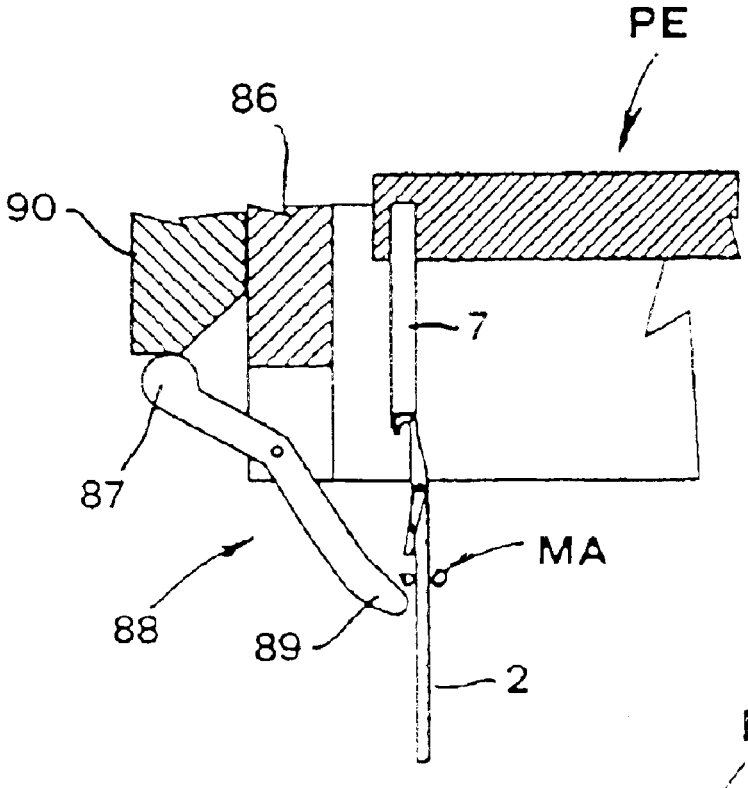
FIG. 81 is a partial side view with parts in section of a first movable carrier, with the stitch-removing members being moved close to the needles, and where a further exemplary embodiment is shown of the means able to define a cast-off plane, said means being deactivated.
Figure 82:
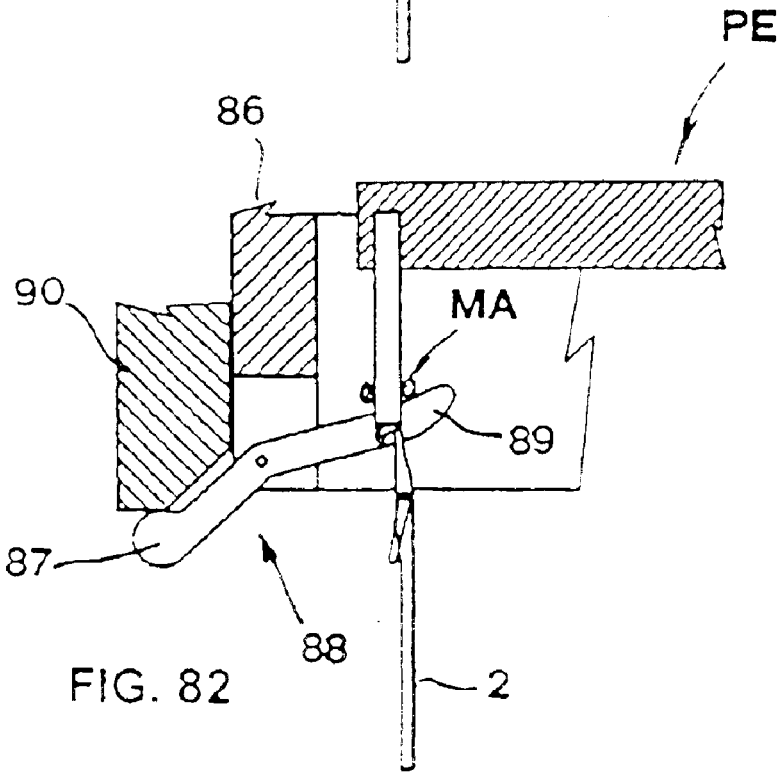
Figure 83:
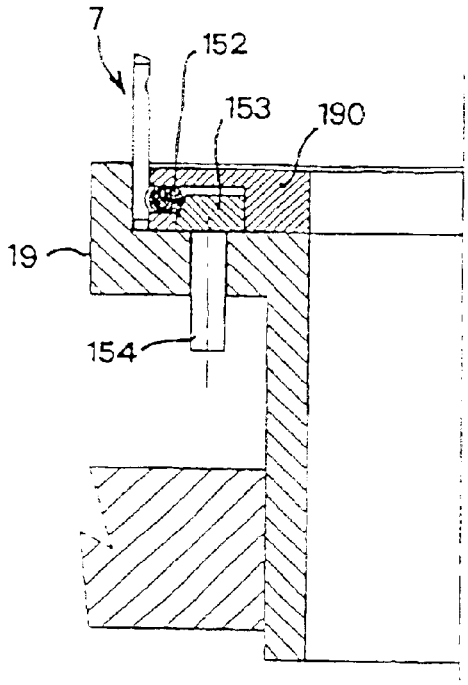
Figure 84:
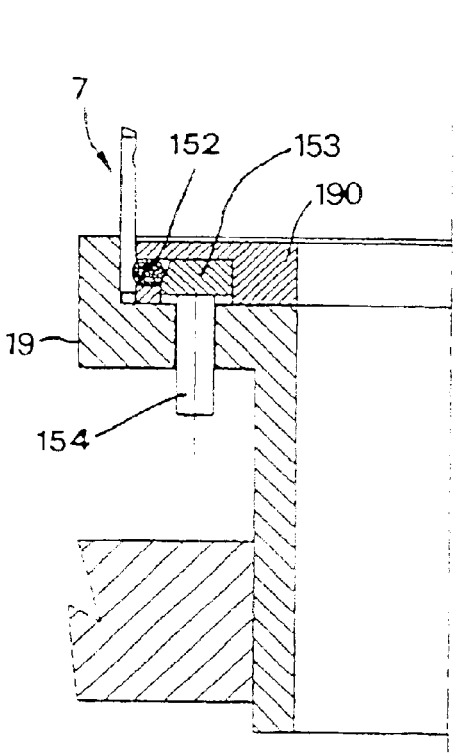
Figure 86:
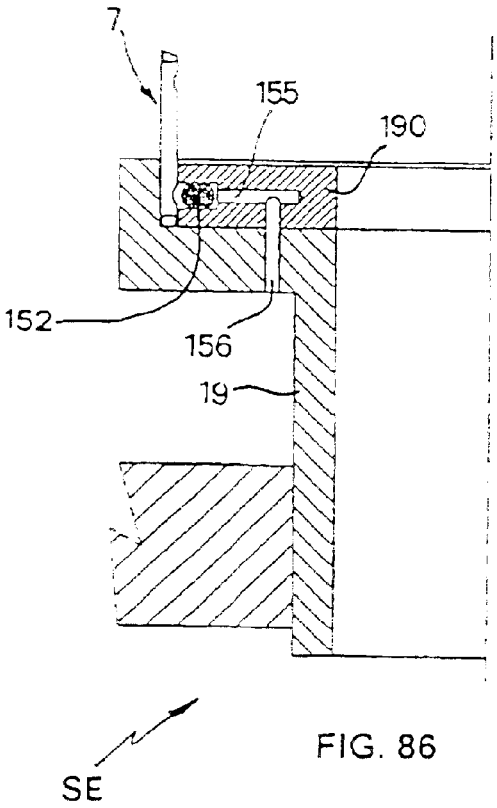
Figure 85:
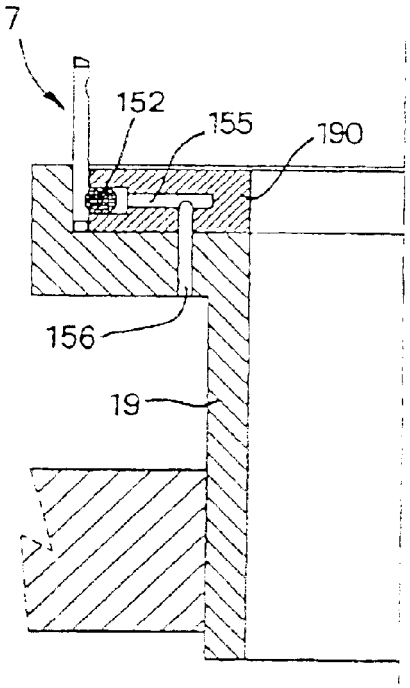
Figure 87:
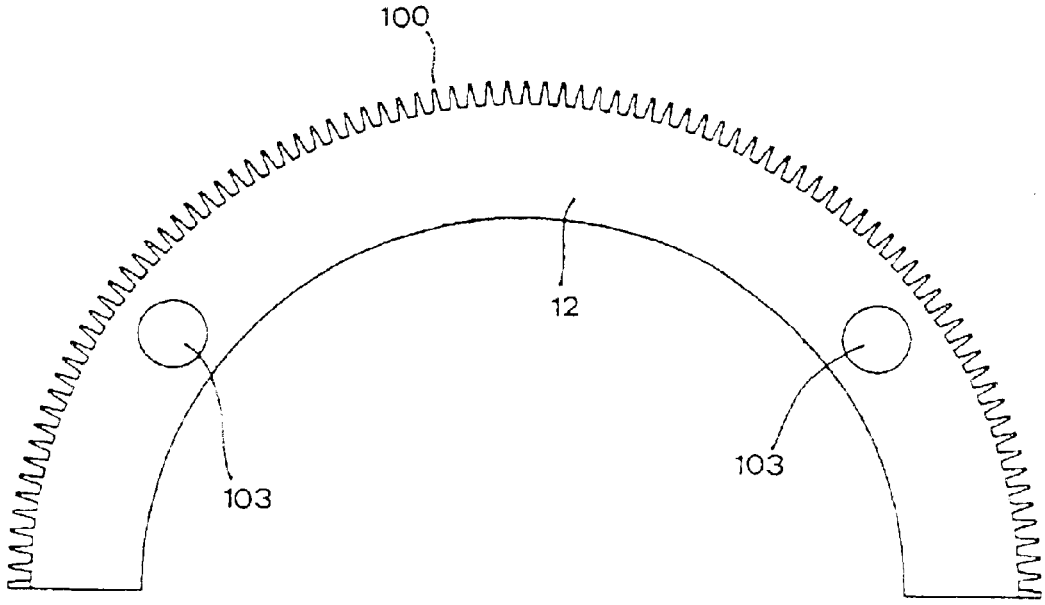
Figure 88:
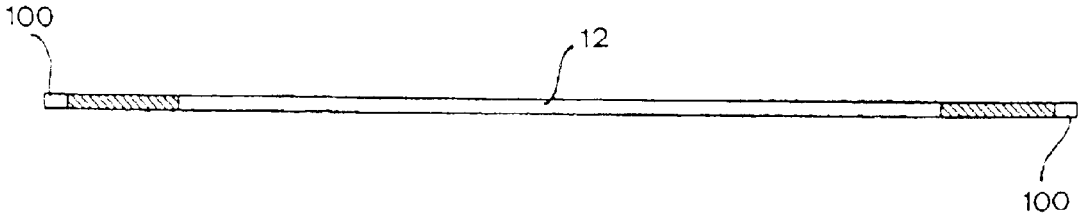
Figure 90:
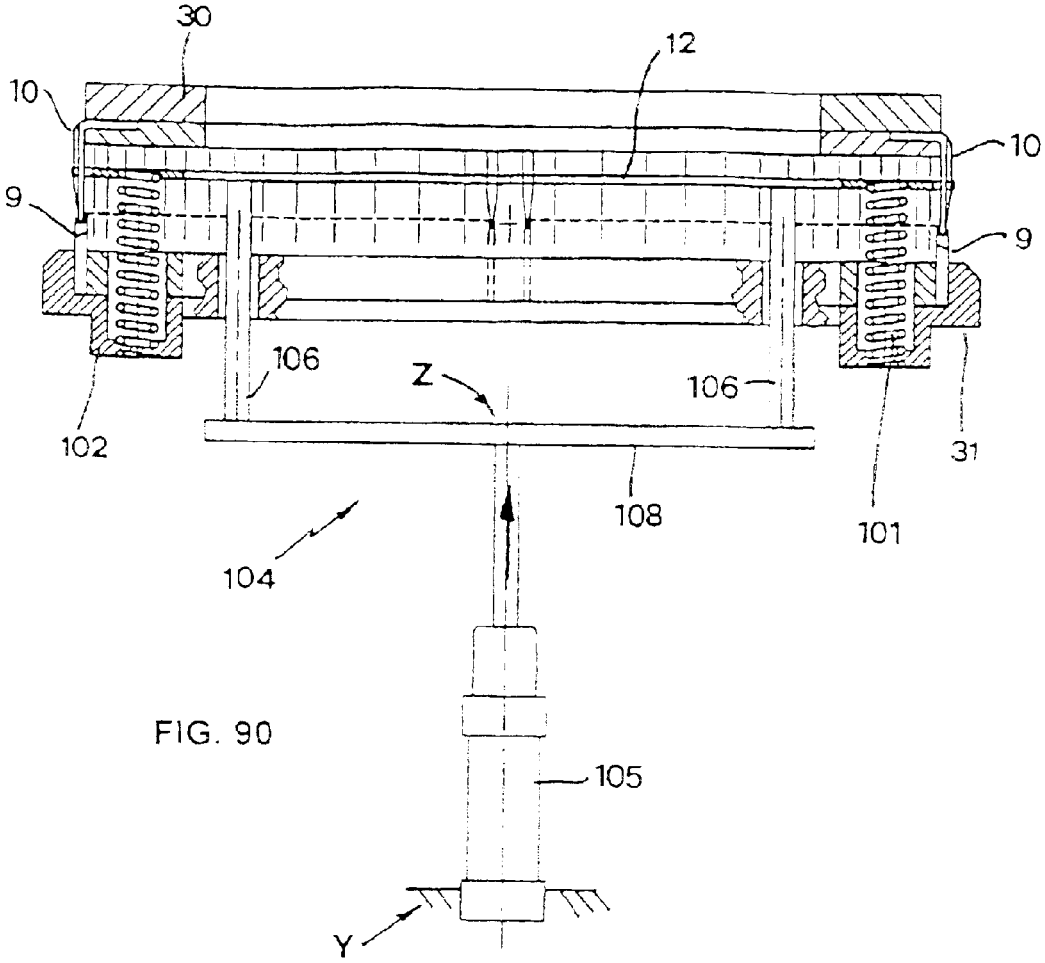
Figure 89:
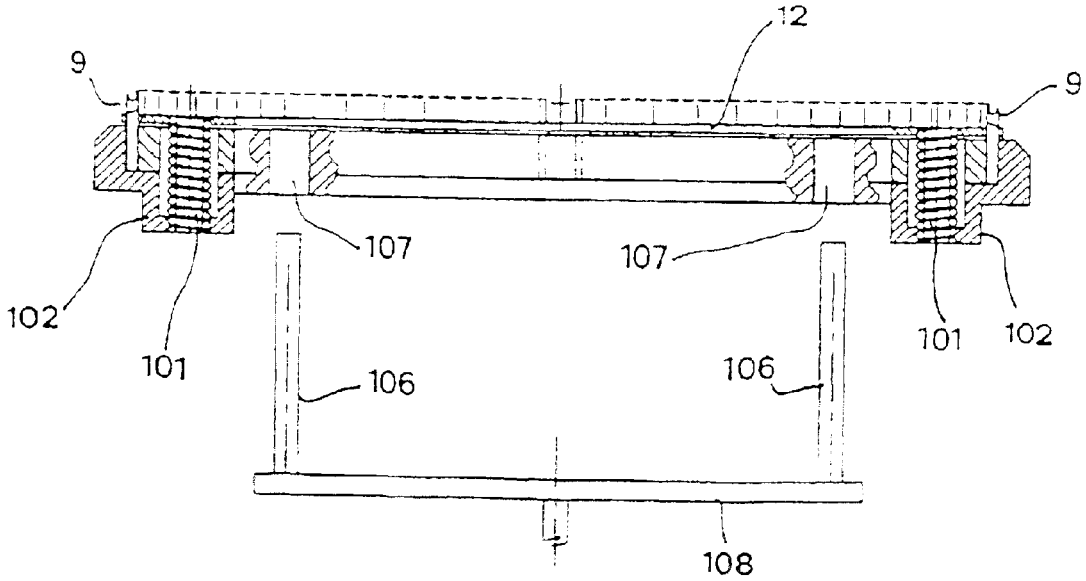
Figure 91:
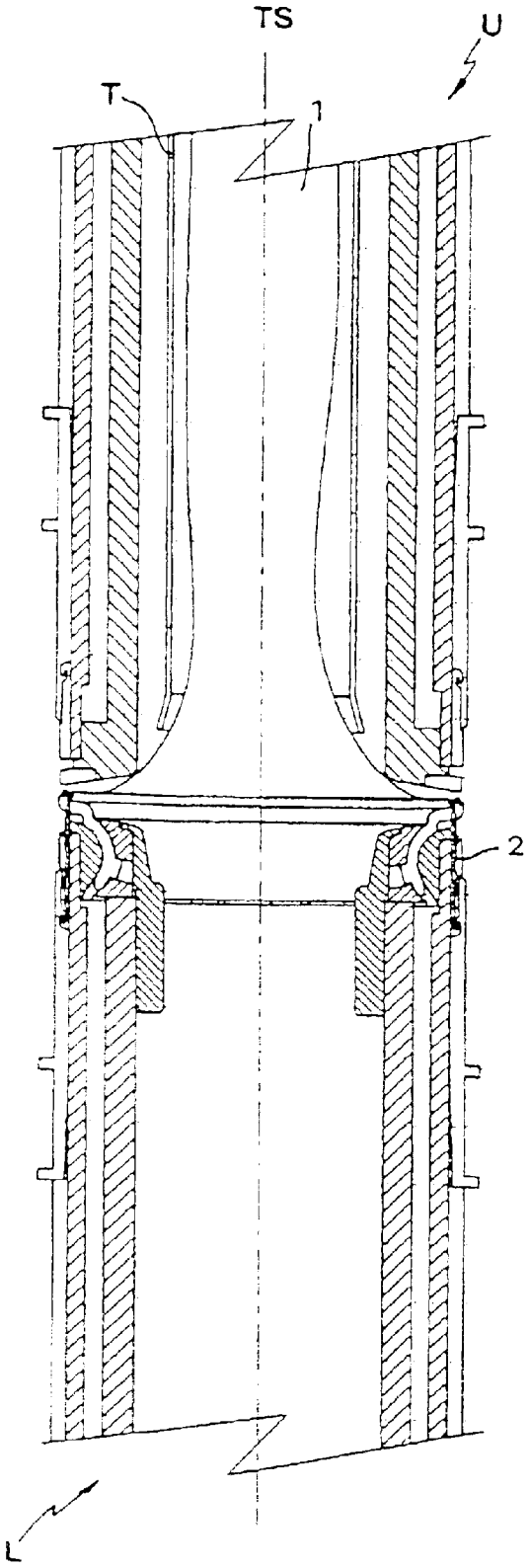
Figure 92:
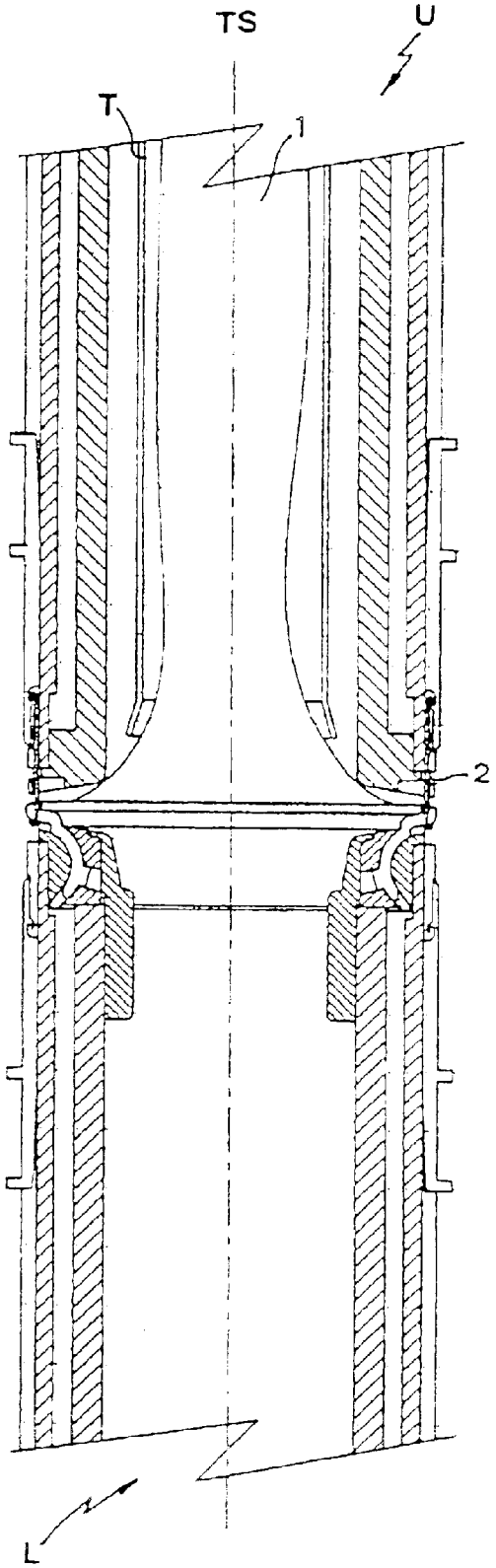
Figure 93:
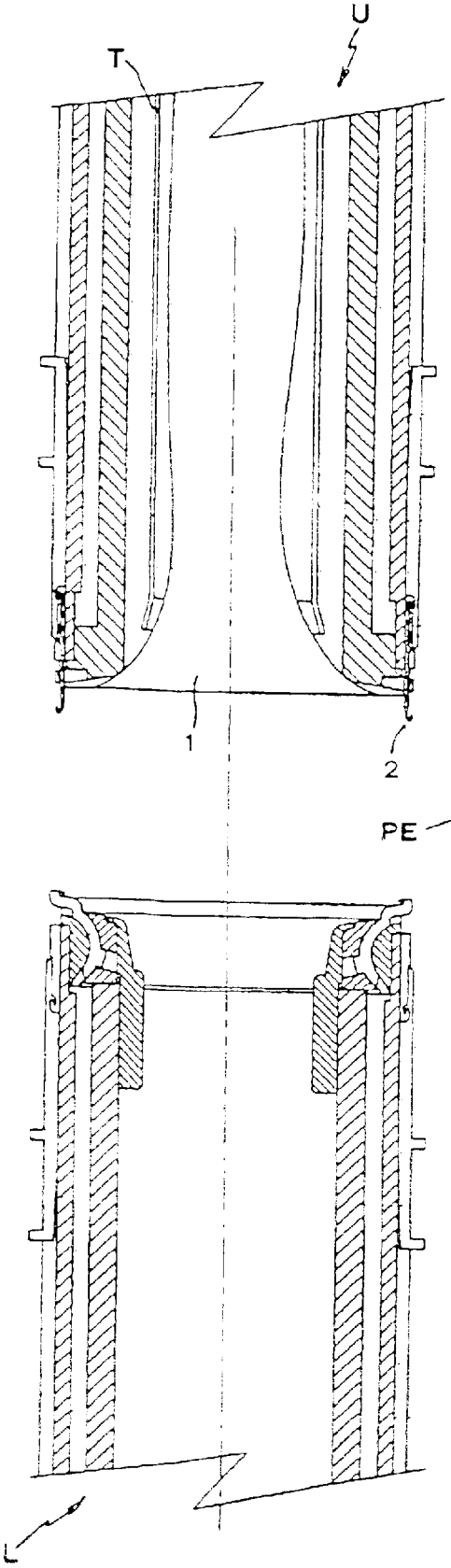
Figure 94:
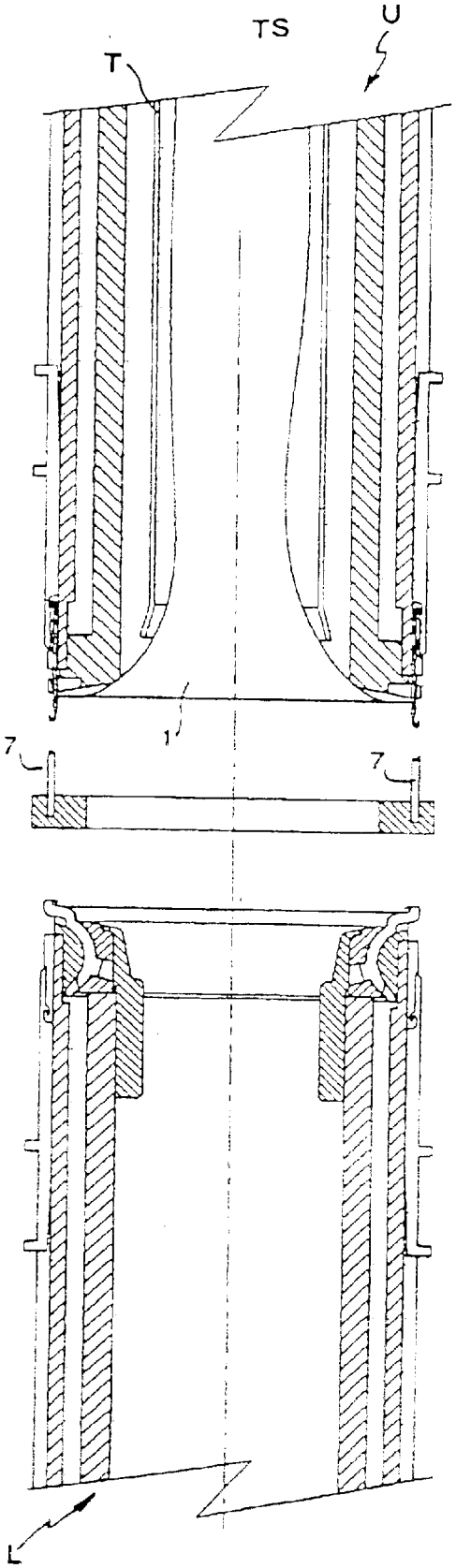
Figure 95:
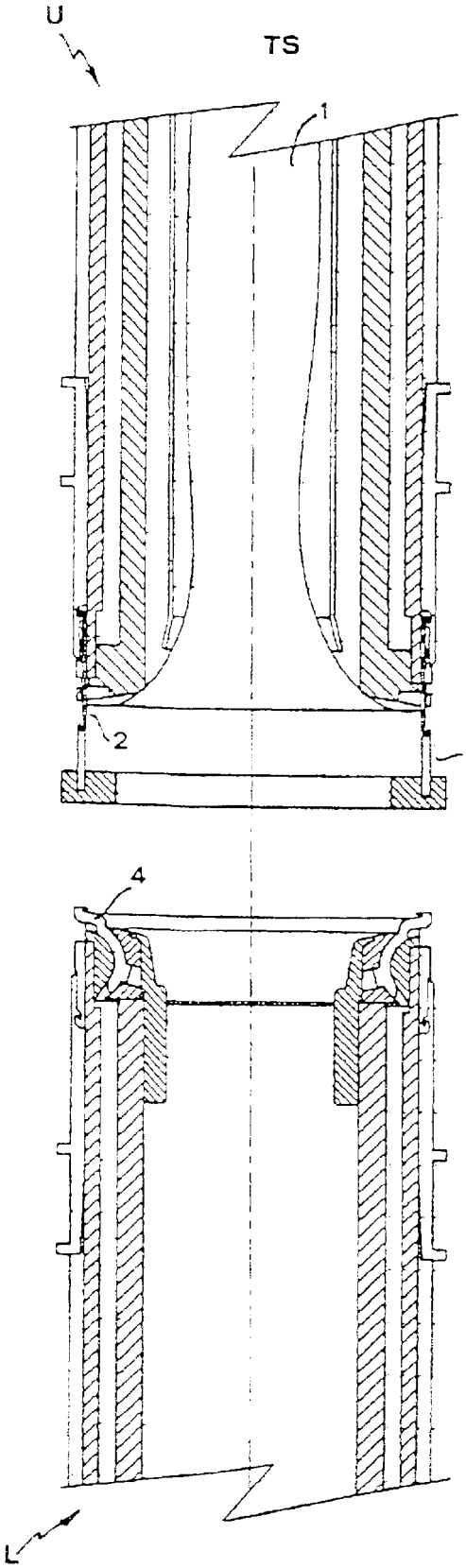
Figure 96:
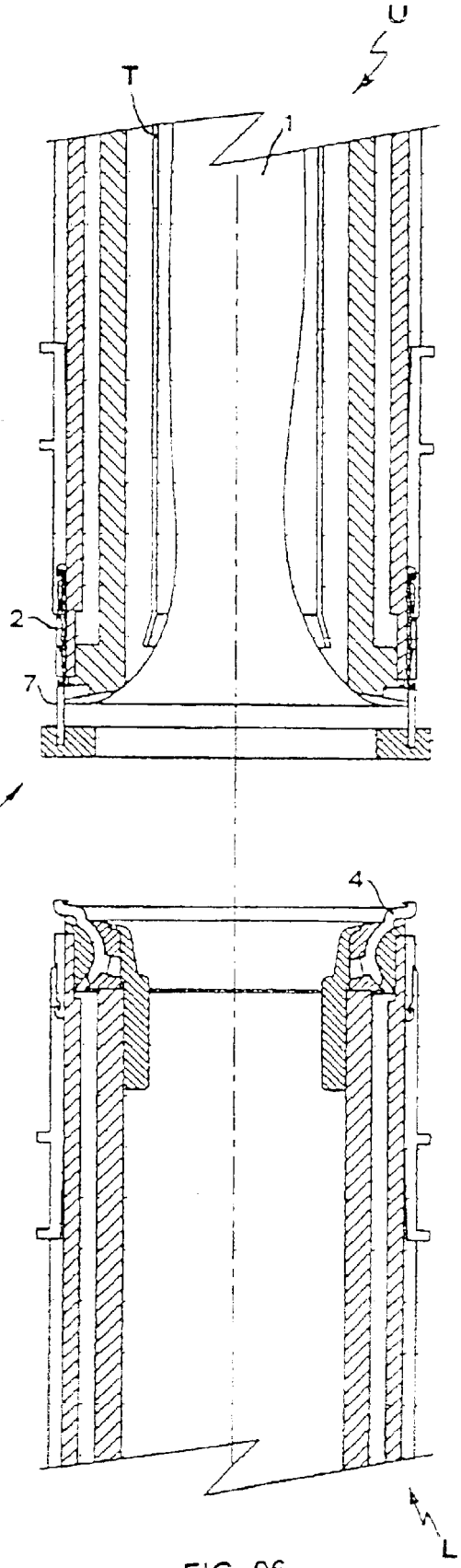
Figures 97, 98:
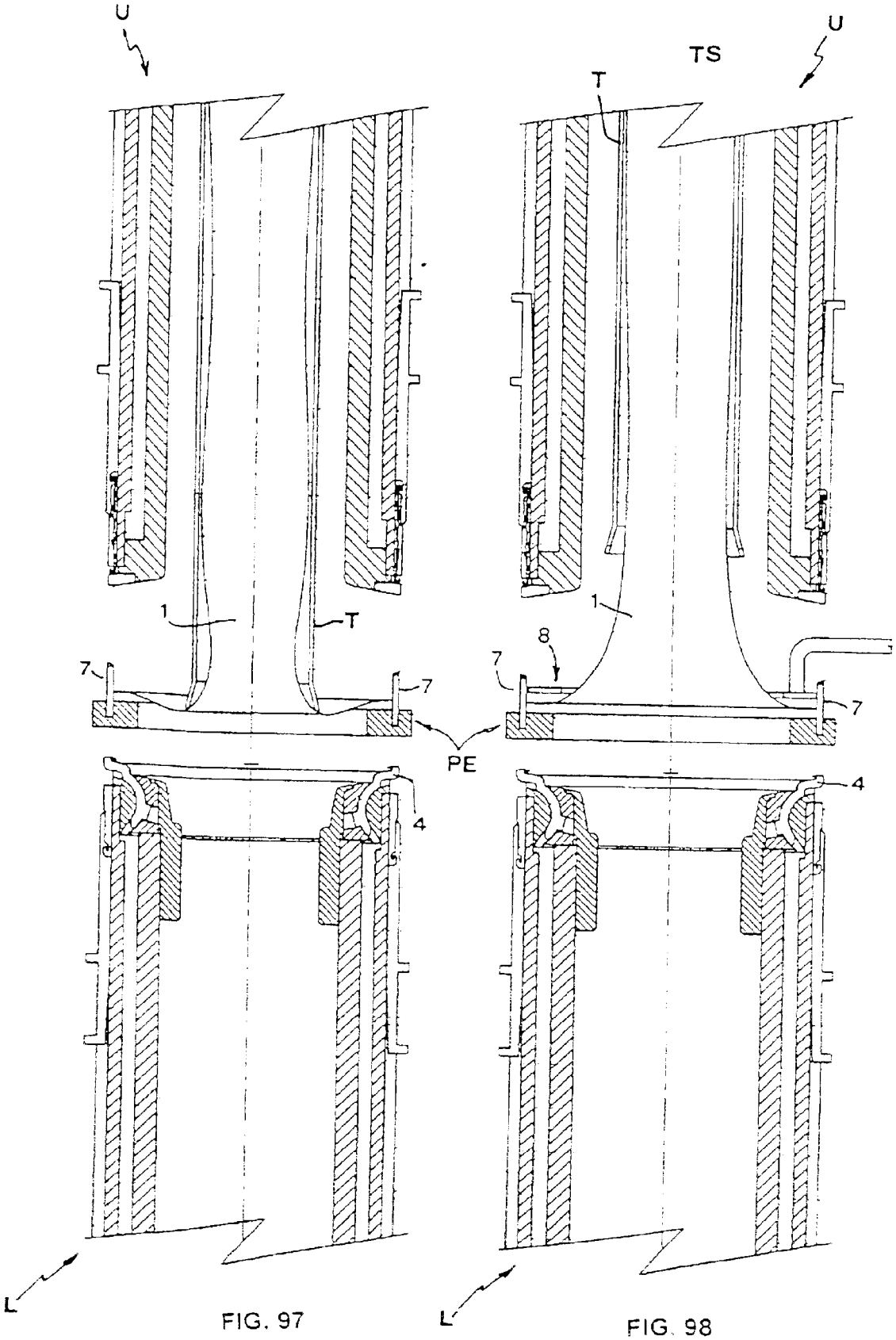
Figure 99:
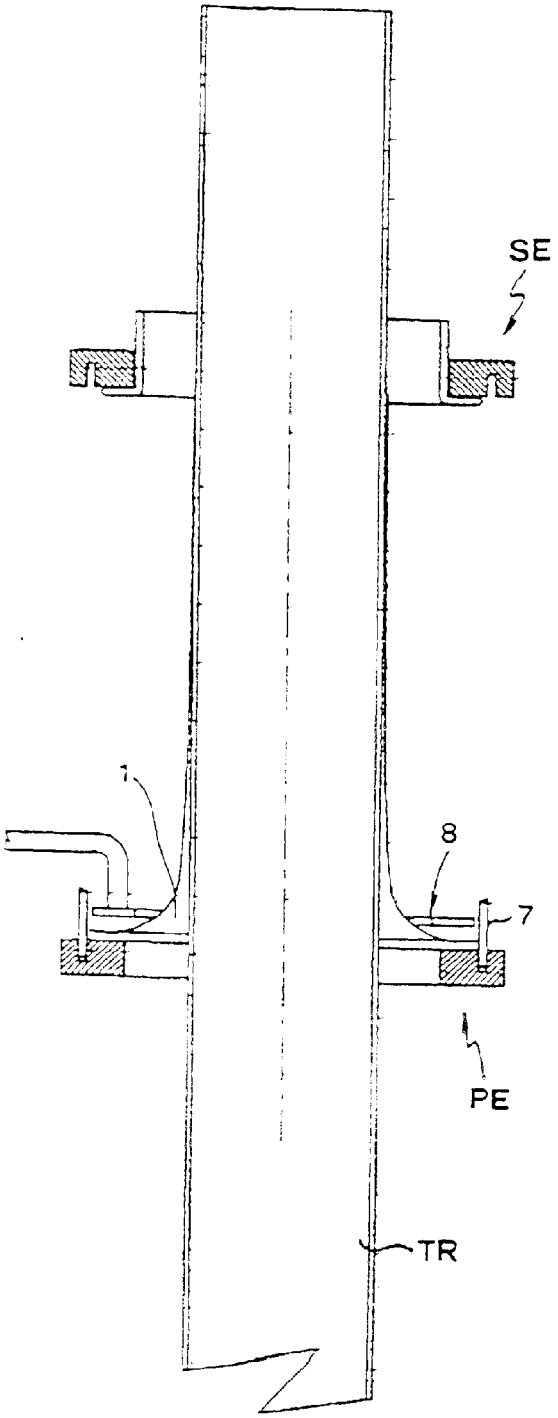
Figure 100:
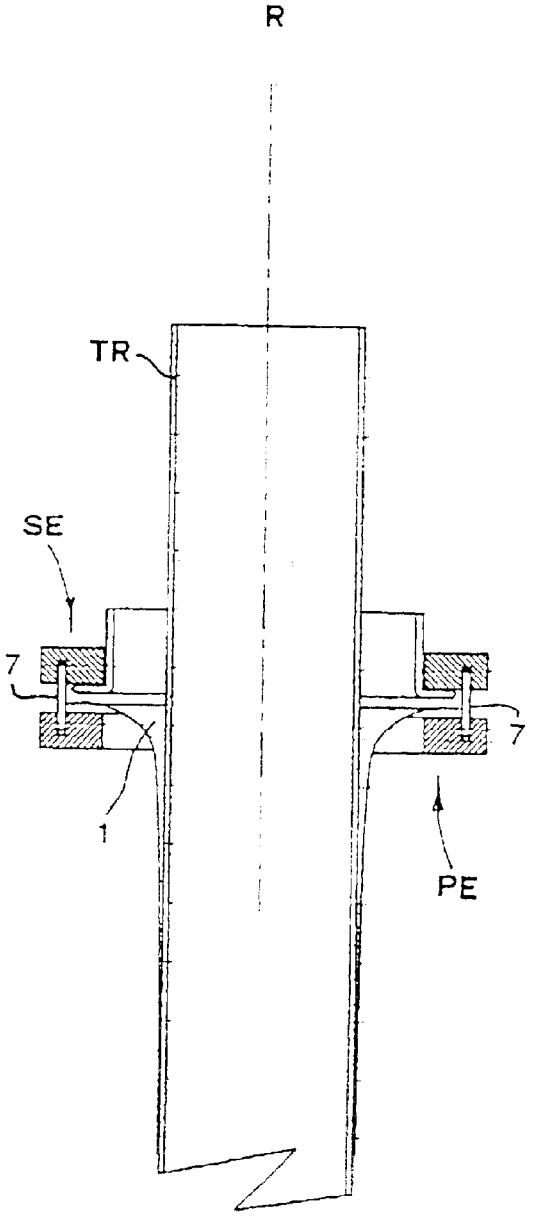
Figure 101:
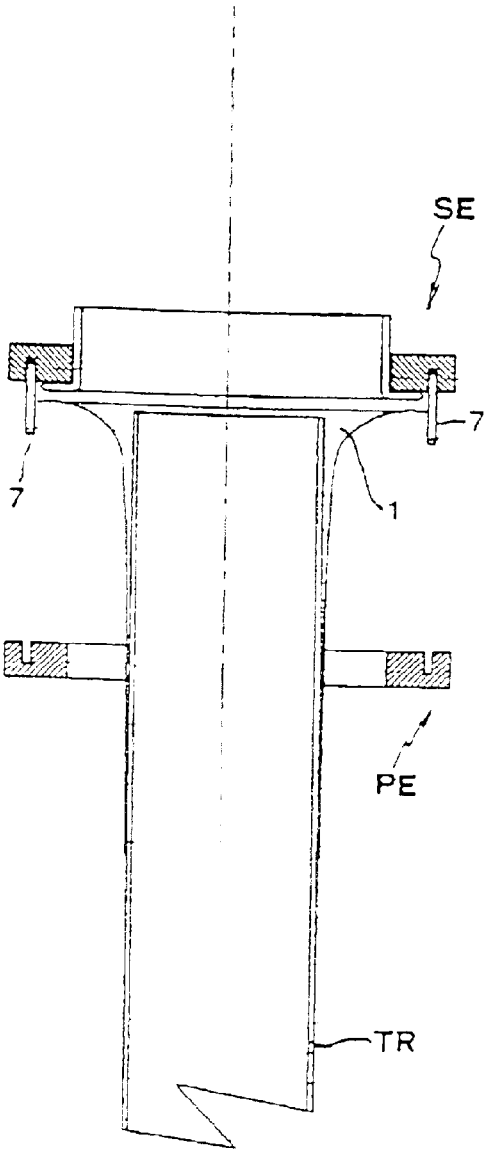
Figure 102:
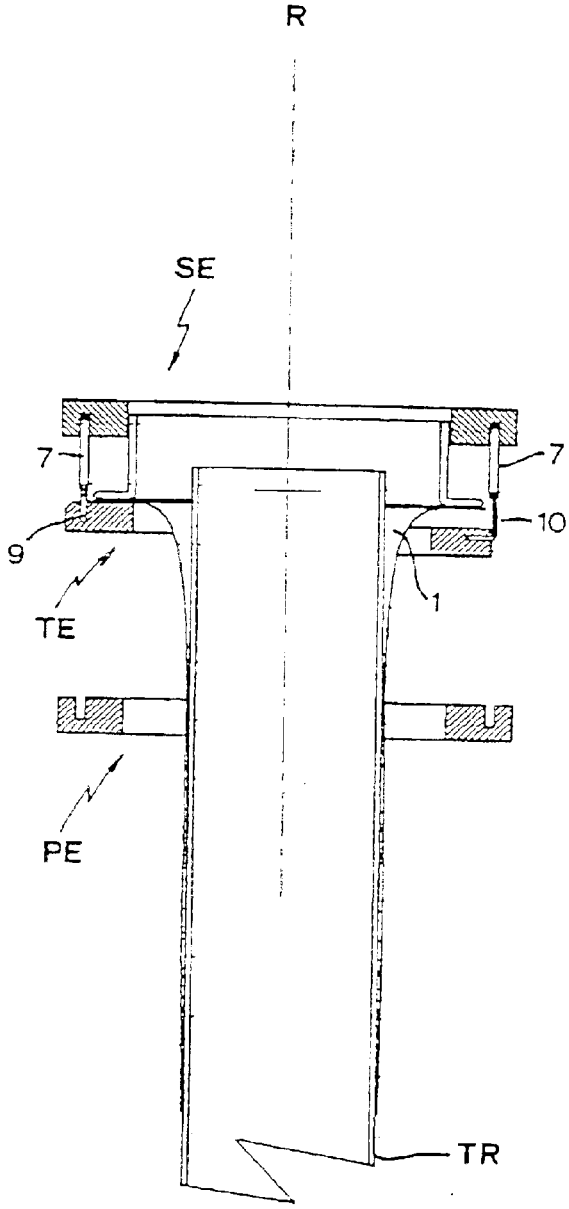
Figure 103:
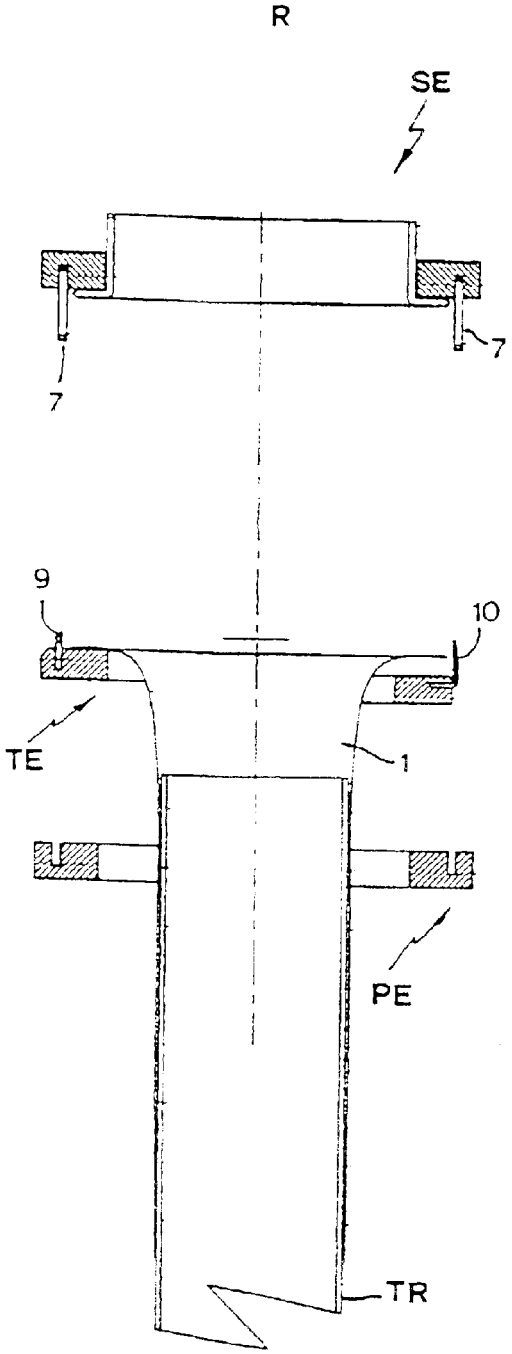
Figure 104:
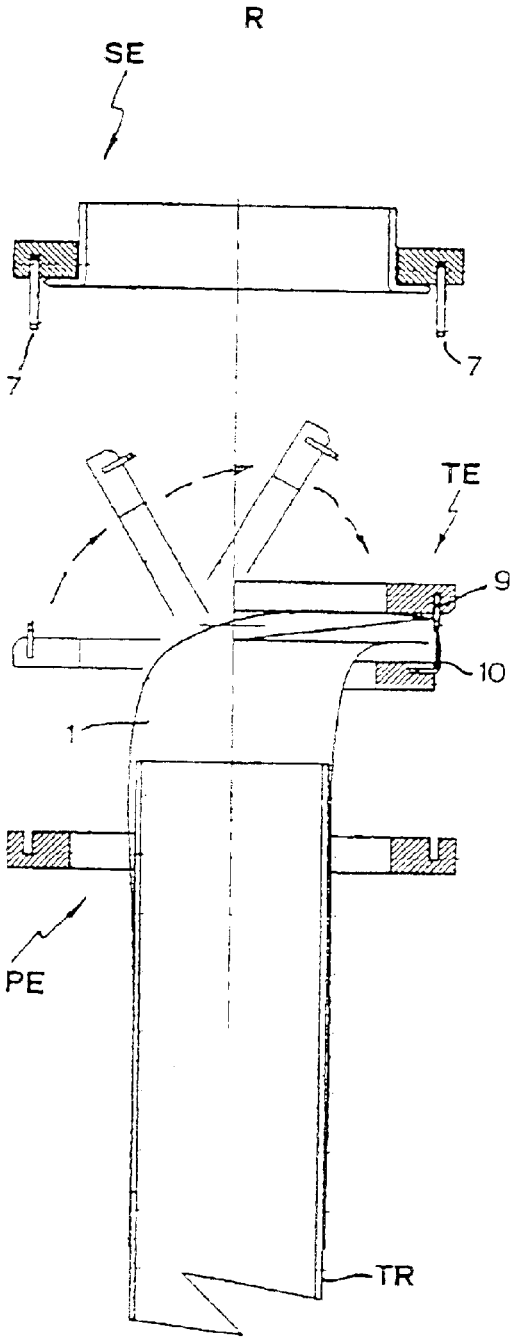
Figure 105:
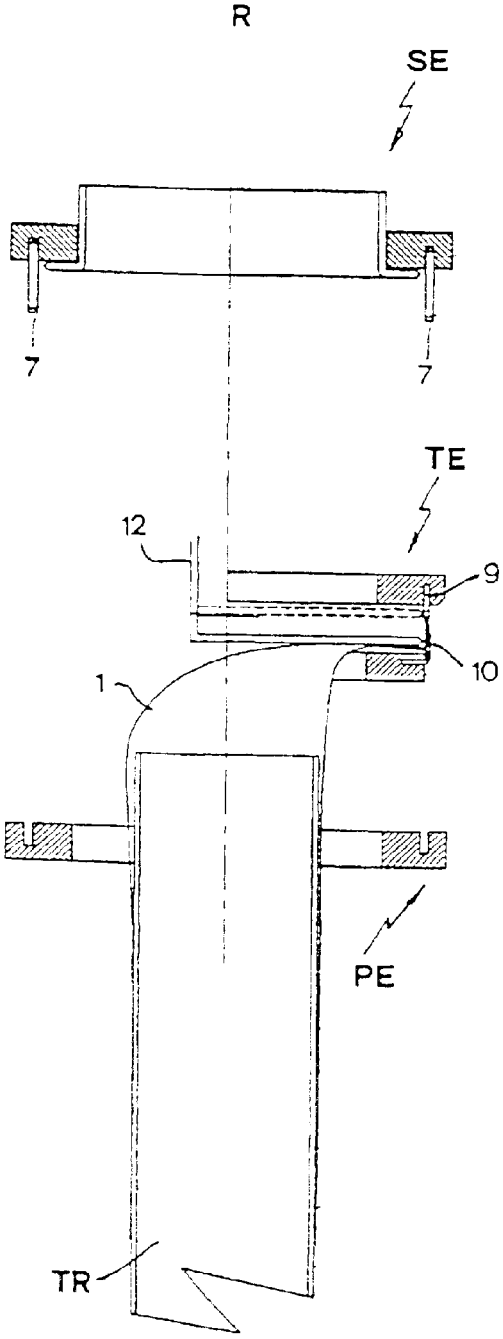
Figure 106:
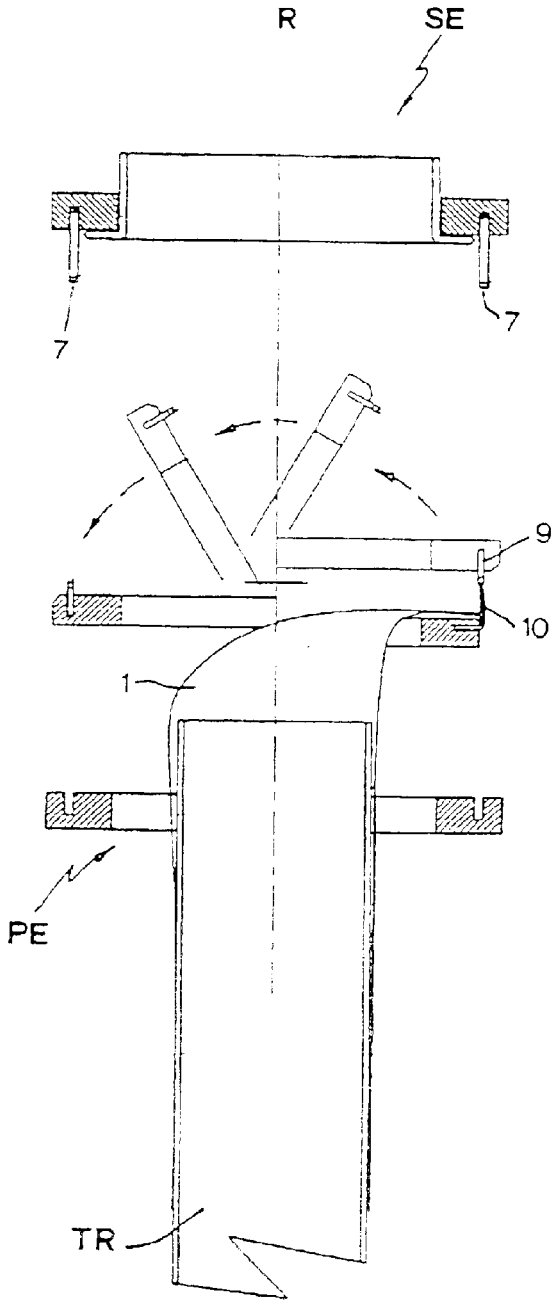
Figure 107:
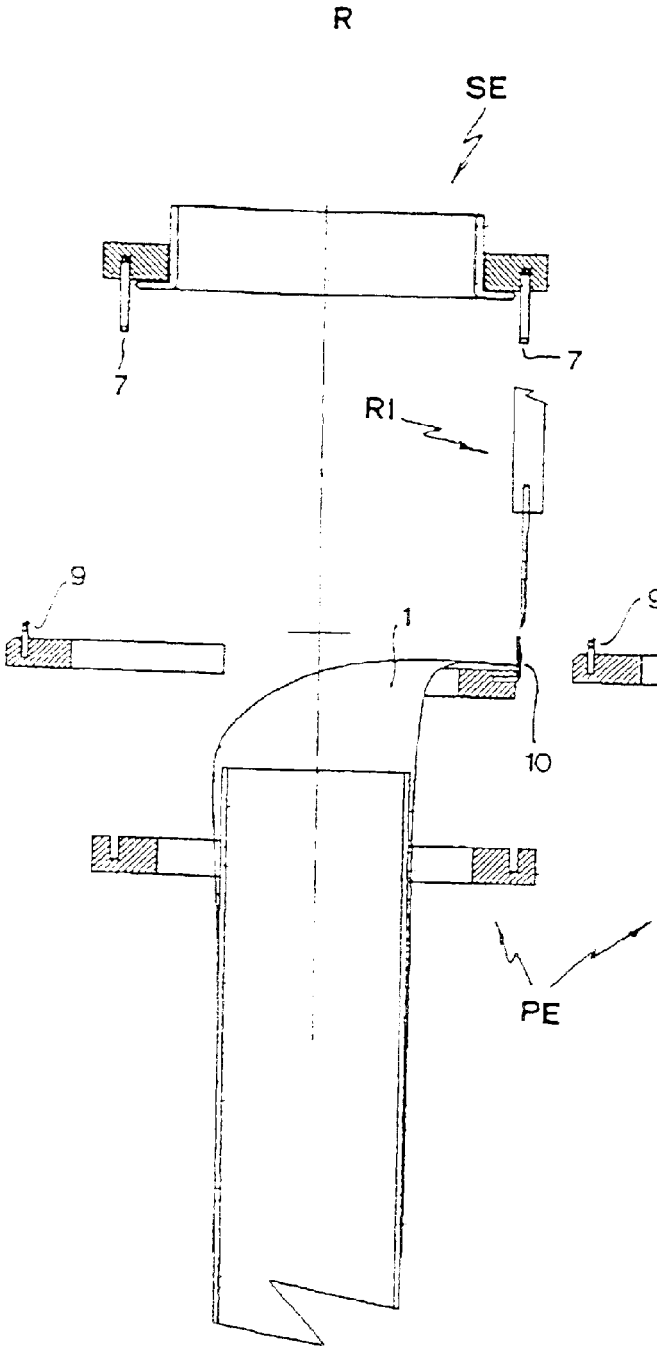
Figure 108:
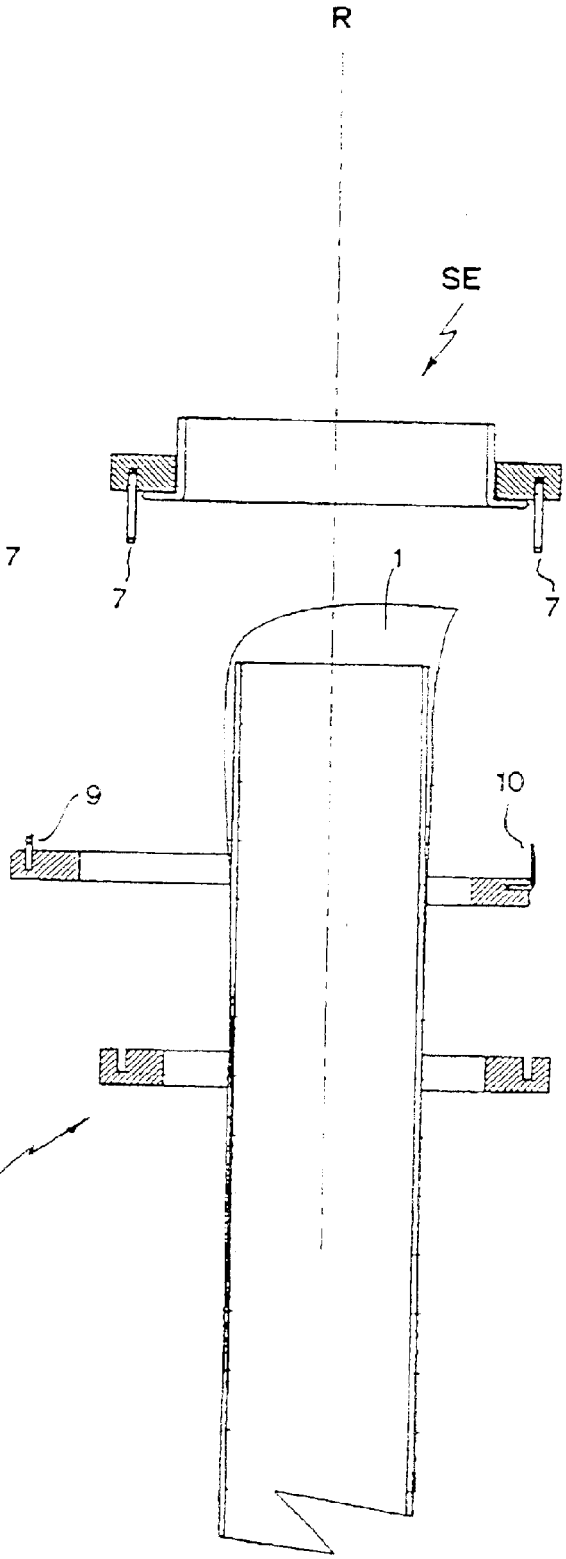
Figure 109:
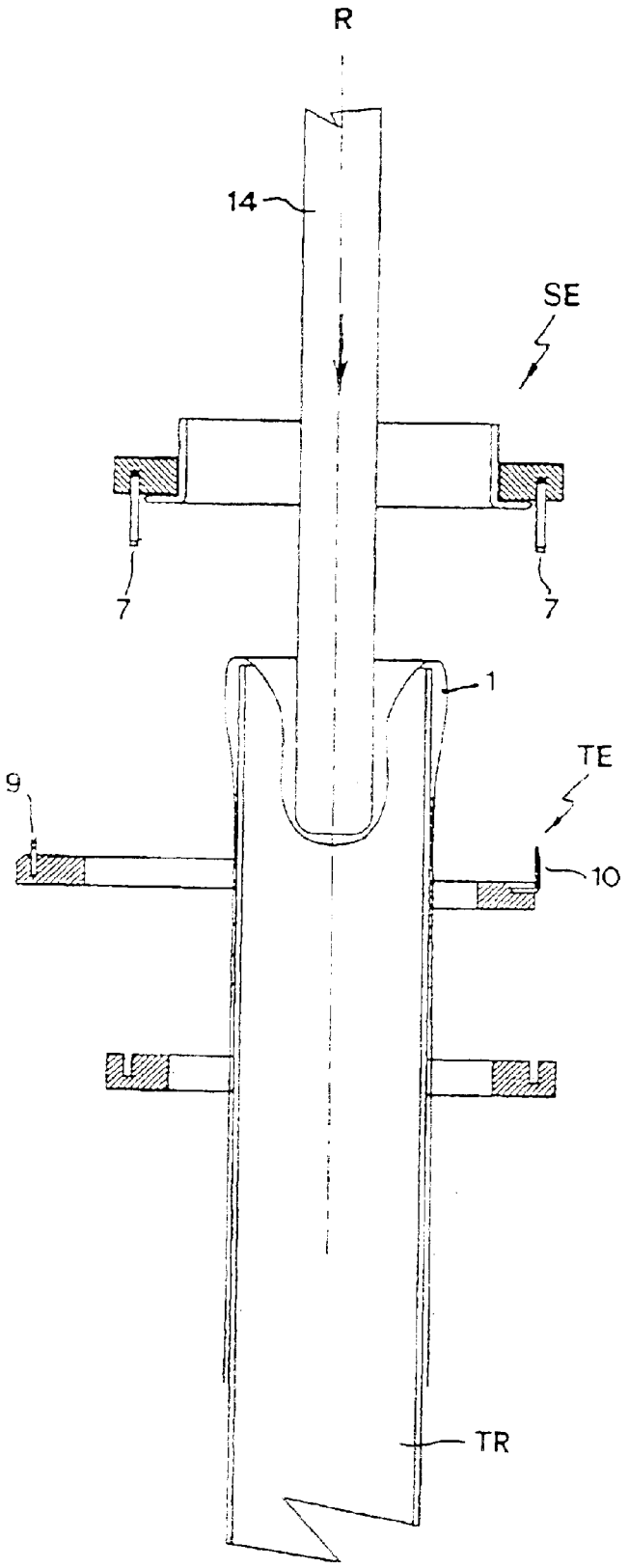
Figure 110:
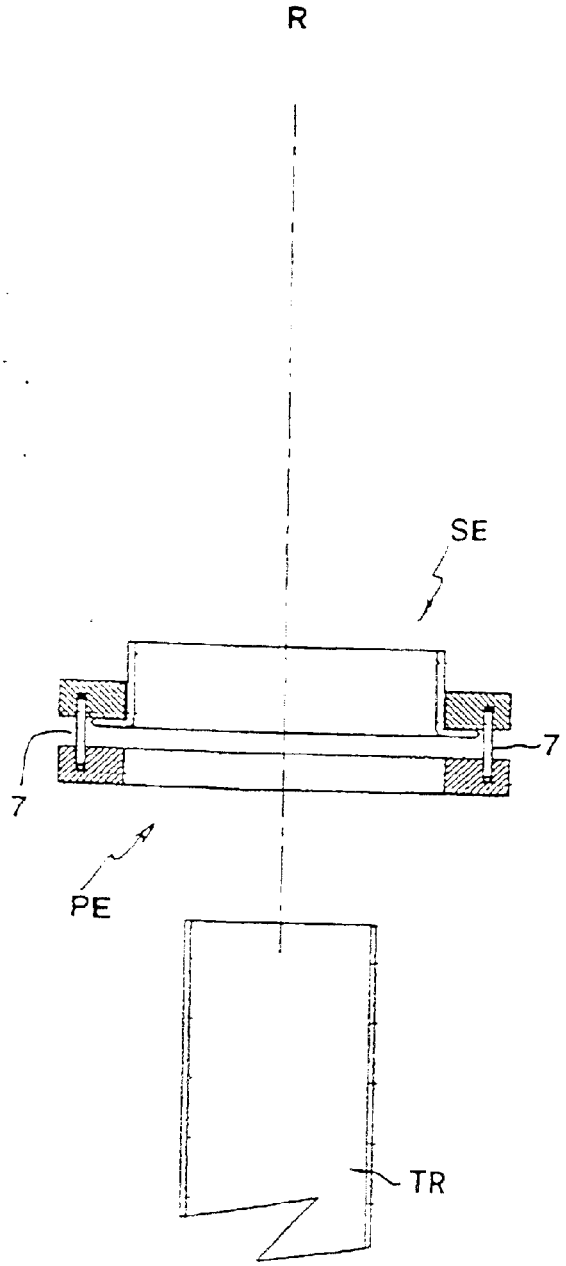
Figure 111:
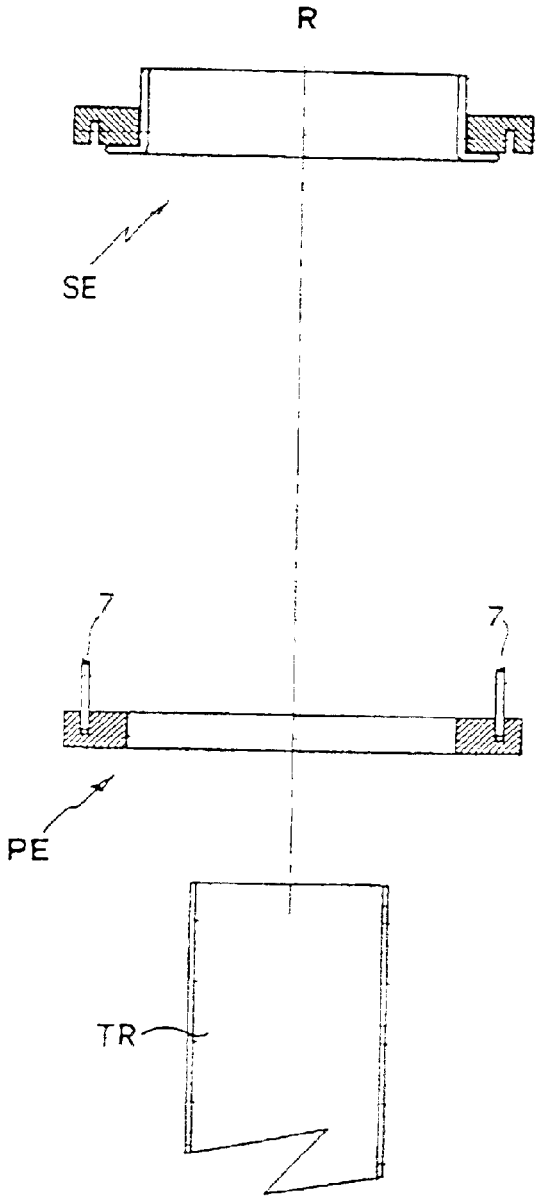
Figure 112:
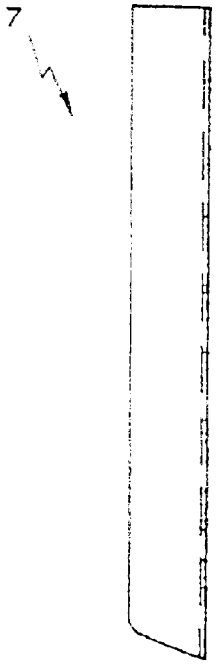
Figure 113:
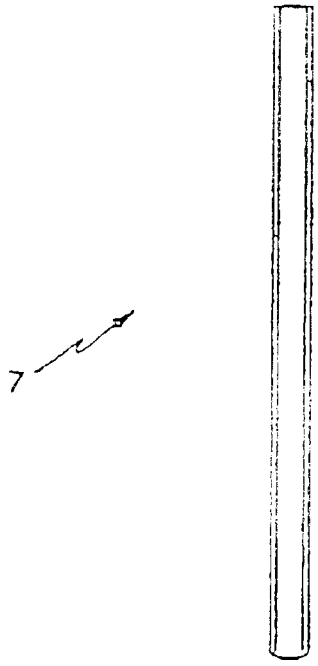
Figure 114:
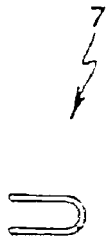
Figure 115:
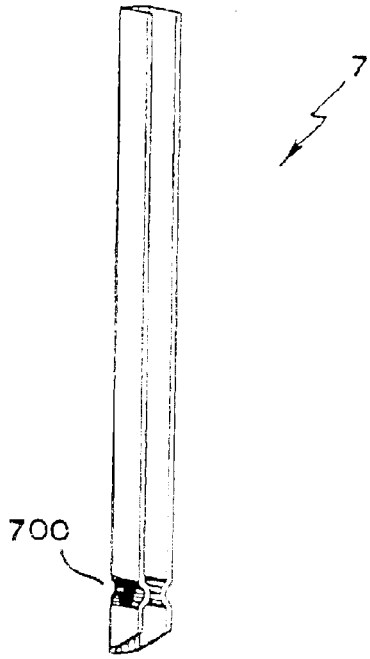
Figure 116:
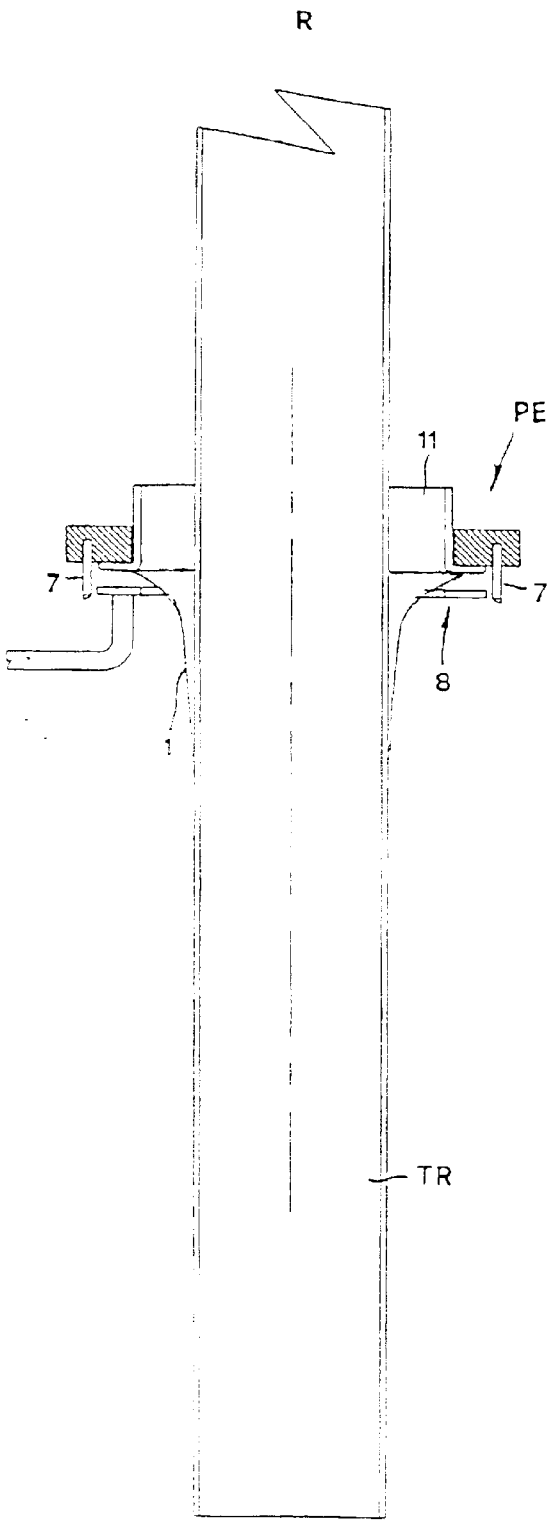
Figure 117:
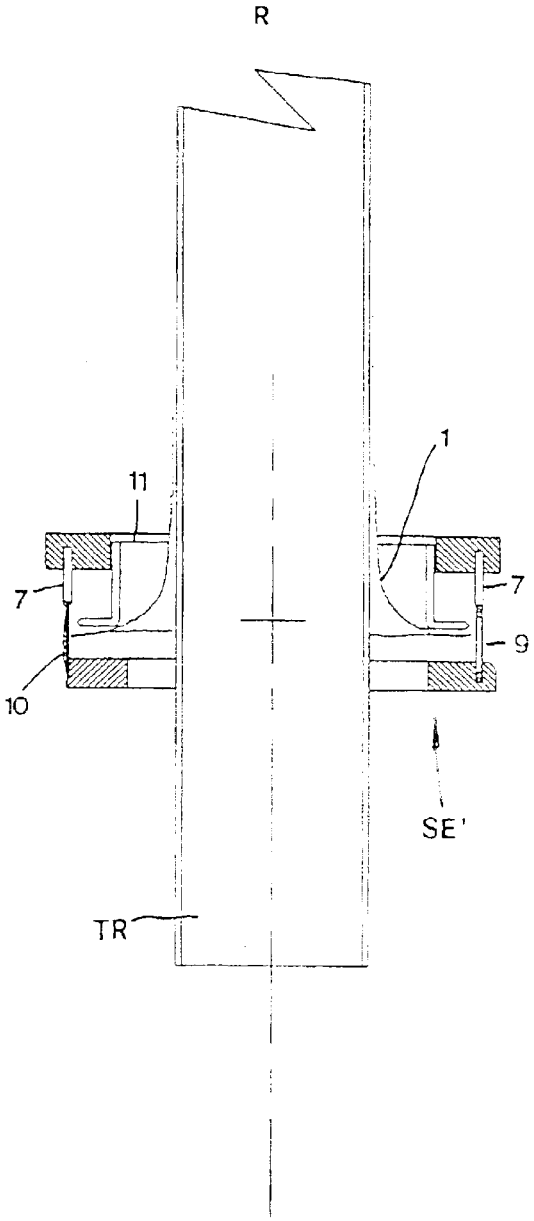
Figure 118:
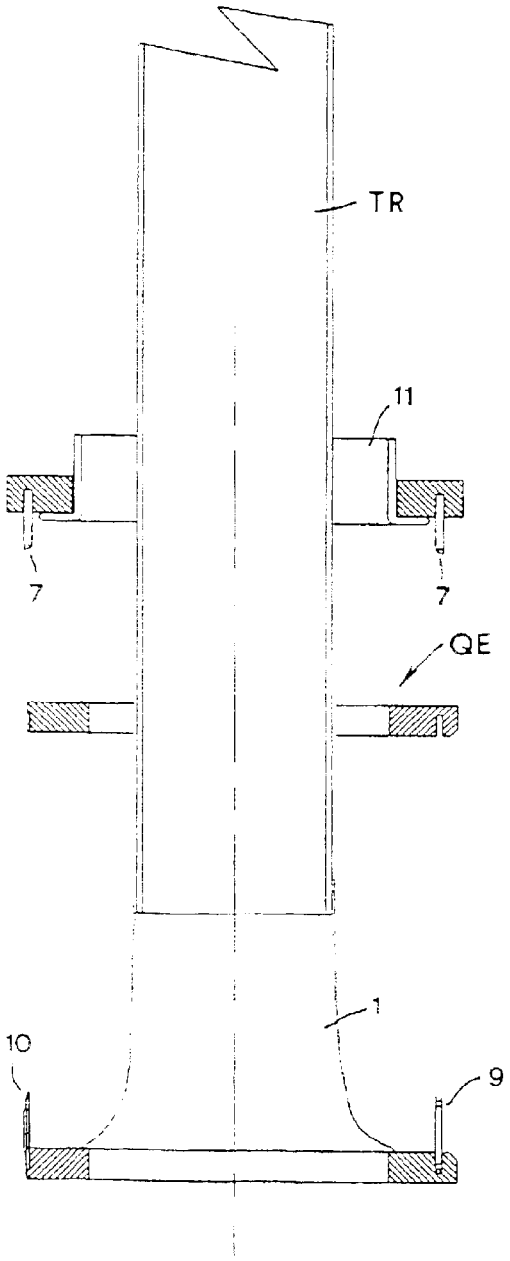
Figure 119:
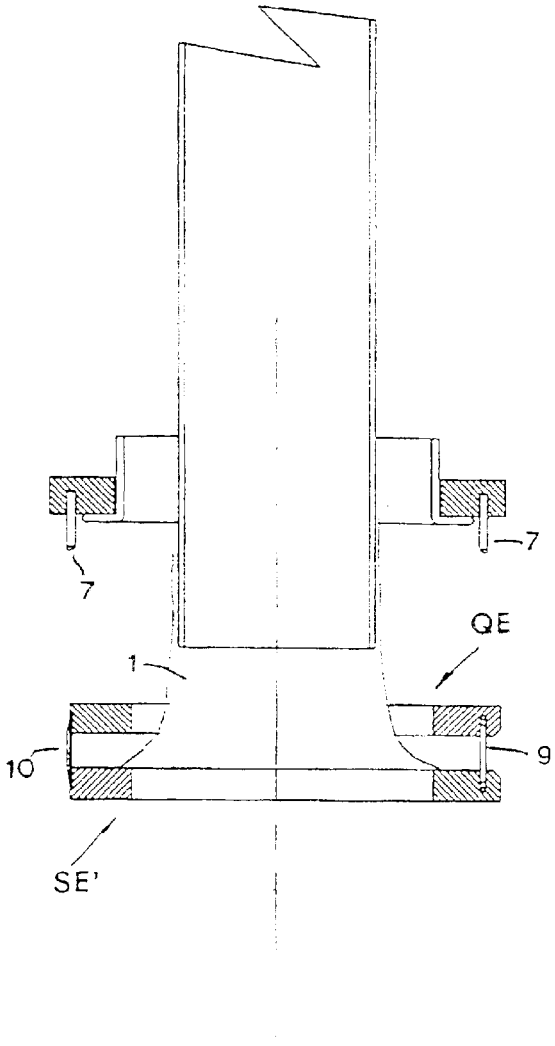
Figure 120:
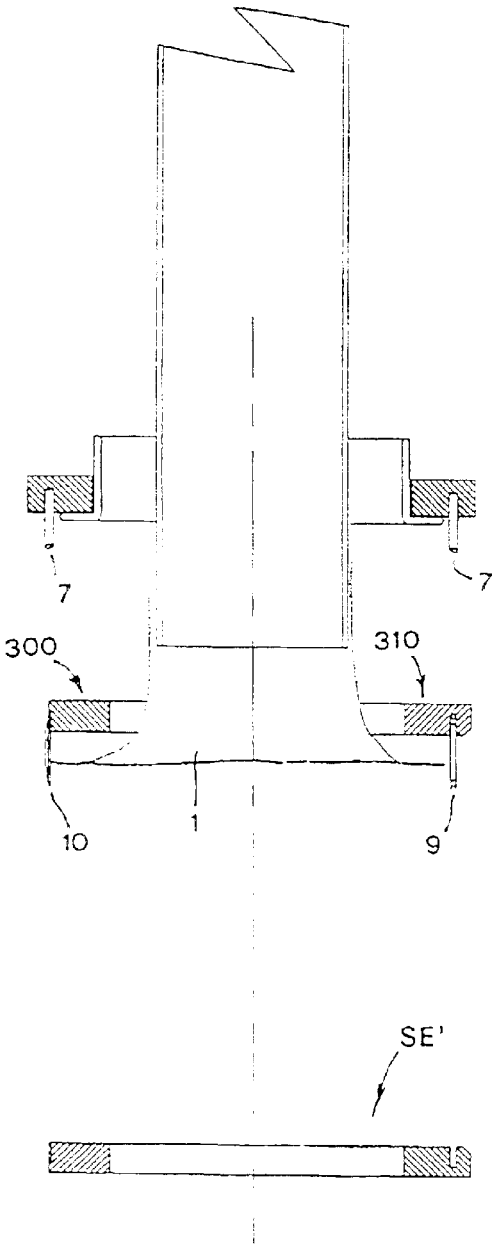
Figure 121:
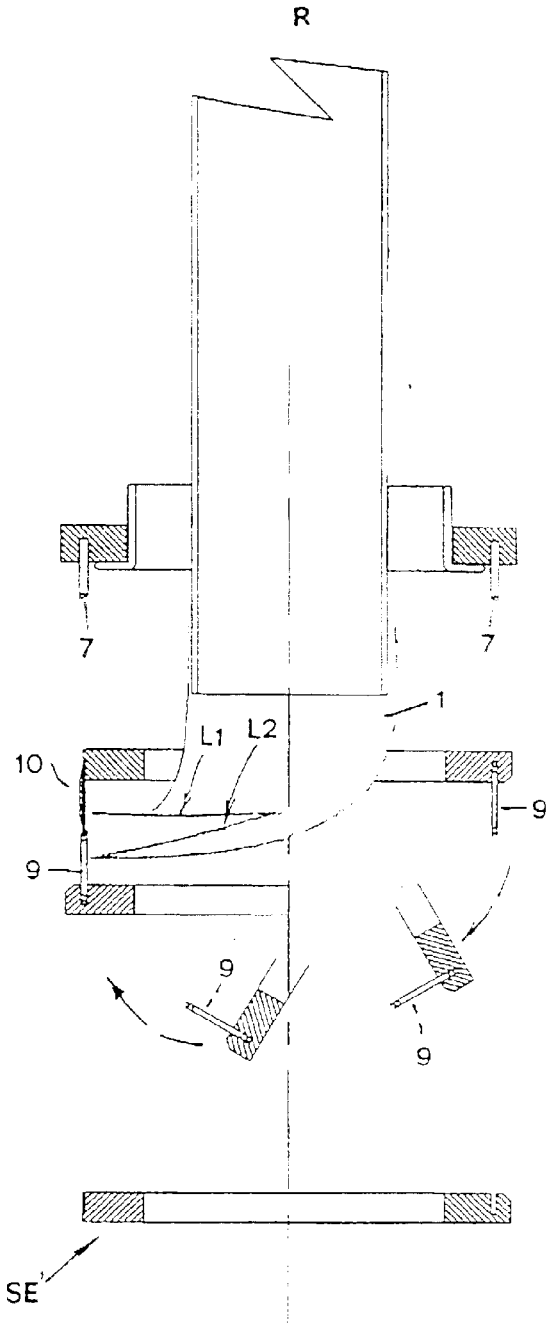
Figure 122:
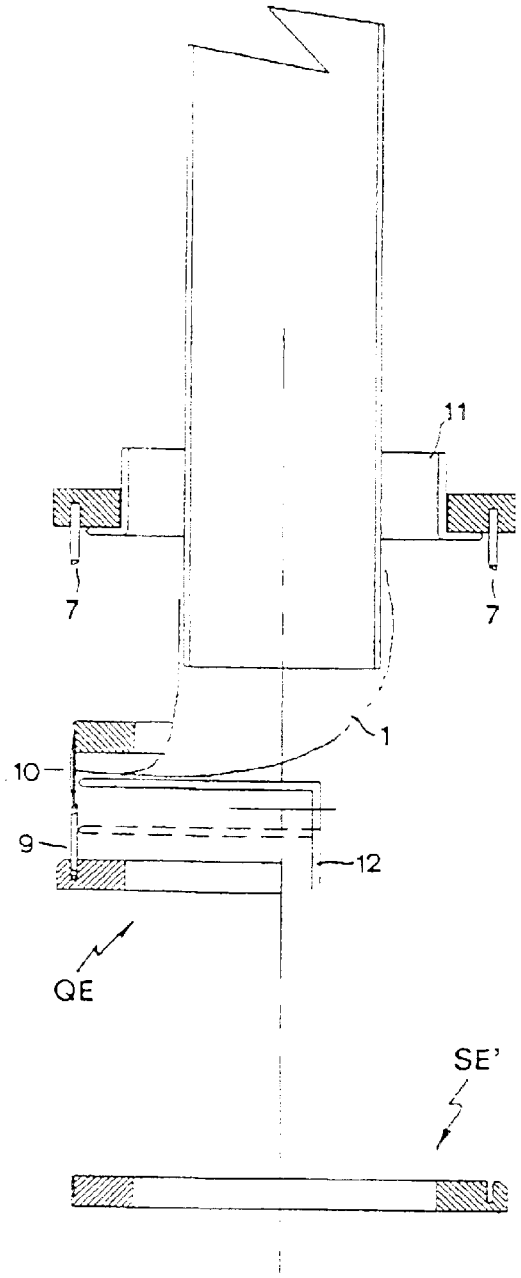
Figure 123:
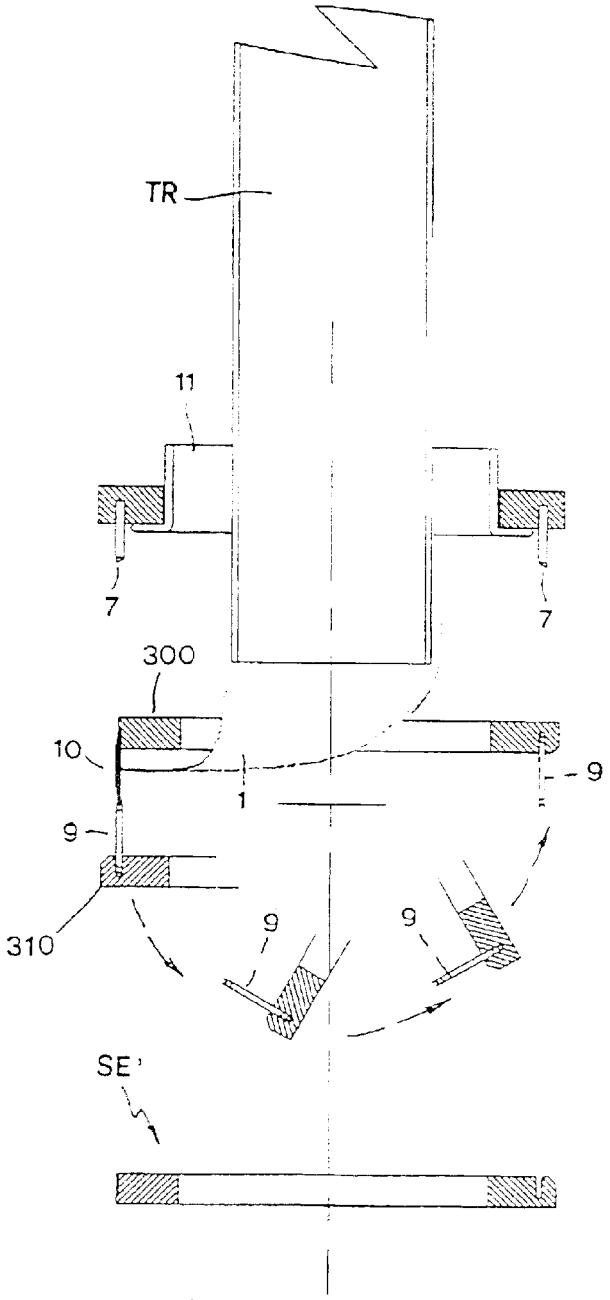
Figure 124:
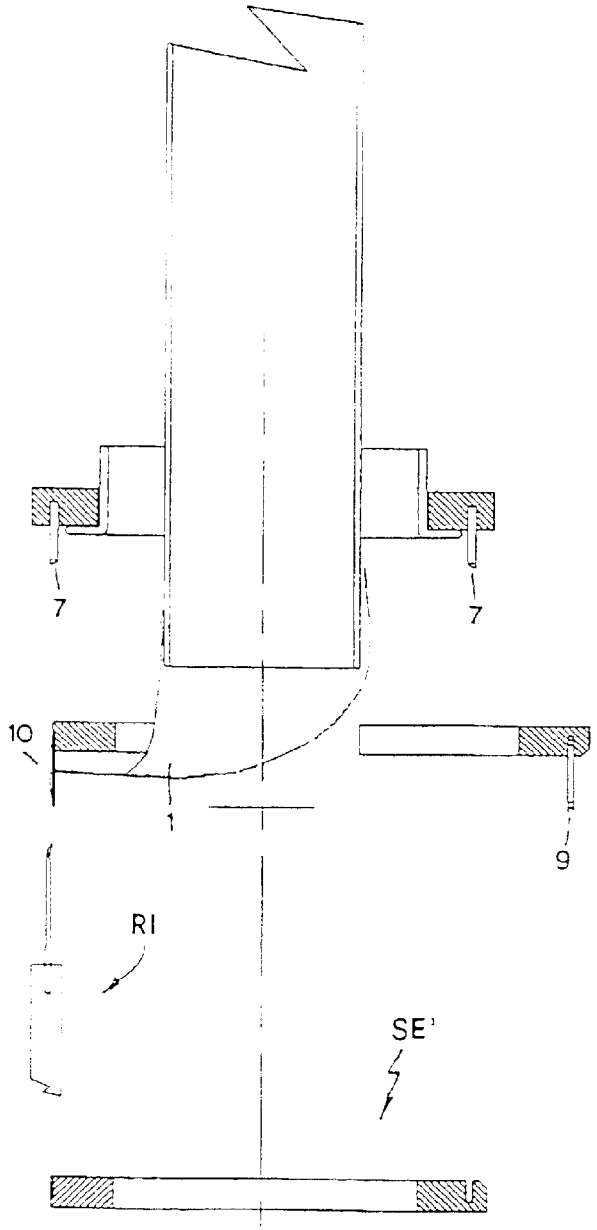
Figure 125:
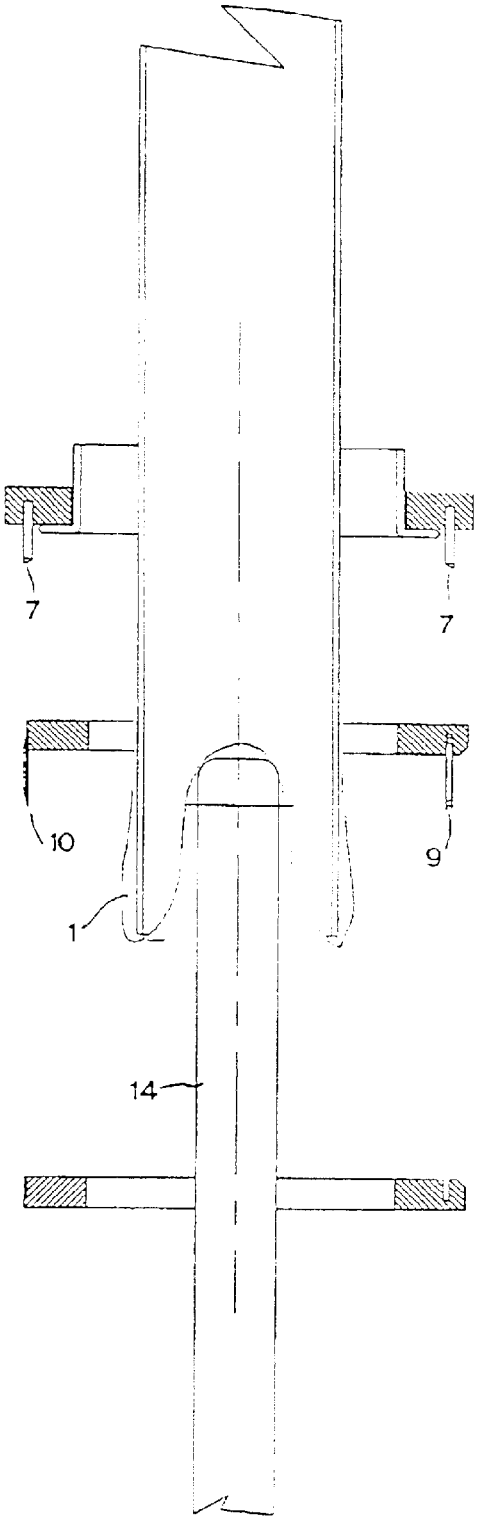
Figure 126:
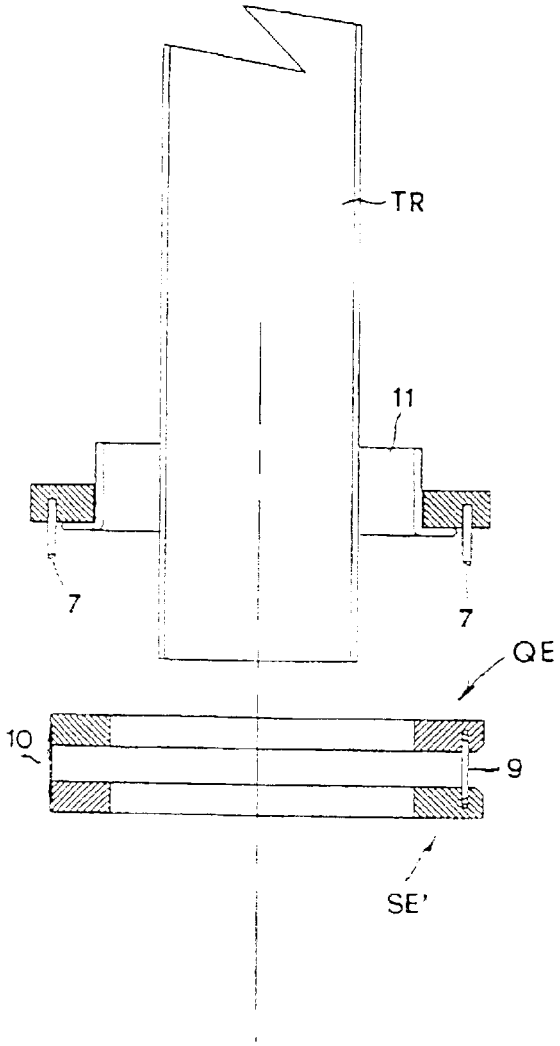

FIG. 82 refers to the example of FIG. 81 and shows a step in which the said means apt to define a cast-off plane are activated;

FIG. 83 shows an enlarged detail, in longitudinal section, of the second carrier (SE) in a condition of non-retention of the stitch-removing members;

FIG. 84 shows the detail of FIG. 83 in a condition of non-retention of the stitch-removing members;

FIGS. 85 and 86 show an enlarged detail, in longitudinal section, of the second carrier (SE) according to a further embodiment, in a condition of non-retention (FIG. 85) of the stitch-removing members;

FIG. 87 shows a plan view relative to a possible embodiment of the transfer rod (12);

FIG. 88 is a schematic rear view of the transfer rod of FIG. 87;

FIGS. 89 and 90 are two views in diametral section of an exemplary embodiment relating to a possible way of using the transfer rod illustrated in FIGS. 87 and 88, said rod being in stand-by (FIG. 89) and respectively work (FIG. 90) position;

FIG. 91 shows the step of ending the knitting of a stocking by a two-cylinder circular machine, with the stocking being in the upper cylinder;

FIG. 92 shows a subsequent step in which the knitting needles are transferred from the lower to the upper cylinder;

FIG. 93 shows the lifting of the upper cylinder;

FIG. 94 shows the step of moving the first movable carrier between the lower and the upper cylinder, the latter being lifted up;

FIG. 95 shows the drawing of the first movable carrier near the needles associated with the upper cylinder;

FIG. 96 shows the step of removing the stitches of the last knitted rank of the stocking of FIG. 91;

FIG. 97 shows the lowering of the first movable carrier with the stitches of the last knitted rank being now engaged with the removal members mounted on said carrier;

FIG. 98 shows the drawing up of a possible safety device;

FIG. 99 shows the introduction of an eversion tube into the article being transferred to a station other than that for knitting;

FIG. 100 shows the moving of the second movable carrier close to the first one and the turning right-side out of the stocking with a upwards movement of said everter tube;

FIG. 101 shows the transfer of said stitch-removing members from the first movable carrier to the first one;

FIG. 102 shows the moving of the third movable carrier close to the second;

FIG. 103 shows the moving of the second movable carrier away from the third;

FIG. 104 shows an overturning through 180° of a semirank of stitches;

FIG. 105 shows a transfer of the overturned stitches onto the spines which support the stitches of the other semirank;

FIG. 106 shows the repositioning of the third movable carrier into its initial configuration;

FIG. 107 shows the step of hooking-up the article;

FIG. 108 the release of the stitches already retained by the said spines;

FIG. 109 shows a possible step of everting the stocking being released;

FIG. 110 shows the transfer of the stitch-removing members from the second movable carrier to the first one;

FIG. 111 shows the moving of the second movable carrier away from the first one;

FIGS. 112, 113 and 114 show a side view, a front view and respectively a plan view of the stitch-removing member according to a further embodiment;

FIG. 115 shows, in perspective view, a modified embodiment of the member shown in FIGS. 112-114;

FIGS. 116-127 correspond to FIGS. 7-18 but refer to a modified embodiment of the process according to the invention;

FIG. 128 shows a detail of the apparatus that can be used to implement the method of FIGS. 116-127;ù

Figure 134:
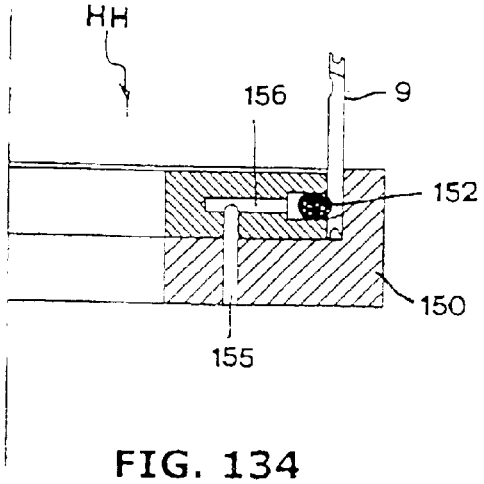
Figure 133:
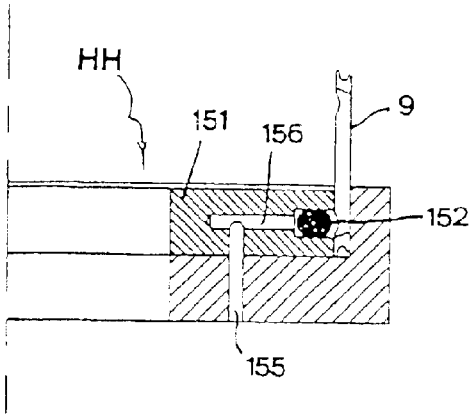
Figure 132:
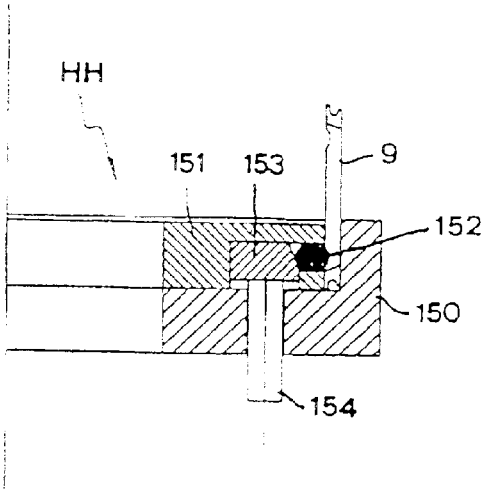
Figure 131:
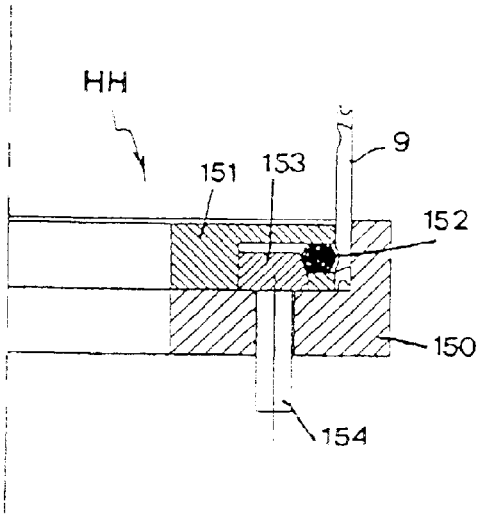
Figure 135:
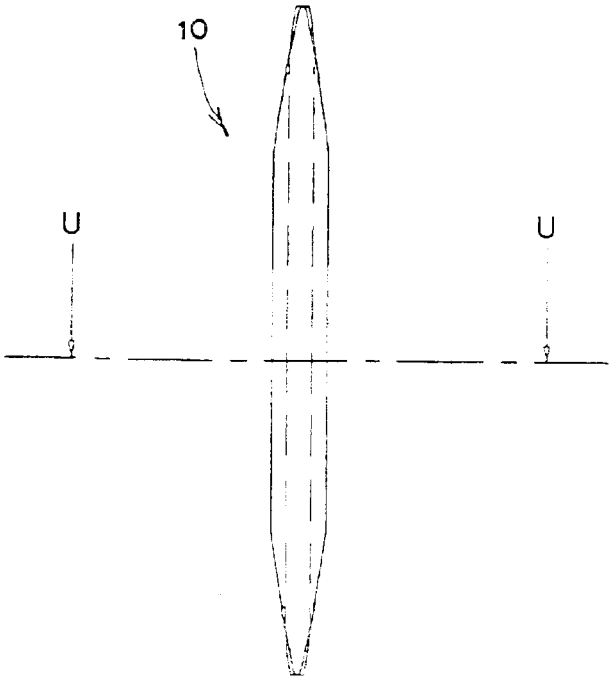
Figure 136:
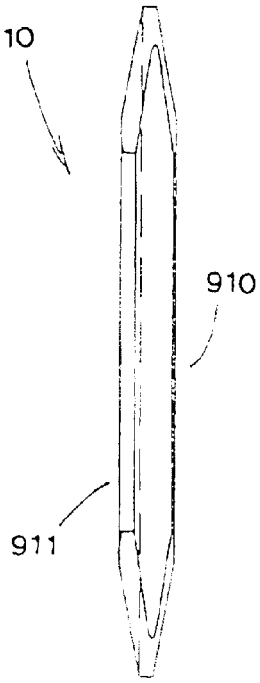
Figure 138:
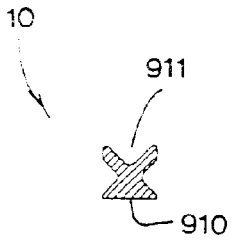
Figure 137:
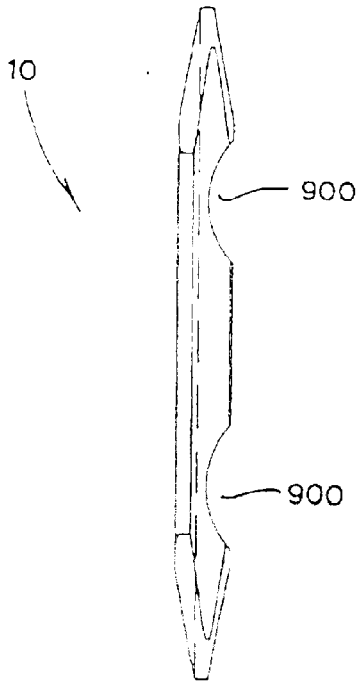

FIG. 129 is a view in diametral section of the apparatus of FIG. 128;

FIG. 130 shows an enlarged detail of the drawing in FIG. 128;

FIGS. 131 and 132 show a detail of the apparatus that can be used to implement the method of FIGS. 116-127 in a non-retention and respectively retention or locking configuration of the rods (9);

FIGS. 133 and 134 show a variation of the apparatus illustrated in FIGS. 131 and 132;

FIGS. 135-137 show three views of a spine associable with the apparatus of FIG. 128;

FIG. 138 is a view in section on line U—U in FIG. 135;

FIGS. 139-147 show diagrammatically a case of handling the stitches of a straight, instead of a tubular fabric.

Figure 2A:
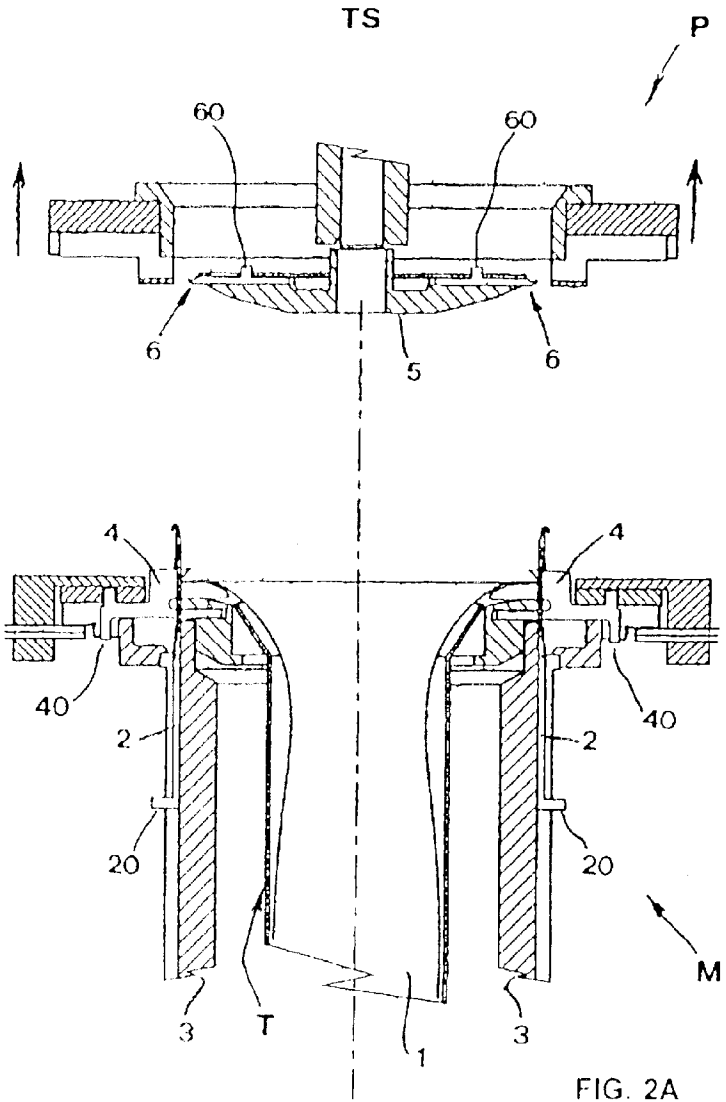
FIG. 2A shows the machine of FIG. 1 with the plate and the knitting needles being lifted, the stitches of the last knitted rank resulting in the so-called "unloaded" position.
Figure 1:
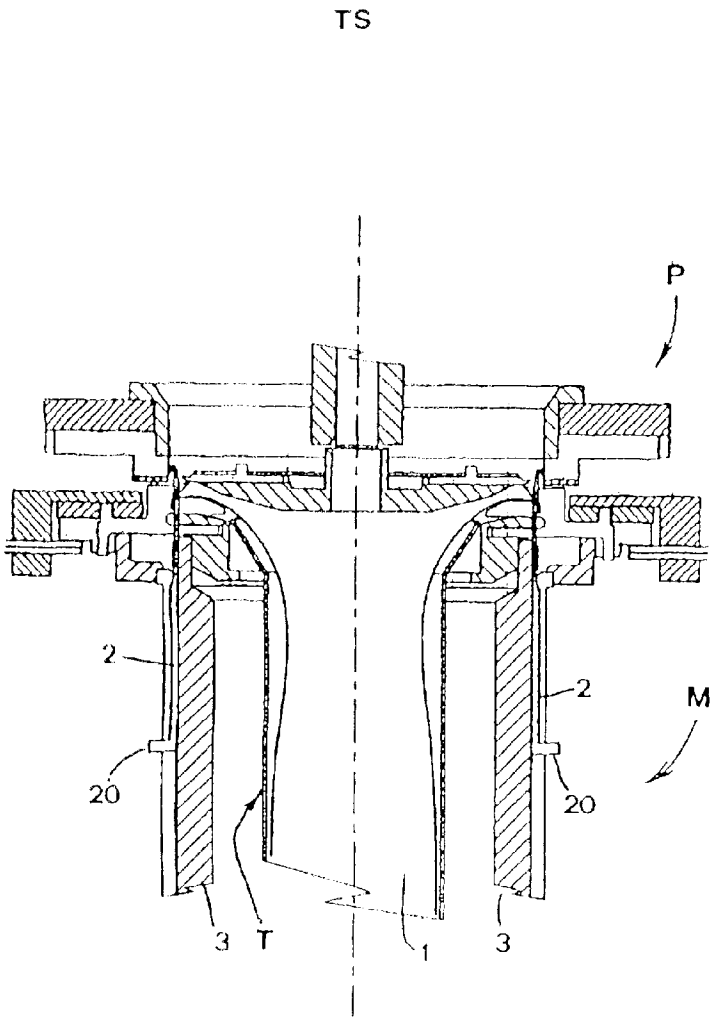
FIG. 1 is a schematic view in diametral section of one-cylinder circular machine in a condition of end-of-knitting of a stocking, with the plate being still down.
Figure 4A:
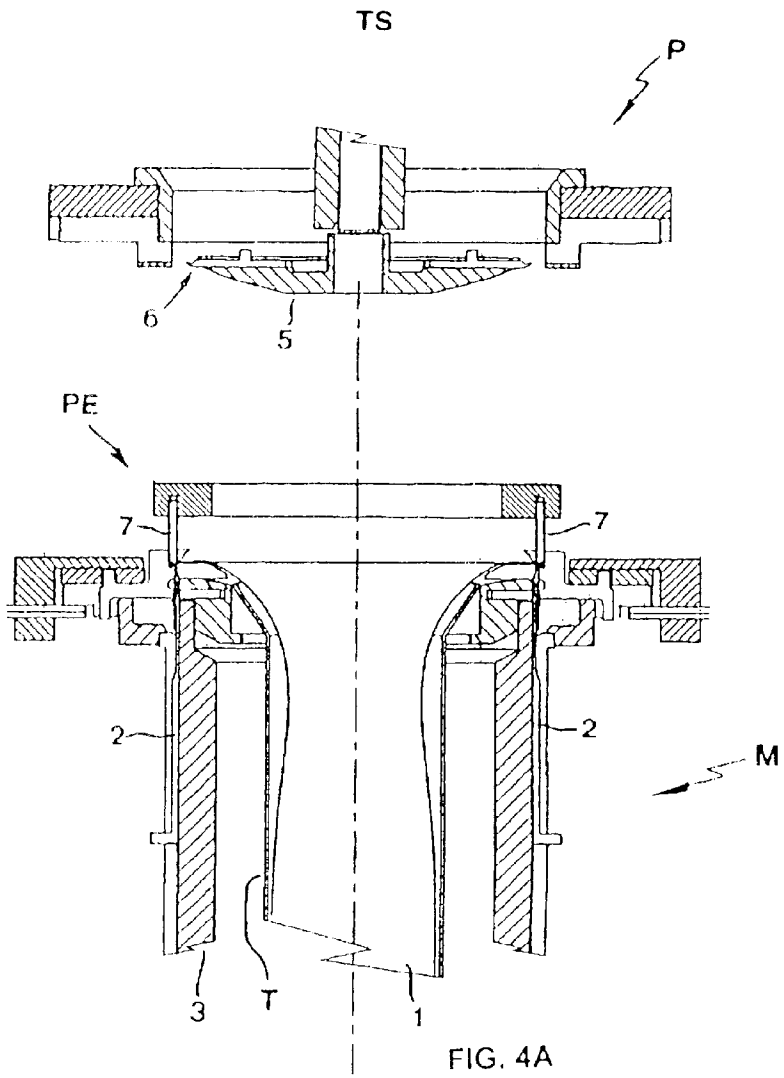
FIG. 4A shows the said first movable carrier as it comes down together with the knitting needles to allow the transfer of the stitches of the last knitted rank from the removal members supported by the movable carrier.
Figure 3A:
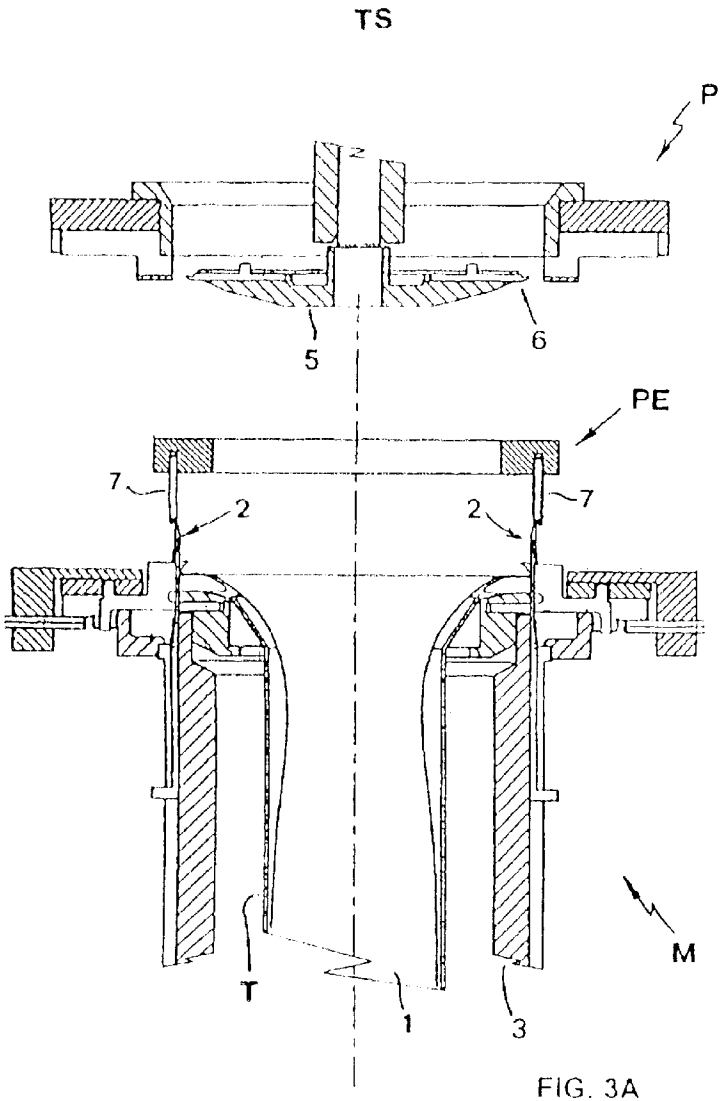
FIG. 3A shows a first movable carrier with the stitch-removing members disposed onto the needles of the machine of FIG. 2.
Figure 3B:
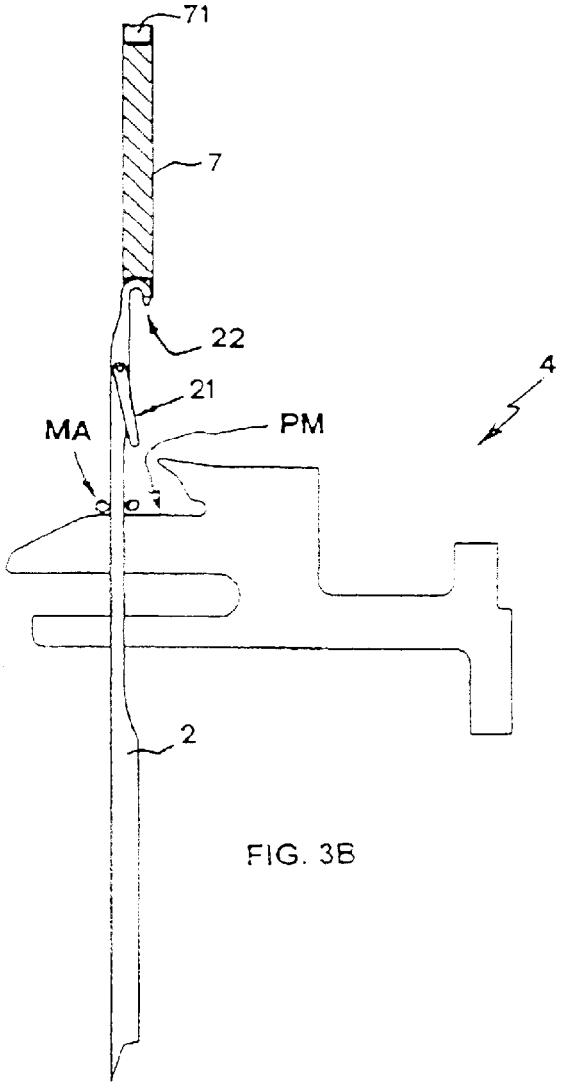
FIGS. 3B and 4B show, respectively, enlarged details of FIGS. 3A and 4A relating to the procedure for closing the latch of one needle where the stitch surface of the sinkers is used as a cast-off plane.
Figure 4B:
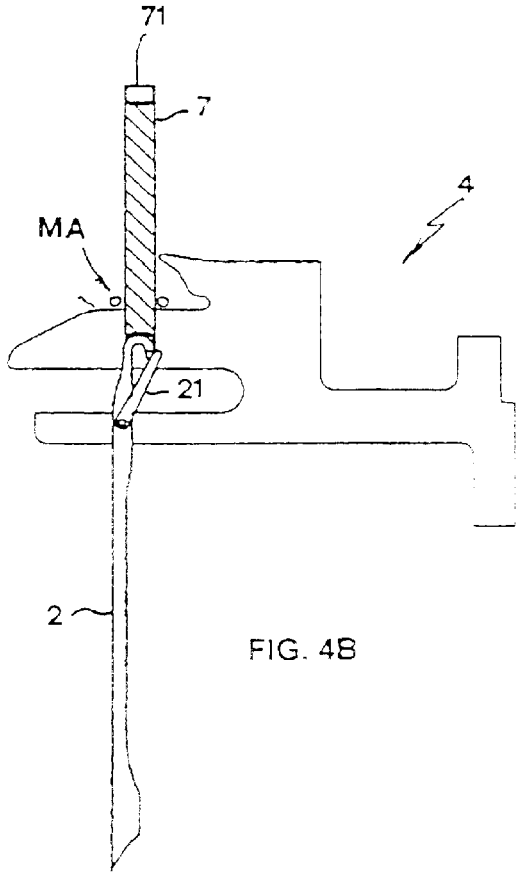
Figure 3C:
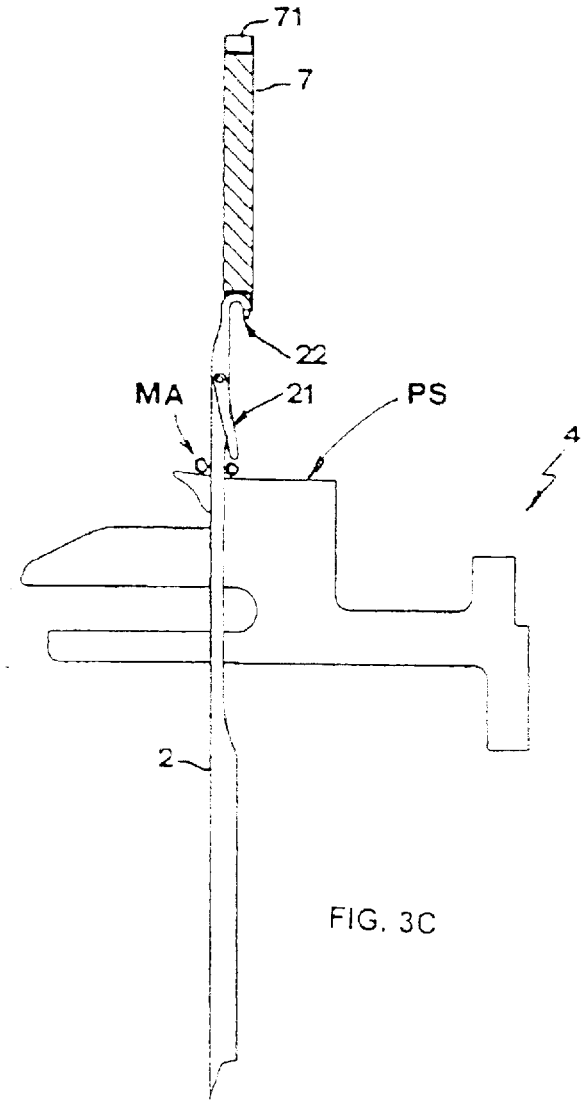
FIGS. 3C and 4C show, respectively, enlarged details of FIGS. 3A and 4A relating to the procedure for closing the latch of one needle where the upper or "beak" surface of the sinkers is used as a cast-off plane.
Figure 4C:
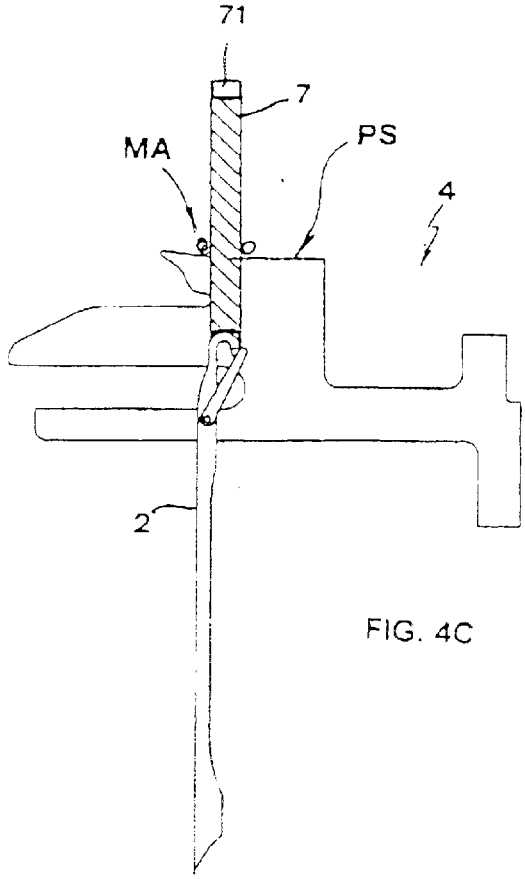
Figure 6:
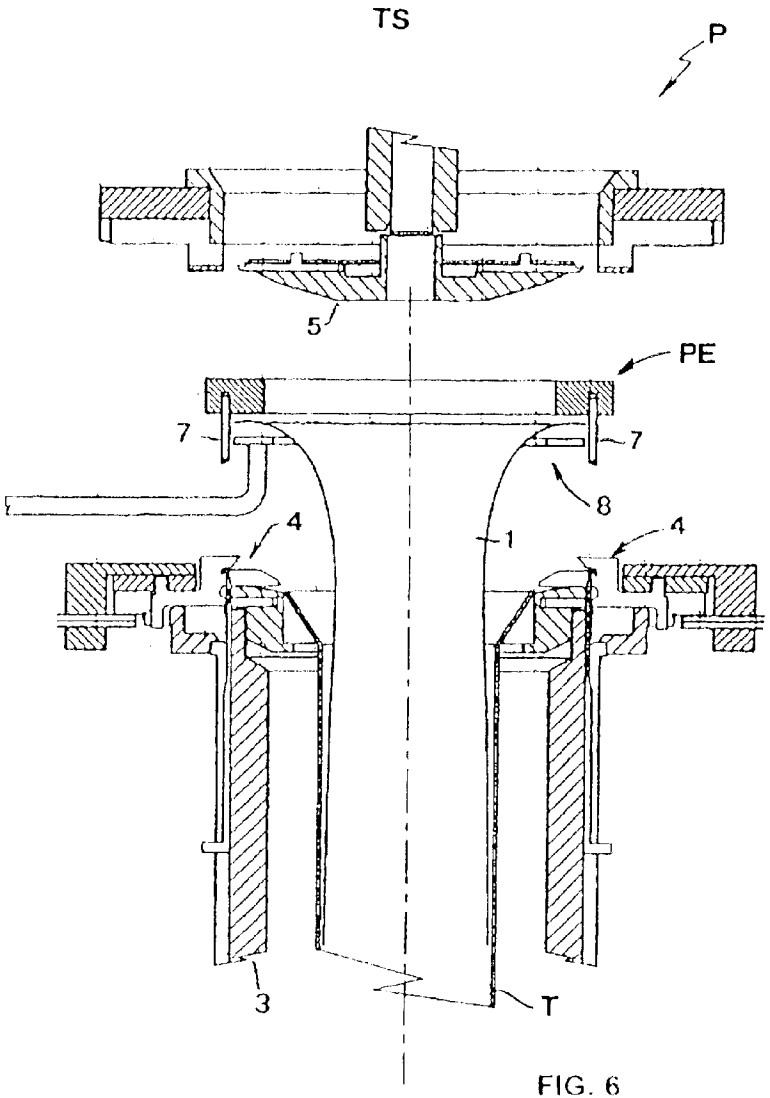
FIG. 6 shows the step of moving a safety device close to the first movable carrier being lifted up.
Figure 5:
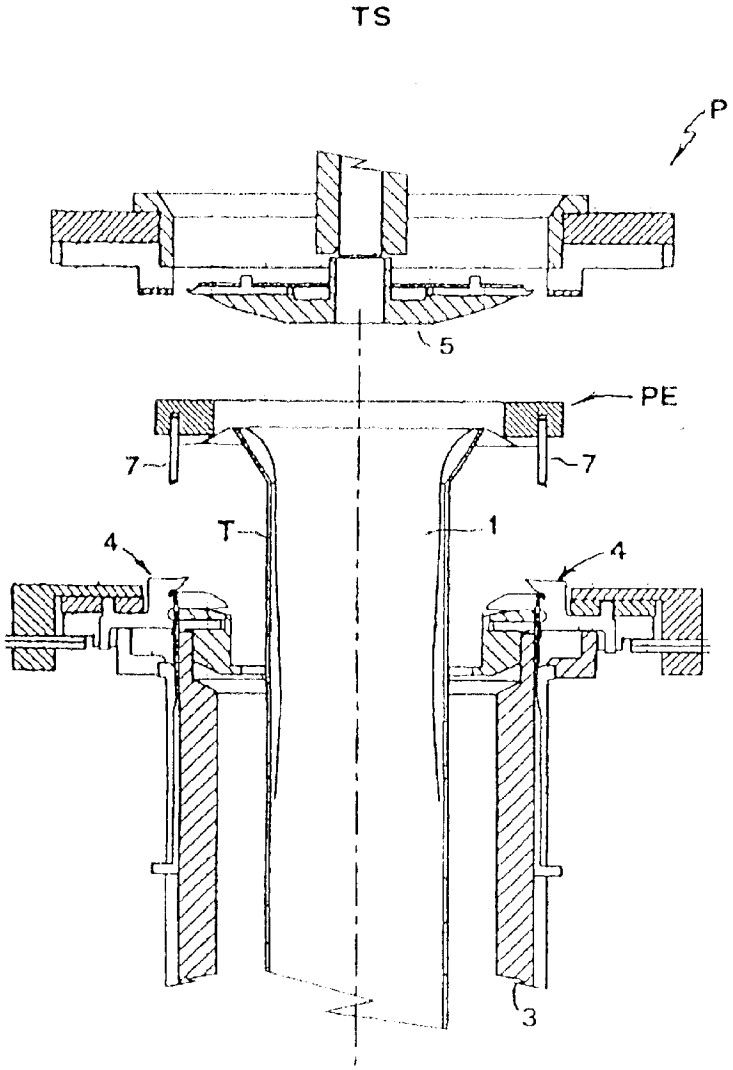
FIG. 5 shows the step of lifting the first movable carrier with the article being disengaged from the knitting needles and engaged with the said removal members.
Figure 8:
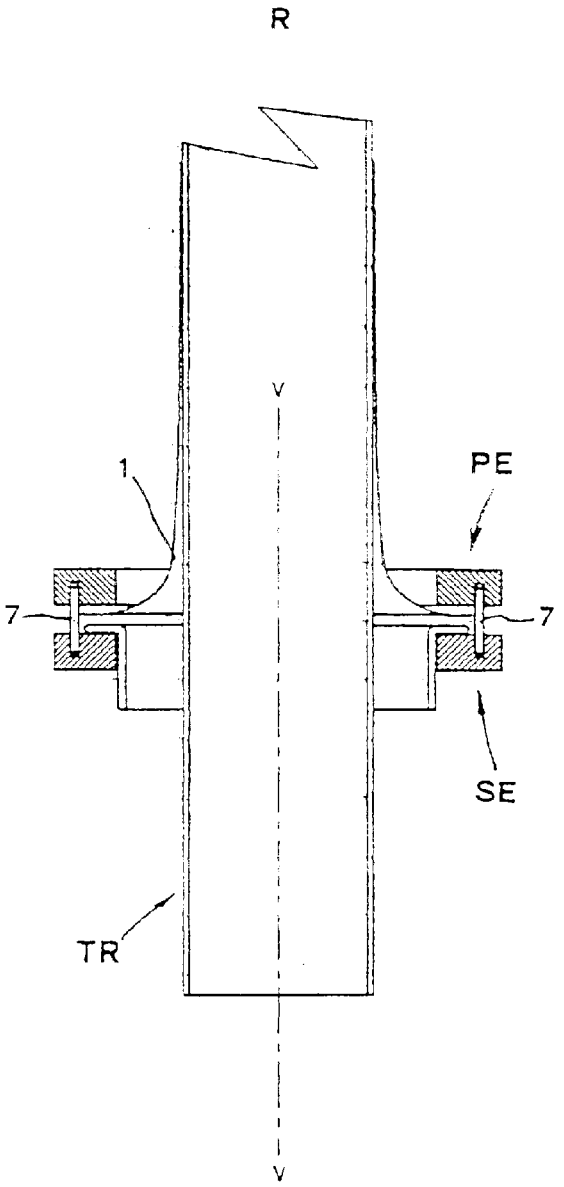
FIG. 8 shows the step of lifting said eversion tube and of moving the two movable carrier close to each other.
Figure 9:
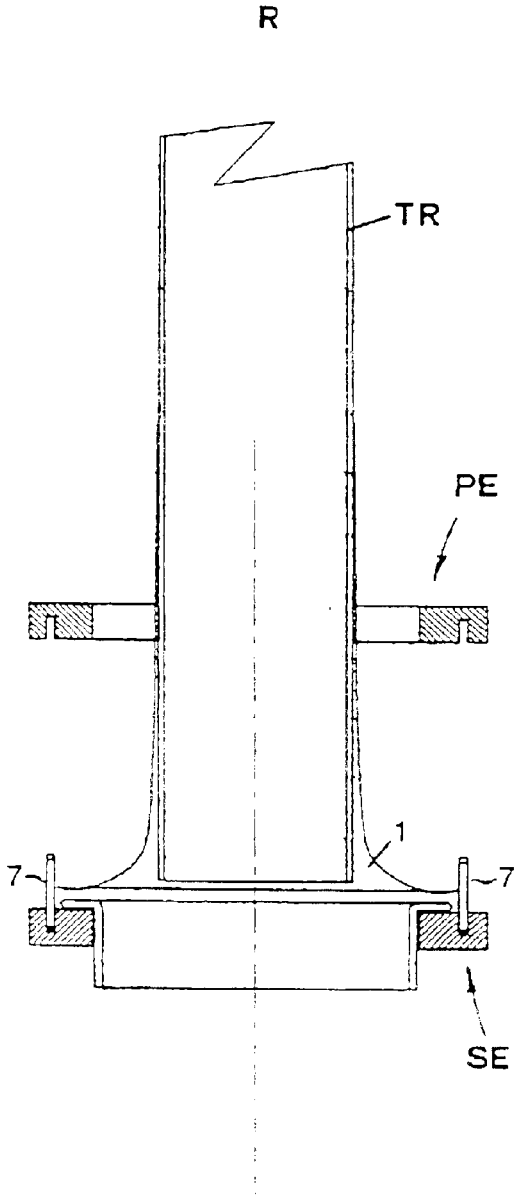
FIG. 9 shows the final step of transferring the stitch-removing members from the first movable carrier to the second one.
Figure 10:
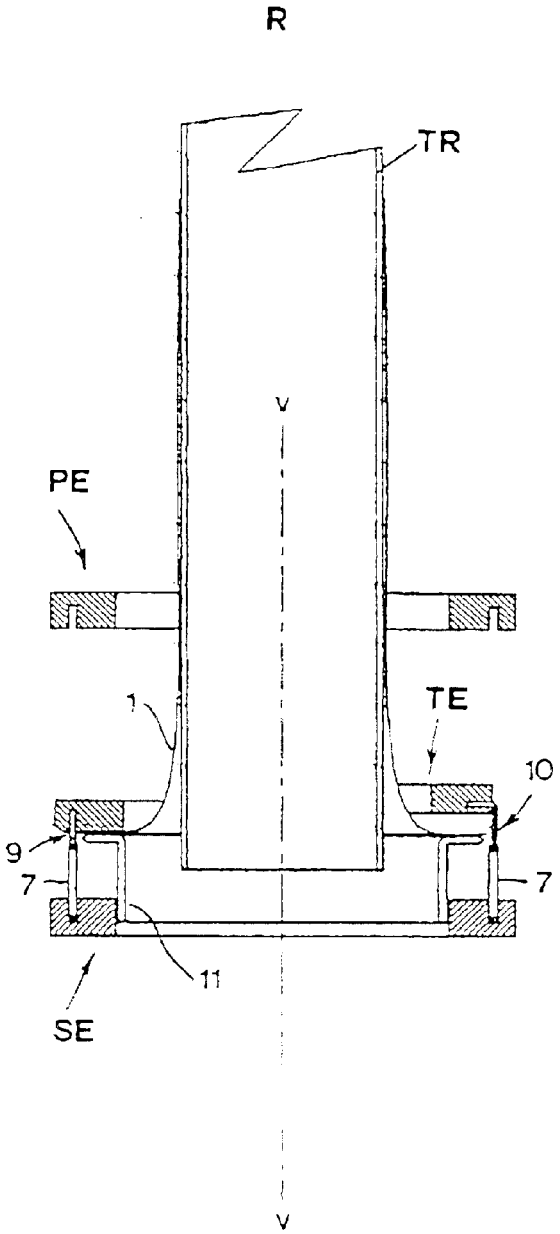
FIG. 10 shows the step of moving a third to the second movable carrier, with the approach of the means supported by the third movable carrier to the stitch-removing members supported by the second movable carrier, and the transfer of stitches from the members of the second carrier to the third one.
Figure 11:
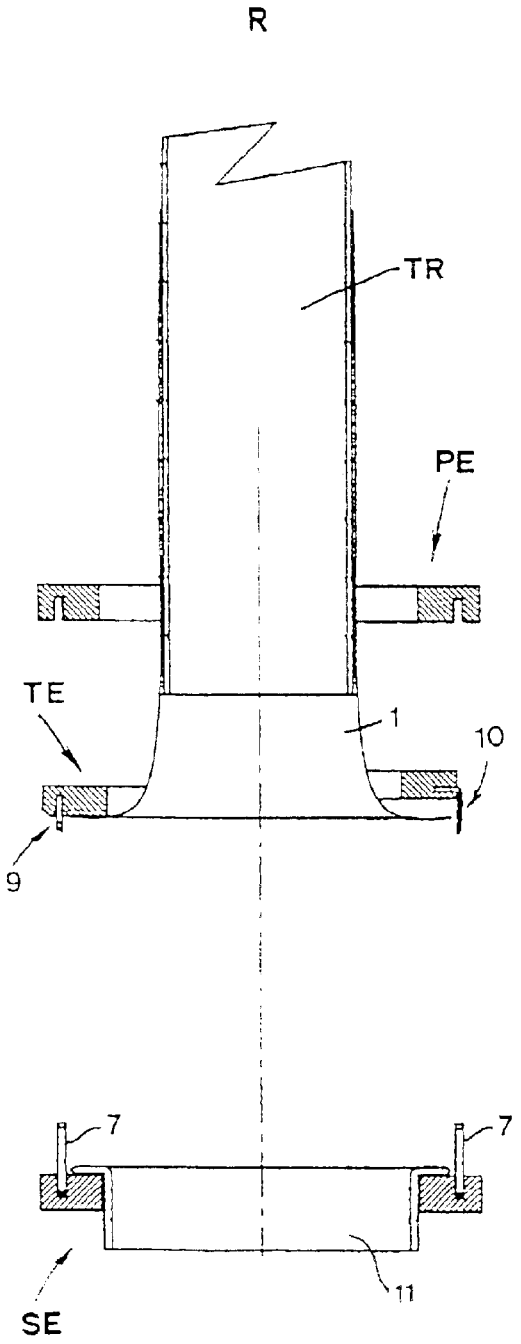
FIG. 11 shows the moving of the second movable carrier away from the third one.
Figure 12:
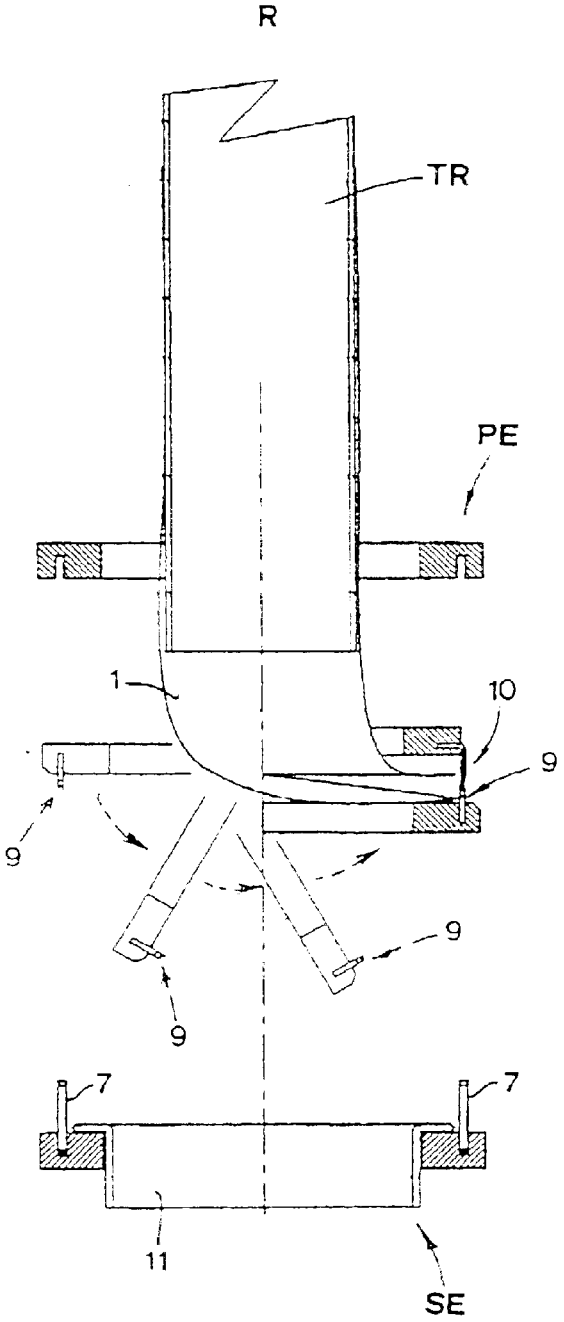
FIG. 12 shows the step of positioning the stitches of a semirank in correspondence of those of the other semirank, the stitches involved in this step being those fitted beforehand onto said removal members.
Figure 14:
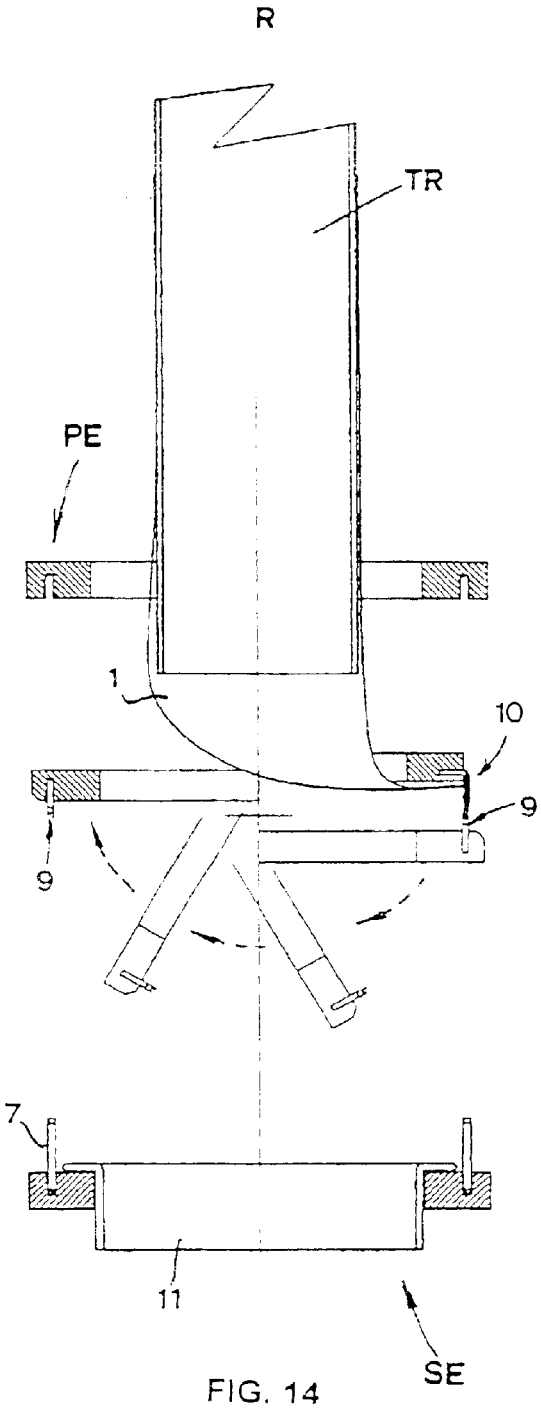
FIG. 14 shows the restoration of the initial configuration of the third movable carrier.
Figure 16:
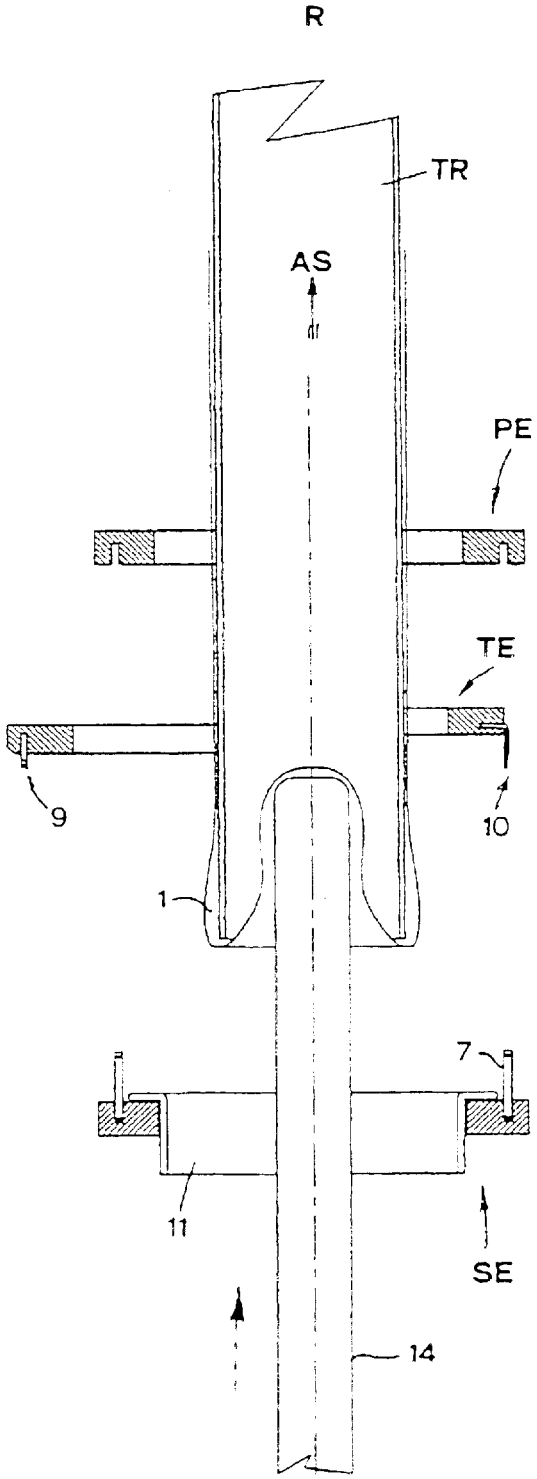
FIG. 16 shows the step of releasing the article after the hooking-up of the edges corresponding to said semiranks.
Figure 17:
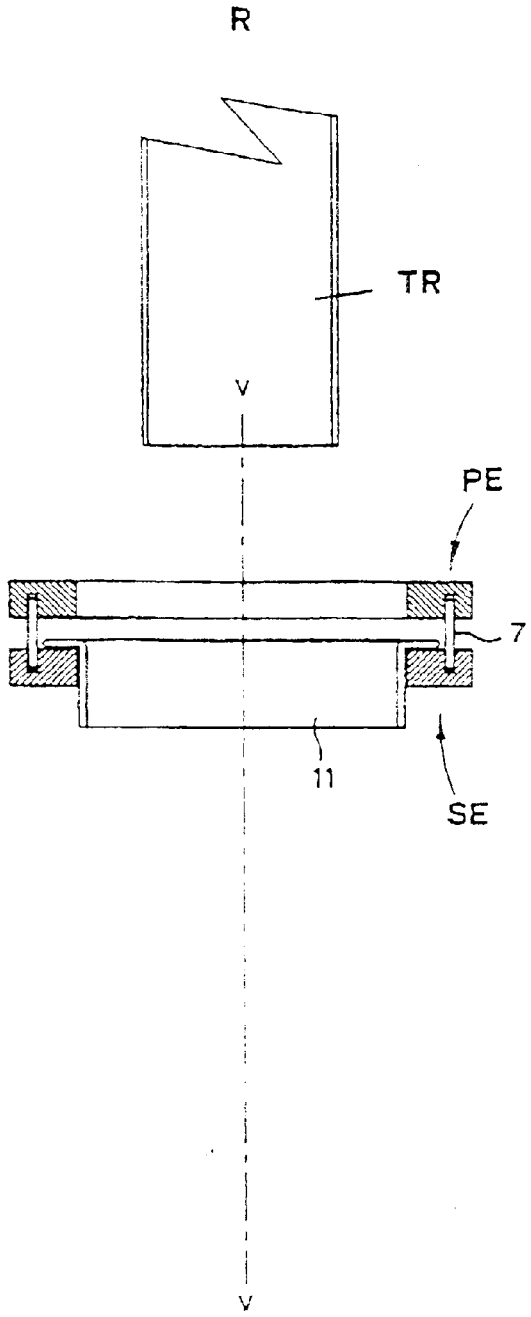
FIG. 17 shows the transfer of said members for the removal of stitches of last-knitted rank from the second to the first movable carrier subsequently to the moving away of third carrier.
Figure 18:
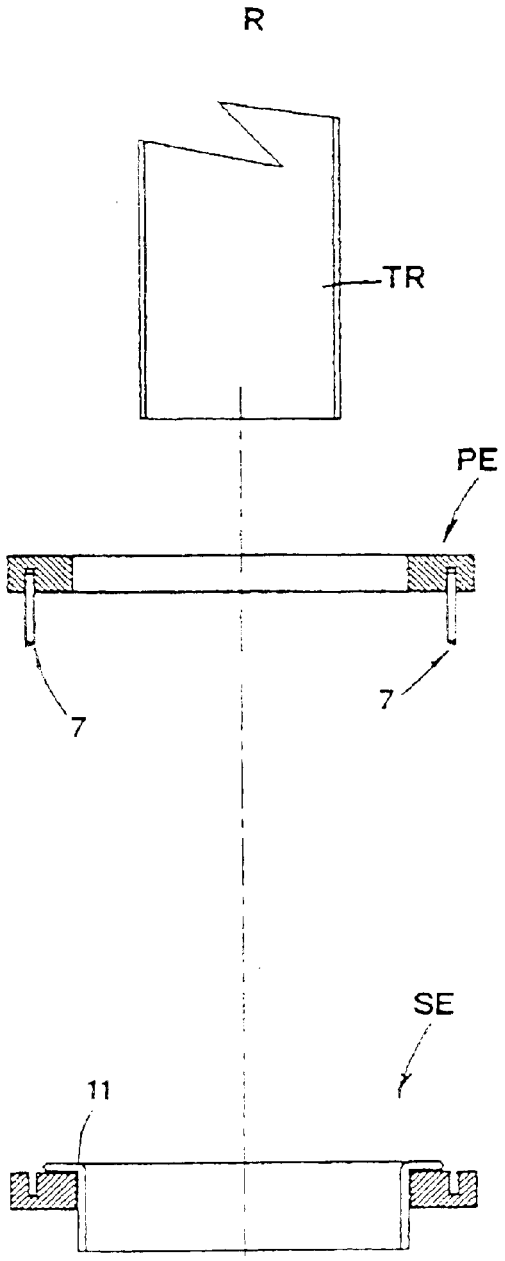
FIG. 18 shows the step of moving the second movable carrier away from the first one, that is, the restoration of the initial conditions.

Reduced to its basic structure and reference being made, in particular, to FIGS. 1-18 of the attached drawings, an operative method according to the invention, related to the manufacturing of a stocking by means of a one-cylinder circular machine (M) provided with plate, includes the following steps:

knitting a stocking (1) starting from the leg portion and ending up with the formation of a rank of terminal stitches corresponding to the stocking's toe portion which results open (FIG. 1), the knitting of the article (1) being carried out in a traditional manner by using a circular machine (M) provided with needles (2) mounted on a vertical support cylinder (3) and movable vertically thereon. The upper part of each of said needles (2) is positioned between two sinkers (4)

oriented radially with respect to the cylinder (3) and which, in the whole, form a circular front in correspondence of the upper base of same cylinder. Provided inside the cylinder (3) is a tube (T) connected to a suction pump within which the article (1) is formed in the course of the knitting. The plate group comprises the very plate (5) of circular configuration, movable from and to the machine (M) and supporting a plurality of radial crooks (6). In the course of the knitting, the plate group (2) is drawn near the machine (M) as illustrated in FIG. 1. Upon completion of the knitting, such group is moved away from the machine (M) as illustrated in FIG. 2A. The very knitting is carried out by forming a tubular assembly of linked loops or stitches by using one or more threads (not shown in the drawing) worked by the needles (2) in cooperation with the sinkers (4). The crooks (6) of the plate (5) can be used to make special parts of the article (1) such as a double edge of the hem. The crooks (6) and the needles (2) are suitable driven in phase between them and with the sinkers (4) by a system of cams acting on corresponding operating heels (20, 40, 60). For the sake of simplicity, FIG. 2A shows only the cams (400) with sinkers (4). A machine of this type is well known and available on the market. For example, use can be made of a machine model "Star" or "4100", or "Fantasia", or also "Tornado", all made in Italy by the company Sangiacomo S.p.A., or of any other equivalent machine;

upon completion of said knitting step, lifting the plate group (P) and the needles (2) of the machine (M) until the respective stitches are unloaded (FIG. 2A); in jargon, it is said that the stitch is in "unloaded position" when it results onto a needle below the relevant latch (219;

transferring the stitches (MA) of the last rank of the article (1) from the needles (2) to a plurality of corresponding removal members (7) disposed on a first movable carrier (PE) so that, upon completion of this step, each stitch (MA) of the last knitted rank will result transferred from the respective needle (2) to a corresponding removal member (7). To carry out this step, the members (7) for removing the stitches from needles (2) may be mounted in a stable but removable manner, as best described later on, onto a first movable carrier (PE). The latter, after lifting the plate (P), is disposed in axial alignment with the needles cylinder, so that the free end of each removal member (7) will result in contact with the crook (22) of a corresponding needle (2), as illustrated in FIGS. 3A and 3B, thereby determining a so-called "covering" condition allowing each stitch to be transferred from the respective needle (2) to the respective removal member (7) with no obstacle, that is, without being intercepted by the needle's crook. Under this condition, the crook is actually overlapped by the free end of member (7) which forms a cap onto the crook. Thereafter, the said carrier (PE) is lowered, as shown in FIGS. 4A and 4B along with the needles (2) by placing the latter below the "cast-off plane" so that, at the end of this last step, each stitch will result fitted onto a corresponding removal member (7) also because of the automatic closing of latches (21) which result positioned as shown in FIG. 4B. In practice, by the lowering of carrier (PE) and needles (2), the members (7) take up the place of the latter by enetering the stitches of the last rank. According to the example of FIGS. 3B and 4B, the plane used as a cast-off surface is the one in which the stitches are formed, that is, the so-called stitch plane (PM) of the sinkers. In the example illustrated in FIGS. 3C and 4C, the cast-off plane used is the upper surface (PS) of the sinkers (also called beak). In practice, as meant in the present description, the "cast-off plane" is a surface for temporarily supporting or retaining the stitches (MA), and beyond which the stitches (MA) cannot be pushed. Accordingly, when the stitches (MA) lie in such a plane, the lowering of the needles (2) and the concurrent lowering of members (7) cause the passage or transfer of the stitches (MA) from the needles (2) to the members (7);

lifting said removal members (7) together with the article (1), the latter being engaged with removal members (7) via the stitches (MA) of the last rank. This step can be carried out by lifting the movable carrier (PE) and tube (T) at the same time, so that the mouth of the latter will result at a height greater than that of the free ends of the removal members (7), as illustrated in FIG. 5. The lifting of tube (T) is not strictly necessary to carry out this step but it may serve to assist the lifting of article (1) simultaneously to the carrier (PE), and to prevent the disengagement of one or more stitches from the respective removal members (7). In addition, to allow the subsequent step of moving the article (1) away from station (TS) in which the machine (M) works, and thus allowing the re-lowering of the tube (T) without this endangering the association of the stitches with the respective removal members (7), use can be made of a safety device (8) made up, for example, of a portion of a circular crown borne at the end of a support arm (800) being movable from and to the carrier (PE) to accompany the article to the subsequent station (where it will be then moved away therefrom to allow the insertion of a second movable carrier (SE) (FIG. 6);

disposing the article (1) in a station (R) other than that for knitting (TS) and inserting an everter tube (TR) thereinto; this step being possibly performed by taking the carrier (PE) to said station (R), together with device (8) if any. The eversion tube (TR) may be a tube with vertical axis (v-v) connected to a suction pump of a type commonly used in hosiery machines;

turning the article (1) inside out, this step can be performed by lifting the tube (TR), as illustrated in FIG. 8, after having moved away the device (8) if used. In this way, the article will result oriented in a manner opposite to the initial one, that is, with the part comprising the last rank of stitches turned upwards, so that the stitches of the latter rank will result below all the other stitches of the article;

transferring the said removal members (7) from said movable carrier (PE) to a second movable carrier (SE); this step can be carried out by moving the second movable carrier (SE) close to the first (PE), as illustrated in FIG. 8 and, upon completion of transfer, by moving the first movable carrier (PE) away from the second (SE), as illustrated in FIG. 9. At the end of this step, the free ends of the members (7) will result those previously engaged with the first carrier (PE) and, vice versa, those previously free will result engaged with the second movable carrier (SE). Described later on are possible ways of making the carriers (PE) and (SE). The fact of transferring the members (7) from the first to the second carrier, along with the stitches engaged therewith, causes the transfer of the article (1) to the second carrier without subjecting the stitches to any corresponding stress. In other words, in this step, the transfer of stitches (MA) of article (1) from the first to the second support carrier is made by involving only the members (7) and not directly the stitches engaged therewith, so that said stitches are not subjected to any stress related to said transfer;

transferring the stitches of the last rank of said removal members (7) to a corresponding plurality of retention members (9, 10), the latter having the function of blocking the said stitches for a subsequent hook-up step and being disposed onto a third movable carrier (TE); the said stitch-retaining members for the hook-up (9, 10) may consist, as best described later on, of a plurality of rods (9) of a shape similar to that of members (7), and of a plurality of hook-up spines as well mounted on two relevant supporting semicrowns. The transfer of the stitches from the members (7) to the rods (9) and to the spines (10) may be made by using a collar flange (11) coaxial to the second carrier (SE) and movable vertically from and to the third carrier (TE). When the flange (11) is lifted, that is, moved towards the third movable carrier (TE), its upper part comes in contact with the stitches fitted onto the members (7) of the second carrier (SE) by pushing them upwards until they fit on the rods (9) and spines (10), these being coaxial with the removal members (7) as illustrated in FIG. 10. Upon completion of this step, the article will no longer be engaged with the members (7) transferred onto the second carrier (SE), but will result engaged wiht the members (9, 10) of the third movable carrier (TE), with the stitches of a semirank fitted on the rods (9) and with the stitches of the other semirank fitted on the spines (10);

disposing the stitches of a semirank coaxial and juxtaposed to the stitches of the other semirank, that is, in a preset hook-up configuration; this step can be carried out by moving the second movable carrier (SE) away from the third (FIG. 11), by rotating the semicrown of the rods (9) through 180° (for example downwards, as illustrated in FIG. 12), then by transferring onto the spines (10) the stitched fitted on rods (9) and finally by bringing the semicrown of rods (9) back to its starting position (FIG. 14). The transfer of the stitches from the rods (9) to the spines (10) can be performed by using a semicrown-shaped push rod (12) acting on the stitches present on the rods (9) in the same way as the collar flange (11) comes to act on the stitches fitted on the members (7) previously mentioned. Upon completion of this step, the stitches of the two semiranks, into which the last rank (MA) of stitches of article (1) may be considered virtually divided, result fitted in pairs, coaxial and juxtaposed, onto the spines (10) ready for hooking-up; each of said pairs being formed by a preset stitch of a semirank and a preset stitch of the other semirank;

performing the hook-up of the stitches so disposed ending the hook-up with the formation of one or more closing knots (FIG. 15); this step can be carried out by using a hook-up needle (13) being constructed, fed and driven by a normal hook-up device (RI) in a conventional manner. At the end of this step, the article (1) which initially had both ends opened, results with the tip end closed by the hook-up operated on the inner or inside-out part;

releasing the stitches thus linked (FIG. 16). This step can be performed by lowering the eversion tube (TR) and using a rod (14) introduced into the same tube (TR) over such a length as to determine the turning right-side out of the article (1) which, in this way, is introduced into the tube (TR) and finally aspirated to be ejected in right-side out condition (in FIG. 16, AS indicates the suction direction);

transferring the said stitch-removing members (7) from the second (SE) to the first movable carrier (PE) (FIGS. 17 and 18). This step can be carried out with procedures corresponding to those for the transfer of members (7) from the first (PE) to the second movable carrier (SE) but in reverse order.

Described herebelow with reference to the examples of FIGS. 37-63 is an apparatus to be used for implementing the operating method.

As previously mentioned, the machine (M) and the plate group (P) with respective drive members, may be of a type already available on the market and, accordingly, it will not be described in further detail. The same applies to the hook-up device (RI).

Figure 38:
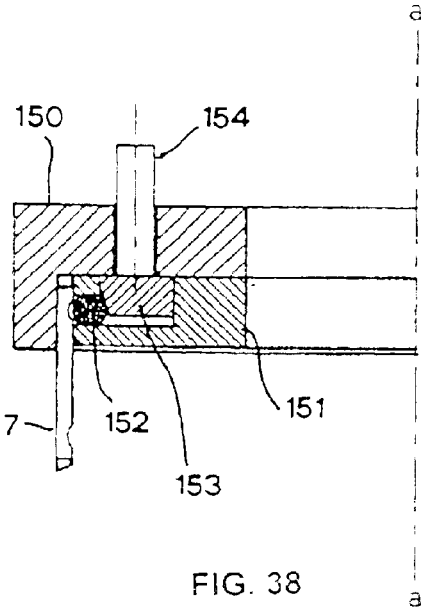
FIG. 38 shows an enlarged detail in longitudinal section of the carrier of FIG. 37 in a condition of non retention of the stitch-removing members.
Figure 39:
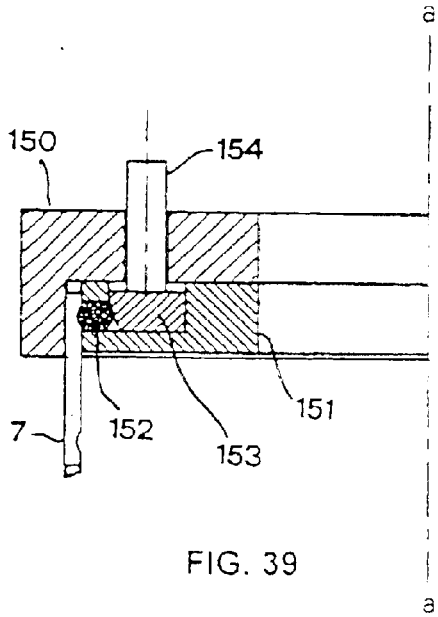
FIG. 39 shows the detail of FIG. 38 in a condition of retention of the stitch-removing members.
Figure 40:
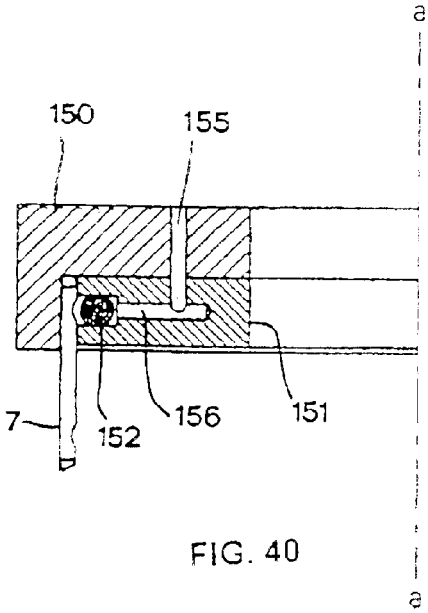
FIGS. 40 and 41 show an enlarged detail in longitudinal section of the carrier of FIG. 37, according to a further embodiment, in a condition of non-retention (FIG. 41) of the stitch-removing members.
Figure 41:
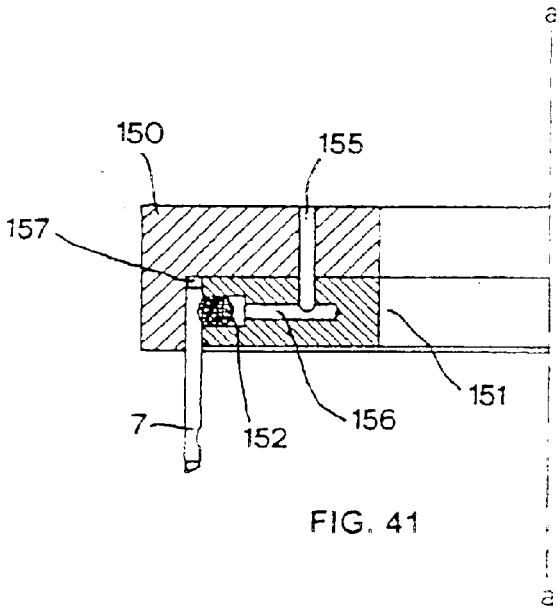

The said first carrier (PE) may consist, for example, of a circular crown structure with two circular concentric elements (150, 151) which, in cooperation with each other, delimit a plurality of seats (157) to receive therein in a stable by removable way, the said removal members (7). These are angularly spaced apart like the needles (2) of the machine (M) and result oriented parallel to the longitudinal axis (a-a) of said circular concentric elements (150, 151). With reference to FIGS. 38-41, between said elements (150, 151) and, more specifically, between the seats for members (7) and the inner wall of the outermost element (150) of pair (150, 151), a annular gasket (152) is positioned, such as of rubber or other elastically deformable material. The gasket is pushed radially outwardly from the inside, by increasing its diameter when it is desired to lock the members (7) in the respective seats. Vice versa, when the members (7) are to be released to allow the transfer of them onto the second movable carrier (SE), the diameter of the same gasket (152) is reduced. To this end, reference being made to FIGS. 38 and 39 of the attached drawings, an annular wedge (153) may be interposed between the gasket (152) and the innermost element (151) of crown (150, 151), the said wedge (153) being associated with a straight actuator (154), for example of electromagnetic or equivalent type, to allow the wedge to be moved vertically between a lifted position in which it does not interfere with the gasket (152), as illustrated in FIG. 38, and a lowered position (FIG. 39) in which it does interfere with the gasket (152) by pushing it radially inwardly. In the configuration of FIG. 38, the members (7) are free, whereas in the configuration of FIG. 39, the members (7) are blocked to the crown (150, 151) because they are compressed between the enlarged gasket (152) and the inner wall of element (150). In place of the said wedge, compressed air may be used to enlarge the gasket (152). More particularly, with reference to FIGS. 40 and 41 of the attached drawings, the said elements (150, 151) of crown (15) may exhibit two ports (155, 156) in communication with each other and with a source of compressed air via a solenoid valve (not shown), the port (156) of innermost element (151) being in communication with the seat of gasket (152). In order to block the members (7) to the crown (150, 151) as shown in FIG. 41, compressed air (or other suitable fluid) is introduced within the seat of gasket (152) through the said ports (155, 156). To release the members (7), as shown in FIG. 40, the compressed air is discharged through the same ports.

Figure 56:
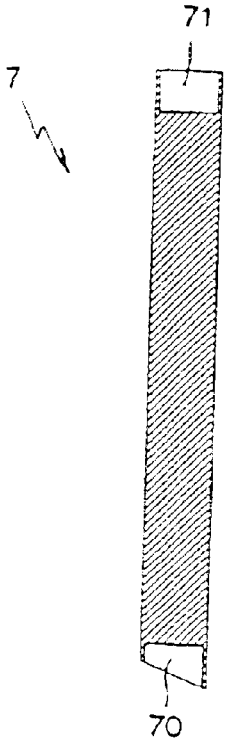
FIG. 56 is a view in longitudinal section of the member of FIG. 55.
Figure 55:
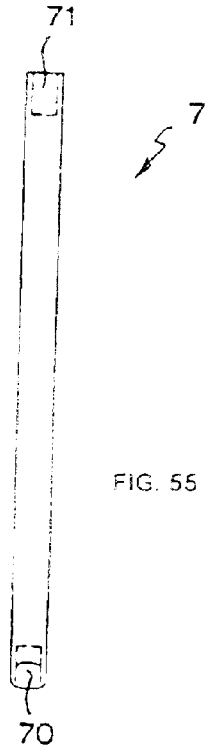
FIG. 55 is a side view of a stitch-removing member.
Figure 59:
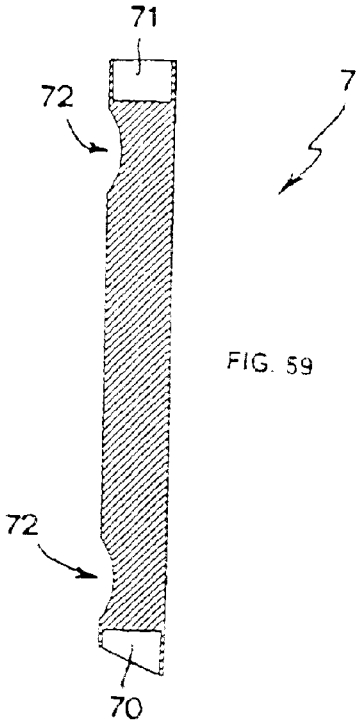
FIG. 59 is a view in longitudinal section of the member of FIG. 58.
Figure 58:
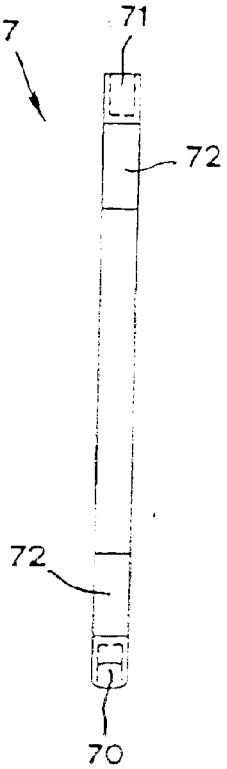
FIG. 58 is a side view of a stitch-removing member according to a further embodiment.
Figure 60:
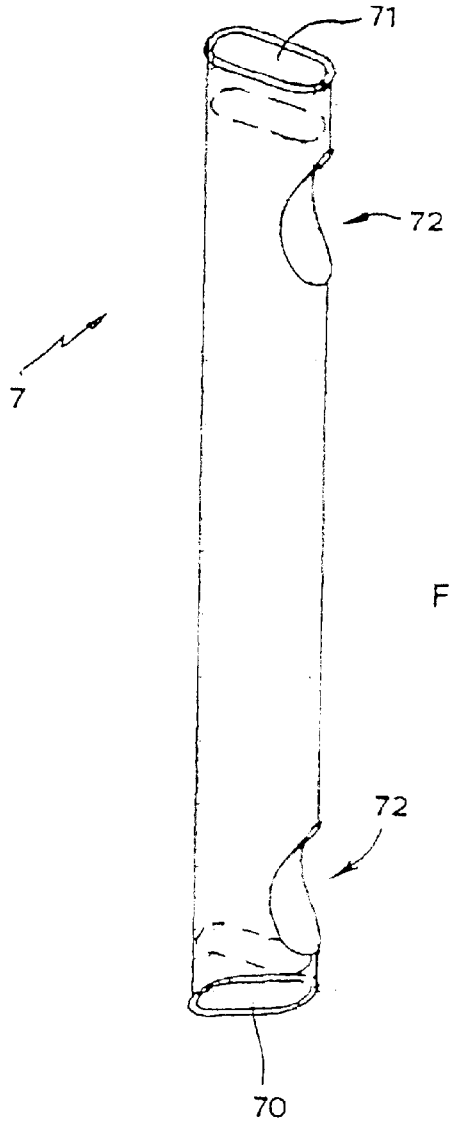
FIG. 60 is an axonometric view of the member shown in FIG. 58.
Figure 57:
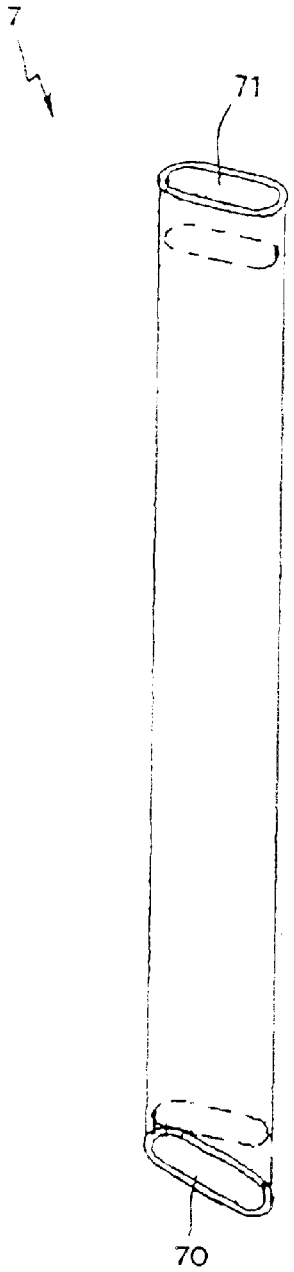
FIG. 57 is an axonometric view of the member shown in FIG. 55.
Figure 62:
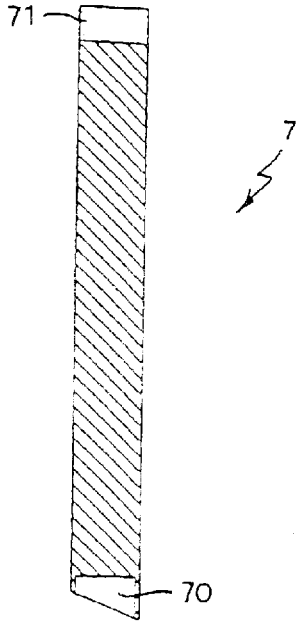
FIG. 62 is a view in longitudinal section of the member of FIG. 61.
Figure 61:
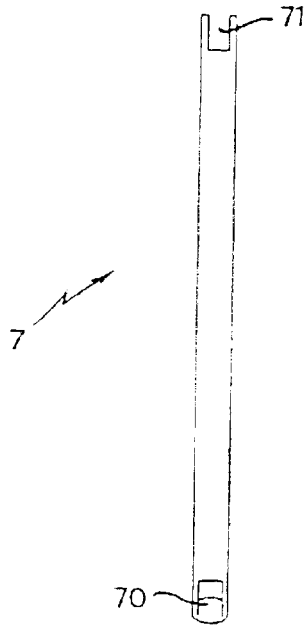
FIG. 61 is a side view of a stitch-removing member according to a further embodiment.
Figure 63:
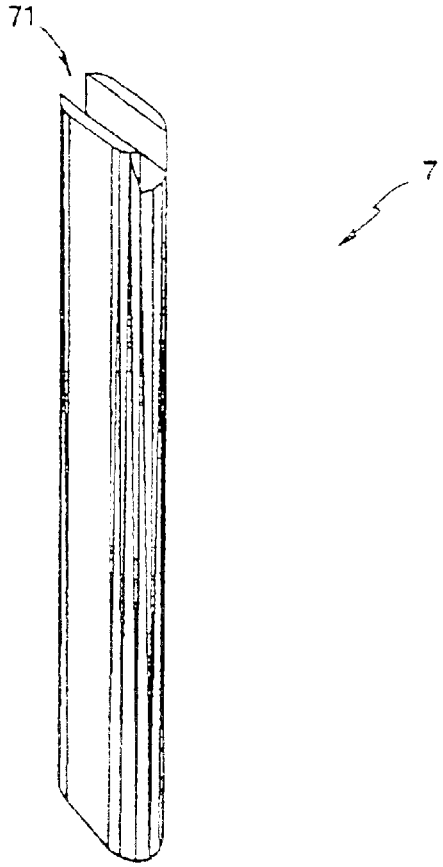
FIG. 63 is an axonometric view of the member shown in FIG. 61.

As far as the said members (7) are concerned, these may be made up, with reference to the examples of FIGS. 55-57, of metal rods with ends (70, 71) suitably shaped to be able to fit with the needles (2) of machine (M) and with spines (10) and rods (9) of the third movable carrier (TE) thereby determining in both case the "covering" condition previously defined. In addition, and advantageously as illustrated in the exemplary drawings of FIGS. 58-60, the said members (7) may exhibit lateral recesses (72) to further assist the locking by the gasket (152) which, once enlarged, is able to fit within the same recesses. By referring now to FIGS. 61-63, the end (71) of rods (7) instead of being shaped like a cap, it may be so shaped as to present a notch.

With reference to the example illustrated in FIGS. 112-115, the members (7) can be made of a metal sheet bent over to present a U-shaped cross-section and thus to delimit a longitudinal inner channel, with a possible necking of section (700) (as illustrated in FIG. 115) to prevent the transit of needles beyond the narrowed section.

Figure 47:
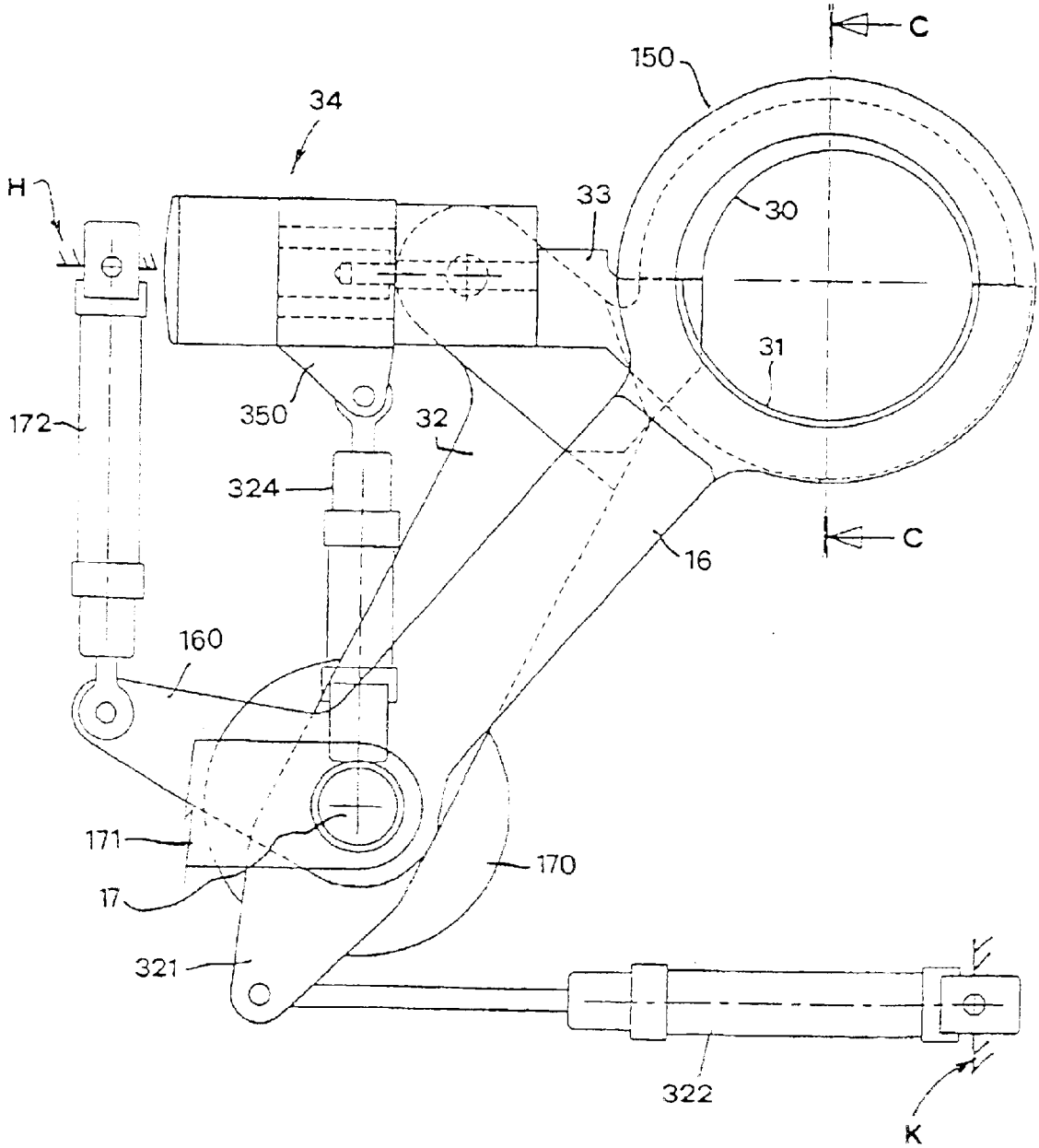
FIG. 47 is a plan view of said three movable carriers in coaxial condition at the hook-up station.
Figure 48:
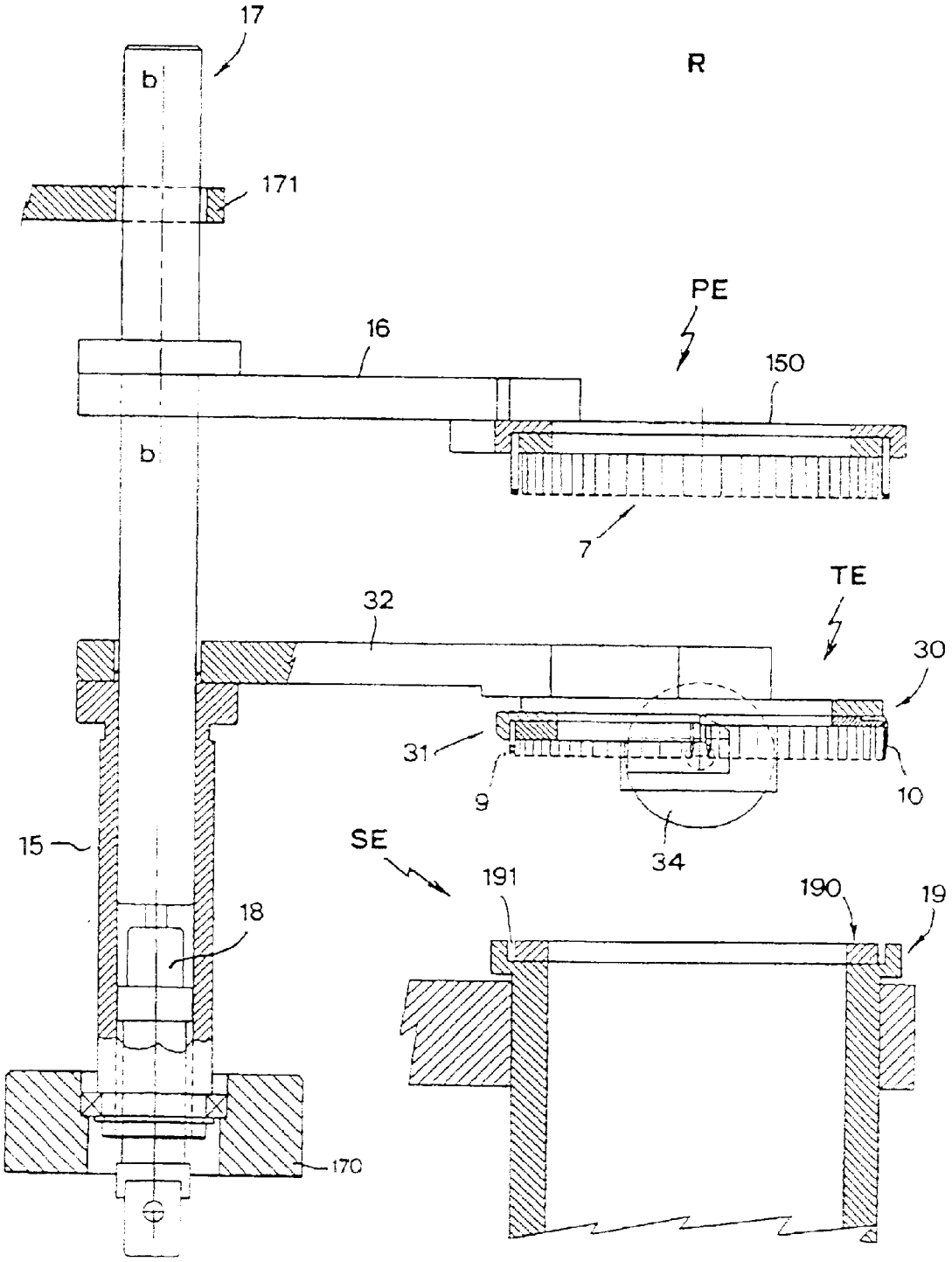
FIG. 48 is a section view taken on line C—C in FIG. 47 showing also the second movable carrier and other parts in section other than those taken on line C—C.
Figure 49:
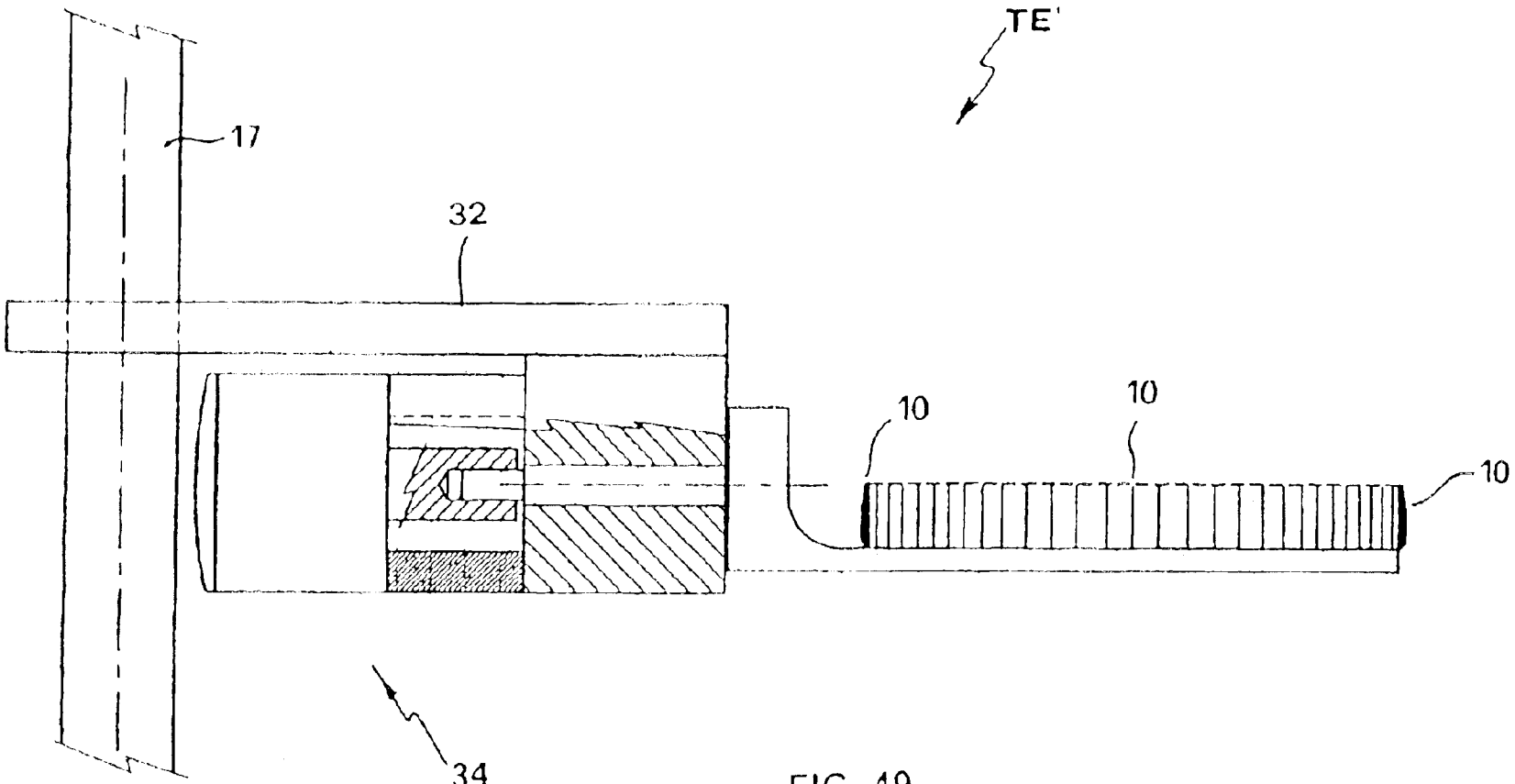
FIG. 49 is a side view partially in section of the third movable carrier shown in FIGS. 26-34.
Figure 51:
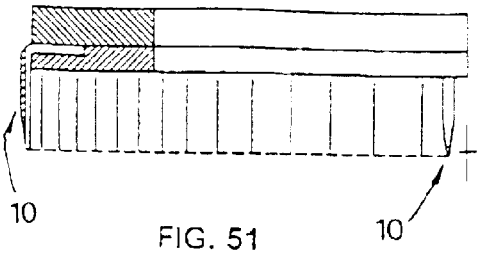
FIG. 51 is a section view taken on line D—D in FIG. 50.
Figure 53:
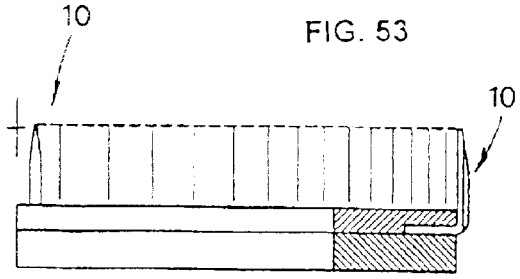
FIG. 53 is a section view taken on line E—E in FIG. 52.
Figure 50:
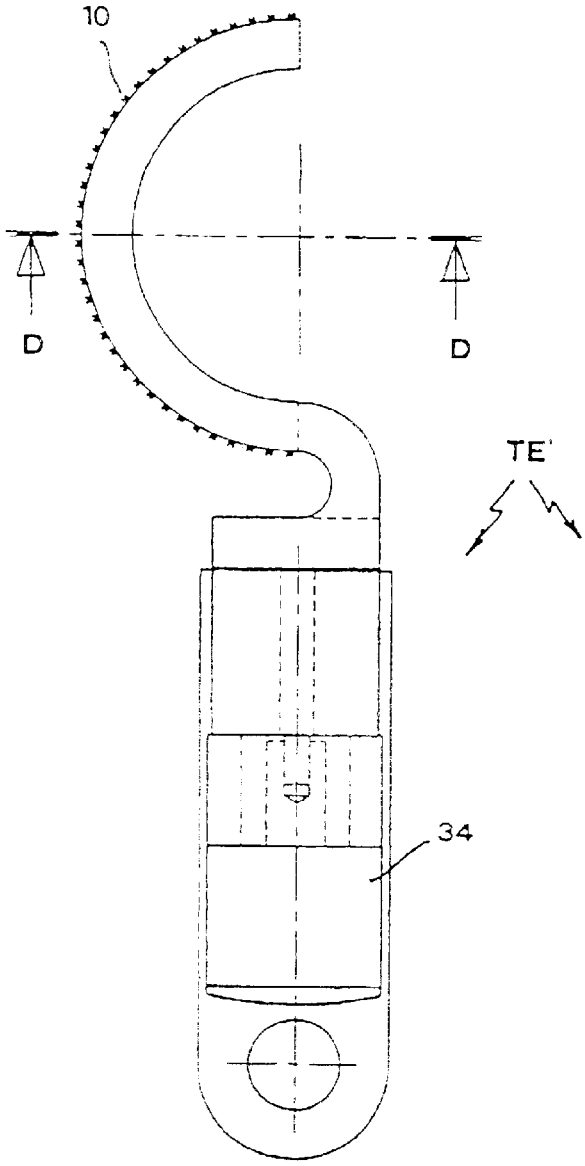
FIG. 50 is a plan view of the carrier of FIG. 49.
Figure 52:
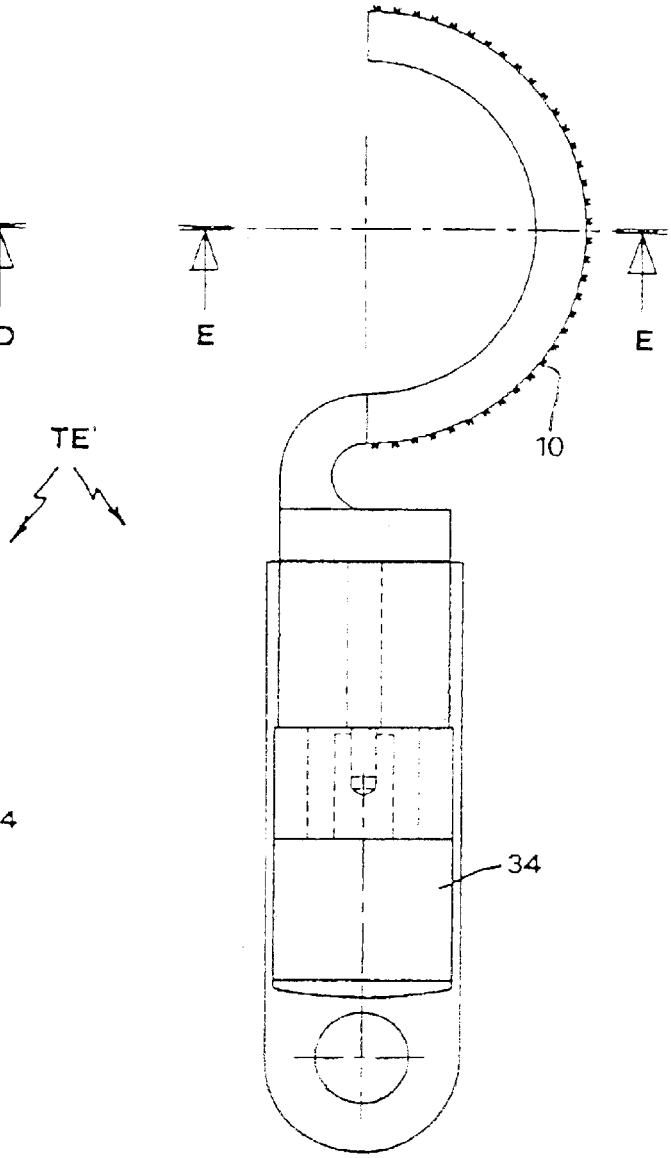
FIG. 52 is a plan view of the carrier of FIG. 49 after a rotation through 180°.

The said crown (150, 151) is attached to a horizontal arm (16) which, on the opposite side, is cantilever fixed on a shaft (17) with vertical axis (b-b) and extends beyond the same shaft by a portion (160) so as to define a kind of lever having its fulcrum in correspondence of shaft (16). The latter, as viewed also in FIGS. 47 and 48, is supported by a base (170) and engaged on top with a stationary bracket (171). The said arm (16) can be rotated about the shaft (17) so as to move and dispose the said first movable carrier (PE), with crown (150, 151) and stitch-removing members (7), into station (TS) for the knitting of article (1) and respectively into the hooking-up station (R).

The rotation of arm (16) may be obtained, for example, by means of an actuator (172) whose stem is fixed to the portion (160) of the arm (16) resulting on the side opposite to the one which carries the crown (150, 151), the skirt of the actuator (172) being solid to a stationary structure (H).

In this embodiment, the said shaft (17) is mounted for sliding vertically with respect to supports (170, 171) under control of an actuator (18) allowing the corresponding lifting and lowering of the arm (16) with carrier (PE) as required. As illustrated in FIG. 48, the said actuator (18) may be disposed below the shaft (17), inside a sleeve (15) acting also as a vertical guide for the same shaft (17).

The arm (800) supporting the safety crown (8) may be mounted for rotation around said shaft (17) under control of a corresponding actuator (810) whose skirt is engaged with the arm (16) of the first carrier (PE) and whose stem acts upon a rear appendix of the arm (800).

Figure 54:
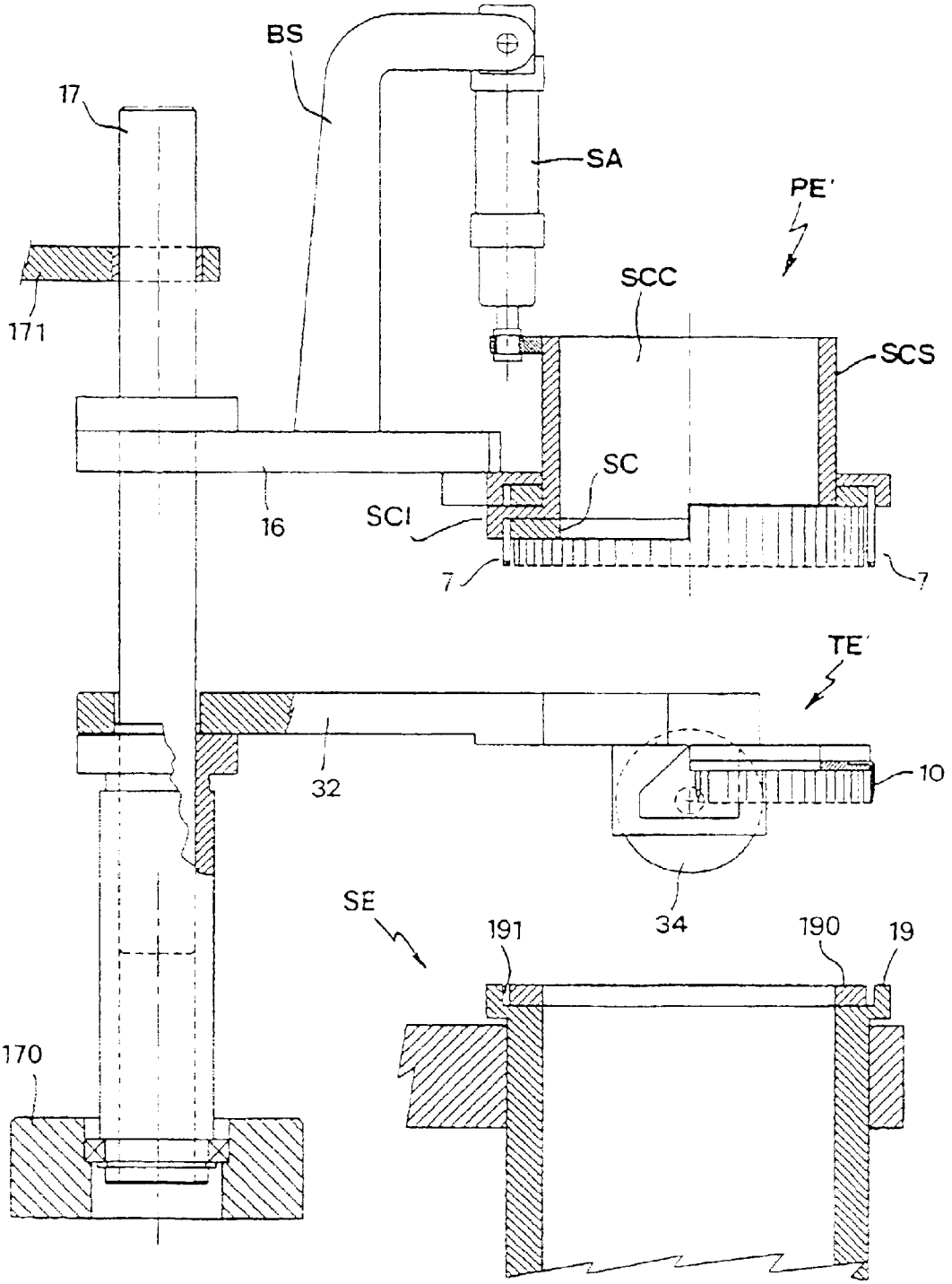
FIG. 54 is a diametral section view of the apparatus with the three movable carriers shown in FIGS. 19-36 in coaxial condition.

The said second movable carrier (SE) is located, according to the example of FIGS. 48 and 54, at the hook-up station (R), associated with an actuator (not shown) which causes it to be lifted and lowered, that is, moved from and to the first and third movable carriers (PE, TE) in the same station (R). More specifically, the second movable carrier (SE) is constructed like the first (PE), as it comprises two concentric crowns (19, 190) able to define a plurality of seats (191) for the stitch-removing members (7) and between which an annular gasket (152) is located for locking and respectively releasing the members (7) likewise it is provided for the first movable carrier (PE) and as illustrated in FIGS. 83-86.

Figure 42:
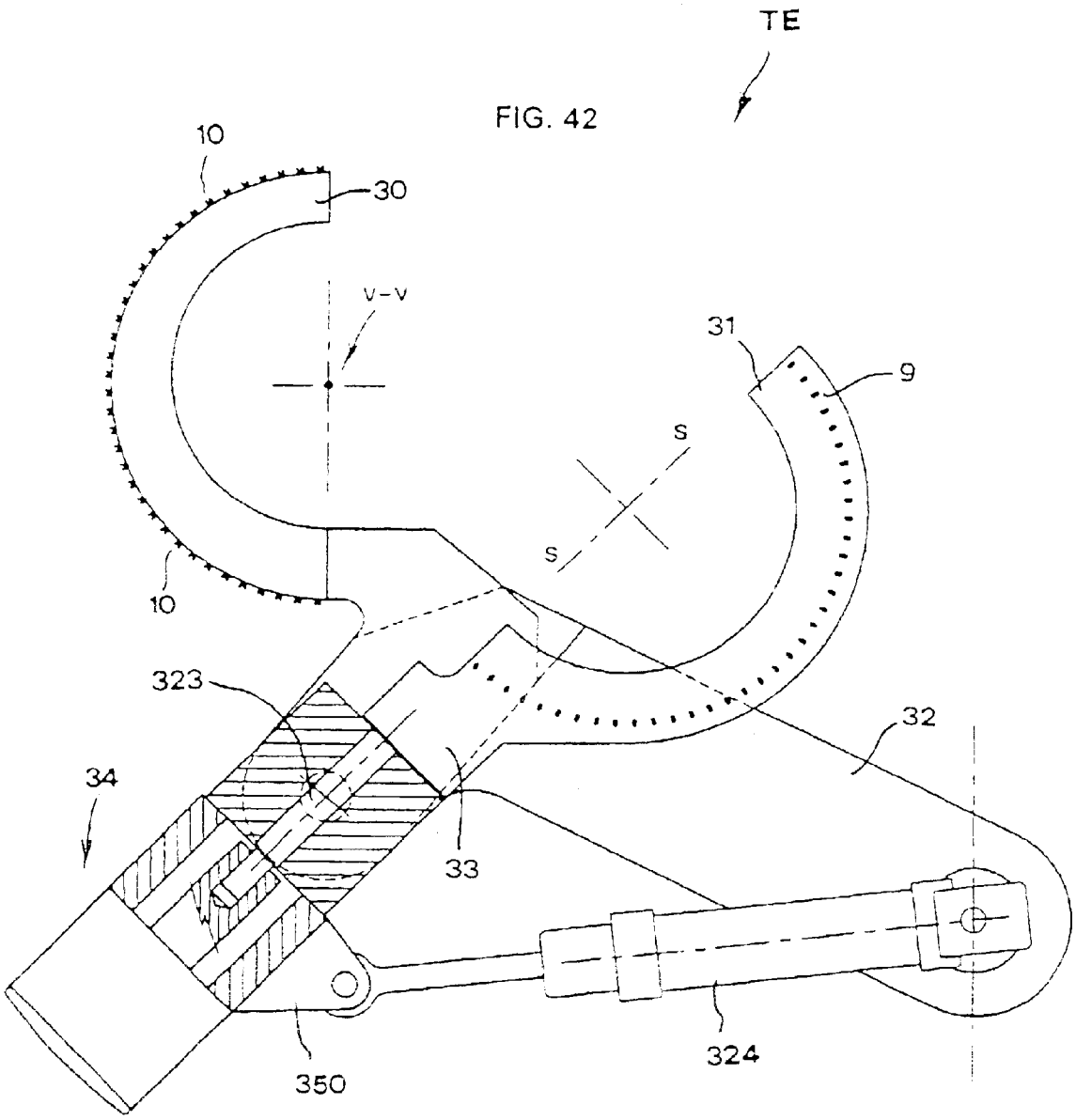
FIG. 42 is a plan view of the third movable carrier of FIGS. 3A-18.
Figure 44:
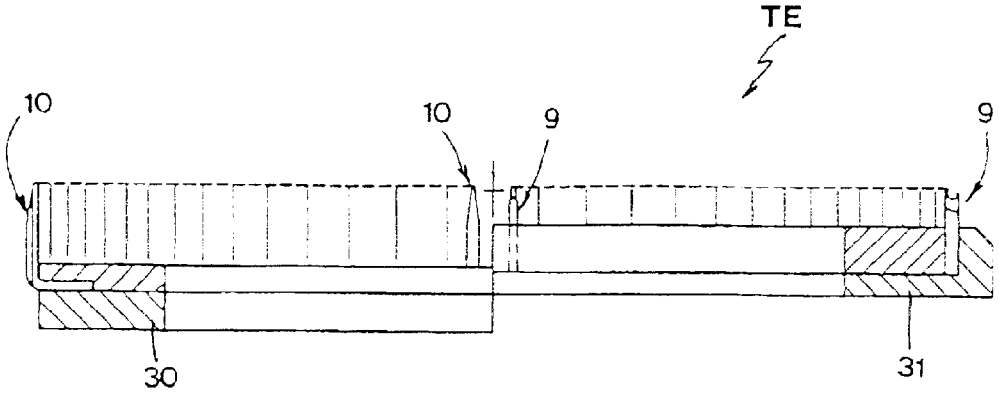
FIG. 44 is a section view taken on line A—A in FIG. 43.
Figure 43:
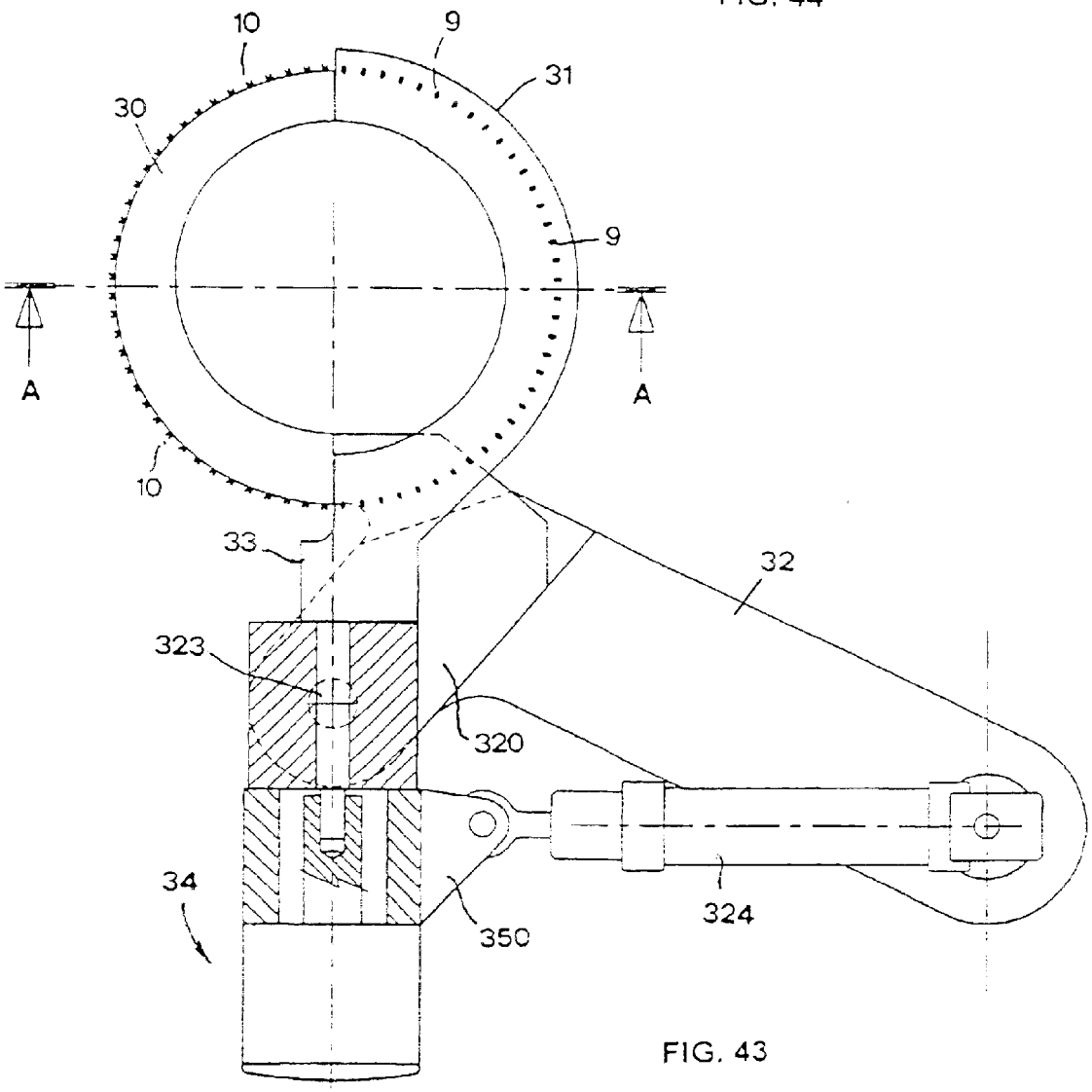
FIG. 43 shows the carrier of FIG. 42 in closed or operating condition.
Figure 46:
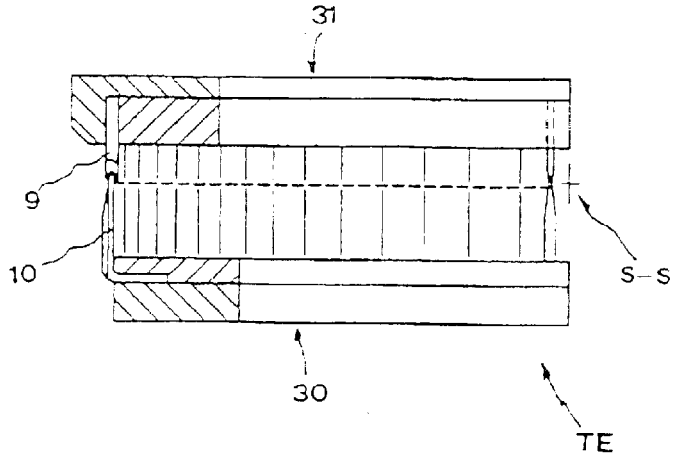
FIG. 46 is a view in section view taken on line B—B in FIG. 45.
Figure 45:
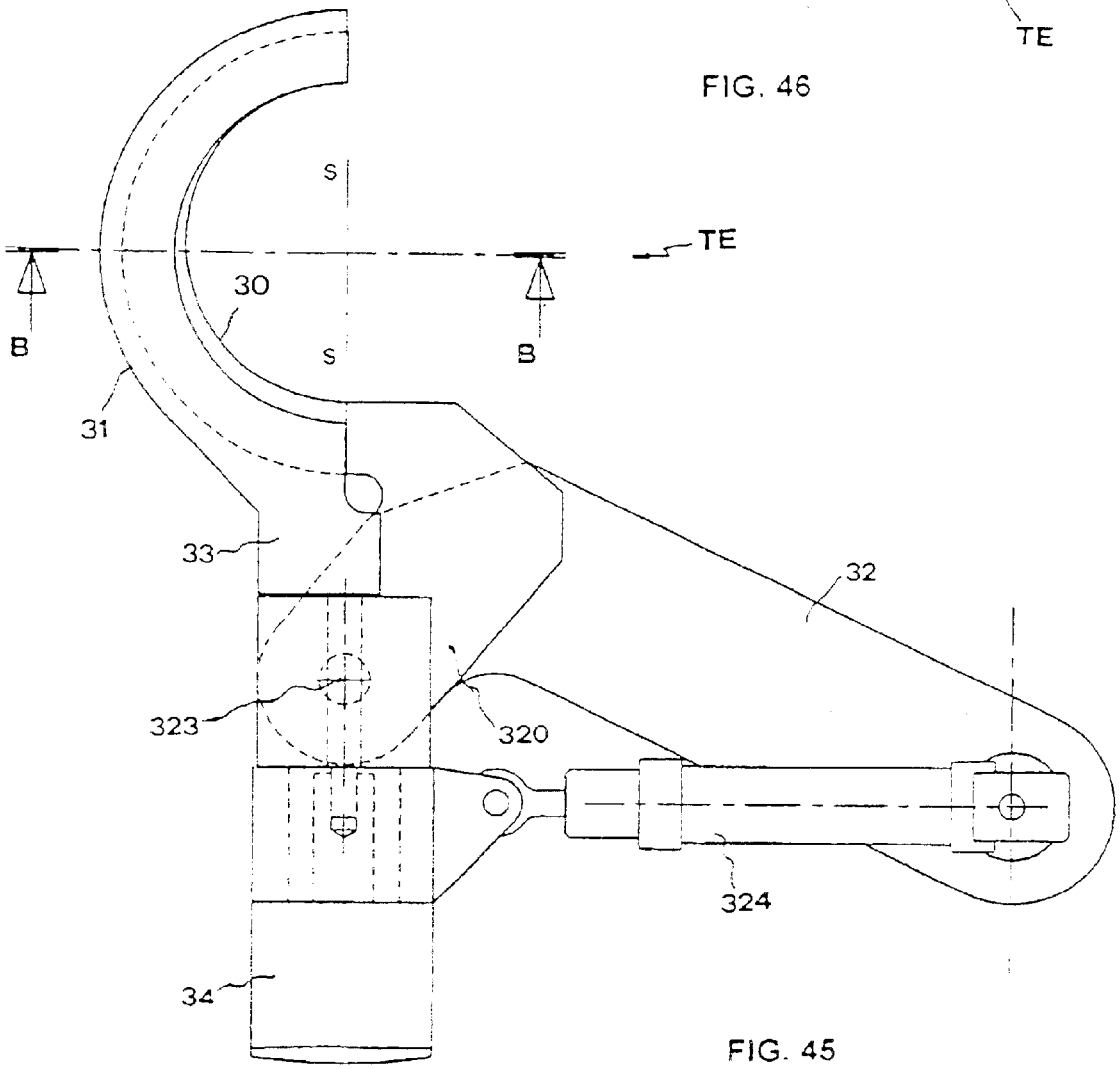
FIG. 45 shows the carrier of FIG. 43 after the rotation of a semicrown.

The third movable carrier (TE) comprises, with reference to the example illustrated in FIGS. 42-48, two semicrowns (30, 31). Mounted on the first of these semicrowns is a plurality of hook-up spines (10), on the other semicrown (31) being mounted a corresponding plurality of rods (9). The angular displacement between the rods (9) and, respectively, between the spines (10) corresponds to the distance between the needles (2) of the machine (M). Each of said semicrowns (30, 31) is onto a corresponding support arm (32, 33). The said arms (32, 33) are connected to each other in correspondence of a lateral appendix (320) of arm (32) of the semicrown which supports the spines (10), via a hinge (323) whose axis is orthogonal to the same arms to allow moving the semicrowns (30, 31) like the jaws of a gripper. This movement can be obtained, for example, by an actuator (324) the stem of which is fixed to a lateral appendix (350) of the arm (33), the skirt being fixed to the arm (32). The extension of the stem of actuator (324) makes it possible to move the semicrowns (30, 31) away from each other as shown in FIG. 42, whereas the drawing back of same stem causes the semicrowns (30, 31) to move close to each other as shown in FIG. 43. In this way, it is possible to use the third movable carrier (TE) also when the eversion tube (TR) is present at station (R) as shown in FIG. 10: firstly, the semicrowns (30, 31) are moved apart, that is, disposed in the condition of FIG. 42 and then, once they are placed in the station (R), are drawn near to each other, that is, disposed in the condition of FIG. 43 for encircling the tube (TR). Besides, the arm (33) of the semicrown (31) which supports the rods (9) is fitted onto the shaft of a rotary actuator, for example an electric motor or a pneumatic actuator (34), to allow the semicrown (31) to rotate through 180° about an axis (s-s) parallel to a diameter thereof, that is, to allow the overturning of semicrown (31) over the semicrown (30), as illustrated in FIGS. 12, 13, 45 and 46. The arm (32) which supports the semicrowns (30, 31) is idly mounted on the shaft (17), at a height less than that for the mounting of arm (16) supporting the first carrier (PE), and is associated with a corresponding actuator (322) whose stem is connected to a rear appendix (321) of arm (32), the skirt of the actuator (322) being connected to a stationary structure (K). The third carrier (TE) is brought to the station (R) subsequently to the transfer of members (7) from the first (PE) to the second carrier (SE) and, prior to said transfer, is placed out of station (R) in a stand-by position (not shown in the figures of the attached drawings). The rotation of arm (32) for disposing the carrier (TE) at station (R) and respectively at said stand-by position is operated by the actuator (322).

With the third carrier (TE) can be advantageously associated a toothed semicrown (12) able to operate the transfer of stitches from the rods (9) to spines (10), subsequently to the overturning of the semicrown (31).

The said semicrown (12) can be mounted onto the semicrown (31) of rods (9) by means of two helical retention springs (101) which, on one side, are fixed inside corresponding seats (102) provided by the semicrown (31) and, on the opposite side, are engaged in correspondence of respective seats (103) provided by the semicrown (12).

The toothing's pitch of semicrown (12) is such that each tooth (100) of the latter will result disposed within the space between two adjacent rods (9).

The action of springs (101) is such as to retain the semicrown (12) onto the semicrown (31), as shown in FIG. 89.

To transfer the stitches (MA) from the rods (9) to spines (10), the semicrown (12) is pushed towards the spines (10), as shown in FIG. 90, by winning the elastic resistance of springs (101), so that the teeth (100) will correspondingly push the stitches (MA) fitted on rods (9) until the same stitches will result transferred onto the spines (10) ready to receive them. To this end, a fork pusher (104) is provided driven by an actuator (105). The two arms (106) of the fork (104) are intended for acting onto the semicrown (12) by passing through two holes (107) formed within the body of the semicrown (31). The bracket (108) which connects the arms of the fork (104) is also shaped like a circular semicrown in order not to interfere with the tube (TR) in the station (R) and, for the same purpose, the actuator (105) is engaged with a stationary structure (Y) so as to act on the bracket (108) at the point (Z) furthest away from the axis of the tube (TR).

The operation of this apparatus, in relation to the implementation of the operating method above described with reference to FIGS. 1-18, is as follows.

Figure 7:
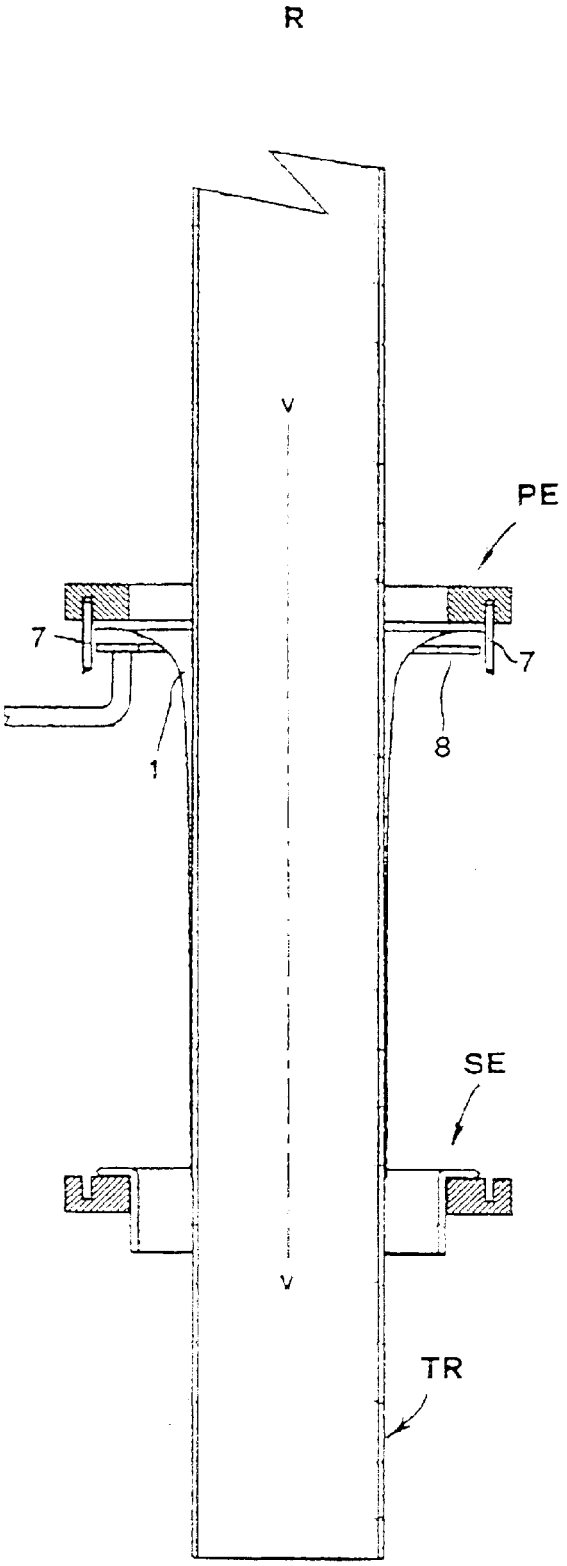
FIG. 7 shows the first movable carrier and the safety device in the hook-up station, with a an eversion tube being inserted into the article, and a second movable carrier being disposed coaxial with the first movable carrier.

After completing the knitting of article (1) and having lifted the plate (P) along with needles (2) to have the latter ready for unloading the stitches, the arm (16) is rotated by the cylinder (172) about the axis (b-b) of shaft (17), so as to dispose the first movable carrier (PE) coaxial with needles cylinder (3), as shown in FIG. 3. Moreover, as the rods (7) of carrier (PE) are angularly spaced apart like the needles (2), the subsequent lowering of carrier (PE) is cause for the rods (7) to push the needles (2) downwardly, as shown in FIG. 4, which determines the automatic closing of the respective latches (21) and the insertion of the same rods into the stitches (MA) of the last knitted rank. In this way, the stitches of the last rank will result no longer engaged with the needles (2) but with the rods (7), owing to the typical elasticity of the stitches and to the tension generated by the article, as the knitting needles (2) and the members (7) are disposed along a circumference having a radius lesser than that of the free portion of the article (1), that is, of the portion not engaged by the needles (2) nor by members (7). Afterwards, the arm (16) is lifted, along with tube (T) of machine (M) as shown in FIG. 5 and, after a possible intervention by the safety device (8), the tube (T) is brought back to its original position as illustrated in FIG. 6. At this point, the arm (16) is rotated, again by the action of cylinder (172), to dispose the carrier (PE), with the article (1) engaged therewith, into the station (R) wherein the hook-up operation will be performed. The eversion tube (TR) is introduced into the article (1) engaged with the carrier (PE), as shown in FIG. 7, and subsequently lifted up as shown in FIG. 8 to turn it inside out. At this point, the command is given for lifting the second movable carrier (SE). Because of the coaxiality of carriers (PE) and (SE) within the station (R) and the matching shape of the seats exhibited by these carriers for rods (7), the free ends of same rods (7) result—upon completion of the step for lifting the second carrier (SE)—positioned within the seats (191) of the second carrier (SE), as illustrated in FIG. 8. At this point, the rods (7) are transferred from the first to the second movable carrier. In particular, provision is made for disengaging the rods (7) from the gasket (152) by reducing the diameter of the latter which takes up, therefore, the configuration of FIG. 38 or FIG. 40, and by acting on the corresponding gasket of the second movable carrier (SE) which in this way takes up a configuration corresponding to that of FIG. 39 or FIG. 41. At the end of this step, the second movable carrier (SE) is lowered, as illustrated in FIG. 9, so that, between the first and the second movable carrier, a space is created for the positioning of the third carrier (TE) which, in the condition shown in FIG. 10, results coaxial to the second.

The transfer of rods (7) from the first to the second movable carrier implies the disengagement of article (1) from the first carrier and its engagement with the second carrier through the rods (7), but this operation takes place without further stress for the stitches of the last rank which remain on the rods (7).

Figure 13:
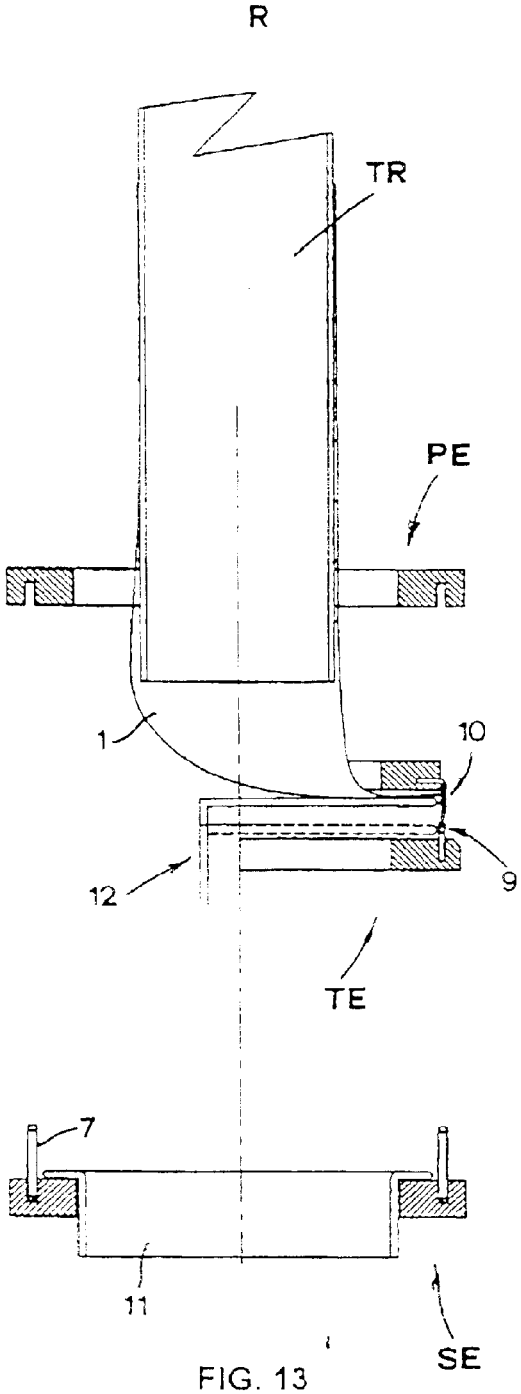
FIG. 13 shows the step of drawing and juxtaposing the stitches of the first semirank near the corresponding stitches of the second semirank.
Figure 15:
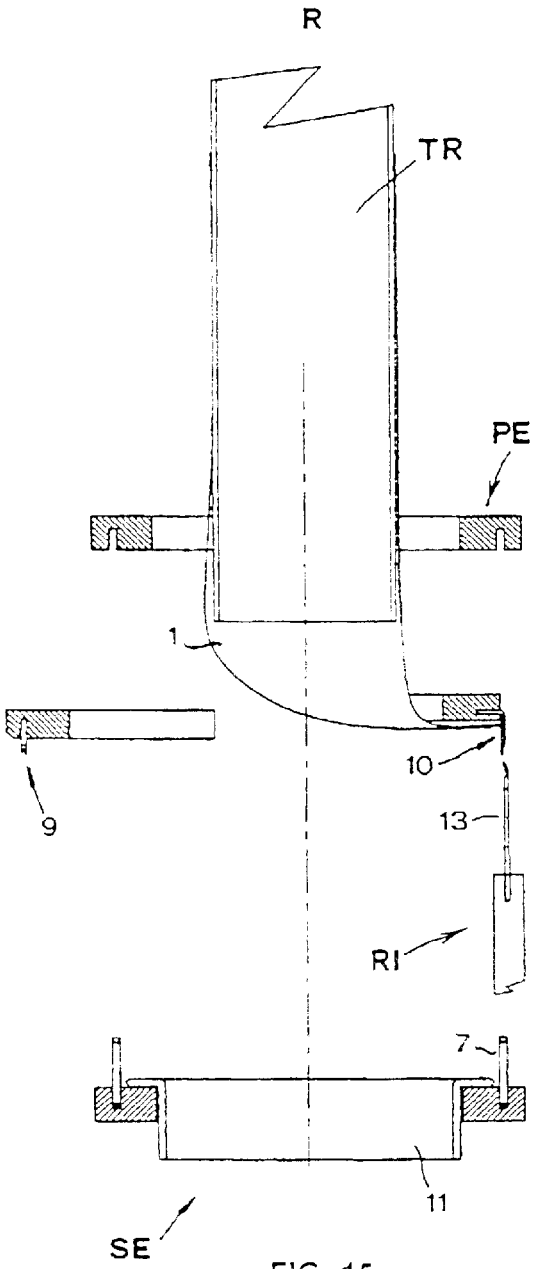
FIG. 15 shows the step of hooking-up pairs of thus formed stitches.

As previously set forth, for the third movable carrier (TE) to be disposed coaxial with the second carrier, in spite of the presence of tube (TR), the arms (32, 33) which support the semicrowns (30, 31) of the third movable carrier (TE) are first stretched apart as shown in FIG. 42 and, afterwards, drawn back close to each other as shown in FIG. 43. Then, the transfer device (11) is operated and, as it goes up, pushes upwards the stitches fitted onto rods (7) thus causing them to be transferred, that is, fitted onto the rods (9) and onto the spines (10) of the third movable carrier (TE). Subsequently, the said transfer device (11) is lowered along with the second carrier (SE) thereby clearing the space beneath the third movable carrier (TE) as illustrated in FIG. 11, and the semicrown (31) of rods (9) is rotated through 180° about said axis (s-s) as shown in FIG. 12. At this point, as illustrated in FIG. 13, the stitches of rods (9) are transferred onto the spines (10) by means of the toothed semicrown (12). In this way, there is achieved a condition of coaxiality and juxtaposition of the stitches of the two semiranks, that is, of the two edges to be joined. In practice, upon completion of this step, each stitch of a semiranks lies on a corresponding spine (10) and the latter results matched, that is, coaxial and juxtaposed, with a corresponding stitch of the other semirank present on the same spine (10). Thereafter, the semicrown (31) of rods (9) is rotated through 180° in a direction opposite to the previous one in order to restore the initial condition, as illustrated in FIG. 14. At this point, it is possible to carry out the hook-up of the stitches being matched onto the spines (10) by a conventional hook-up machine, as shown in FIG. 15 and, subsequently, to unload the article (1) in right-side out condition as represented in FIG. 16. In particular, it is possible to lower the tube (TR) to exert a top-down push onto the joined stitches to release them from the spines (10) and, besides, the suction (AS) of the article (1) into the tube (TR) can be performed with the aid of rod (14) as illustrated in FIG. 16. Once the article (1) is unloaded through the tube (TR), the latter is lifted and then the semicrowns (30) and (31) are brought back to the respective start position to clear the space between the first and second movable carriers (PE, SE). Following this, as shown in FIGS. 17 and 18, the first and second movable carriers (PE, SE) are moved again close to one another and the transfer of members (7) from the second (SE) to the first movable carrier (PE) takes place through a reverse sequence of operations, so that the apparatus results in the configuration taken up at the start of the operating cycle above described, ready to carry out a further cycle.

With reference to FIGS. 20-36, the present invention can also be implemented according a further operating method, again relating to the production of a stocking by a one-cylinder circular machine (M) provided with a plate. Such method implies the steps described in relation to the example of FIGS. 1-18 with the differences set forth below.

Figure 2B:
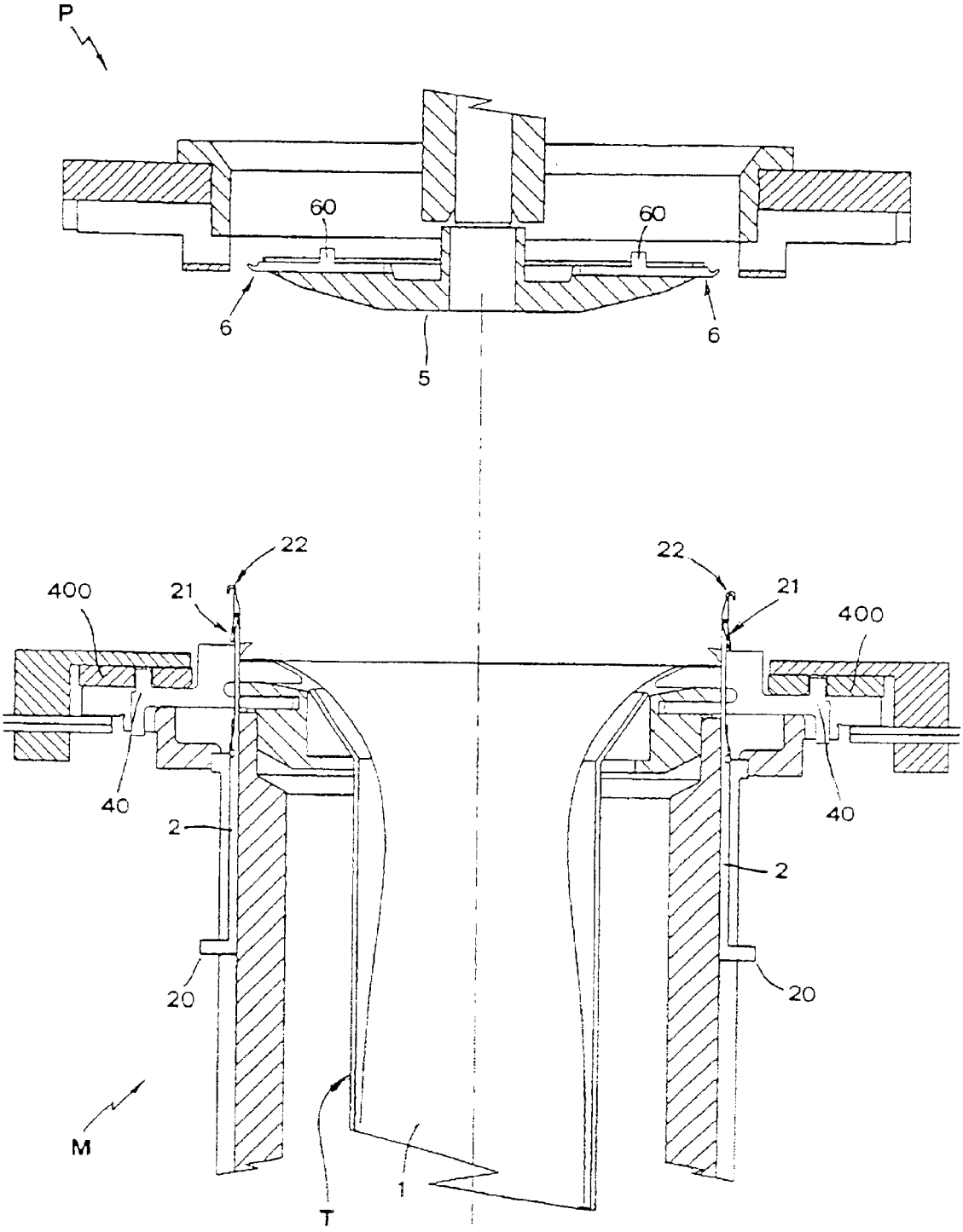
FIGS. 2B and 2C show, in different scales, enlarged details of the drawing in FIG. 2A.
Figure 2C:
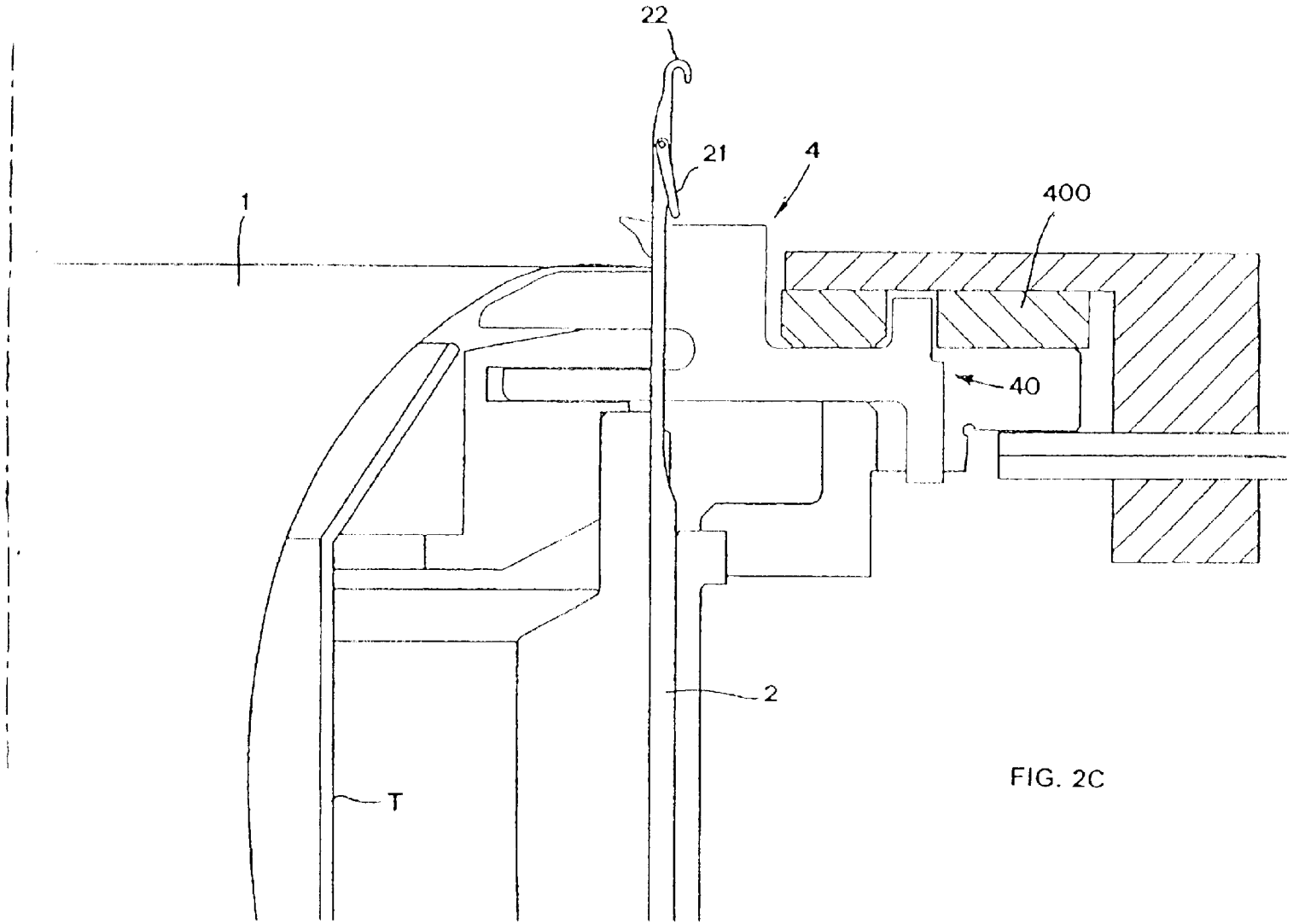

In a manner substantially similar to what has been illustrated in FIGS. 1-2A, at the end of the knitting step, the plate group (P) and the needles (2) of machine (M) as well are lifted until the respective stitches result "unloaded" (also in this case, a stitch is said to be in "unloaded position" when it results fitted onto a needle and disposed below the relevant latch).

At this point, a first movable carrier (PE') is positioned so that, at end of this step (illustrated in FIG. 19) it is in axial alignment with the cylinder (3) of needles (2), with the free end of each removal member (7) being in contact with the crook of a relevant needle (2), thereby determining the so-called "covering" condition previously mentioned.

Figure 19:
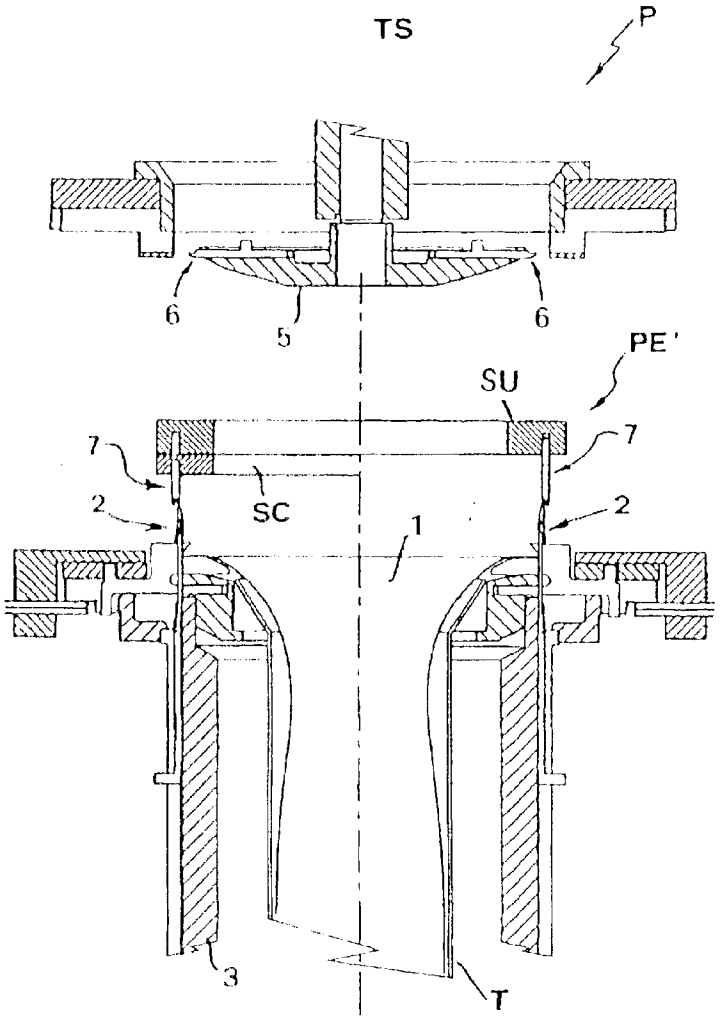
FIG. 19 shows, reference being made to a further exemplary embodiment of the invention, a first movable carrier having members associated therewith for the removal of stitches of the last-knitted rank, the said first movable carrier being disposed so that the said removal members will result upon the needles of the knitting machine, the said needles being lifted up as shown in FIG. 3A.

The first movable carrier (PE') used for implementing this method differs from that previously described in that it is of modular construction and comprises a semicrown (SC) associated in stable but removable manner to said carrier:

the removal members (7) (which in the whole develop circularly along an entire circumference) are subdivided into an upper semicrown (SU) (on the right side in FIG. 19), like it is provided for the movable carrier (PE) utilizable for the implementation of the method previously described, and a lower removable semicrown (SC) (on the left side in FIG. 19). This allows differentiating the two semiranks which form the last rank of stitches. In other words, the said removal step provides for engaging the two fabric's semiransks with the members (7) associated with two different semicrowns, a first one (SU) coinciding with the main part of the movable carrier (PE'), and a second one made up of the removable semicrown (SC). Obviously, the length of the removal members (7) will be differentiated, a greater length being provided for the members (7) associated with the semicrown (SU) and a minor length for those associated with the semicrown (SC), so that the free ends of members (7) associated with these two supports (SU, SC) disposed as shown in FIGS. 19, 20, 21 and 22, will result all at the same level. A possible embodiment of the modular carrier (PE') being described later on.

Figure 20:
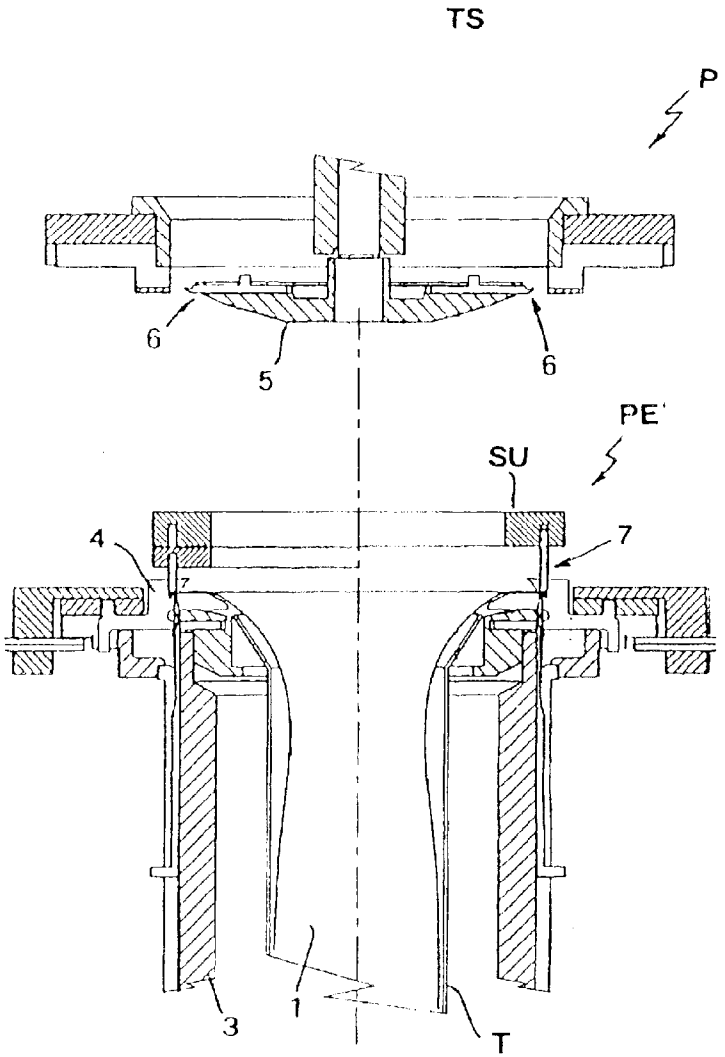
FIG. 20 shows the step of lowering the movable carrier of FIG. 19 along with the knitting needles.
Figure 22:
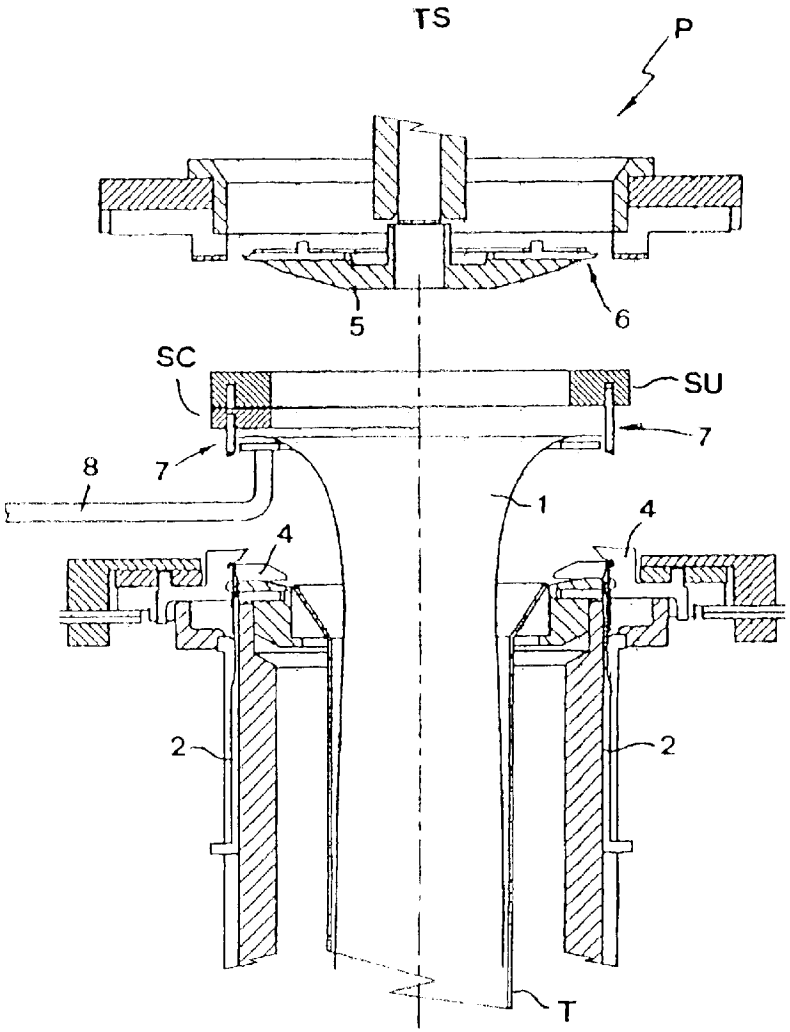
FIG. 22 shows the positioning of a safety device.
Figure 21:
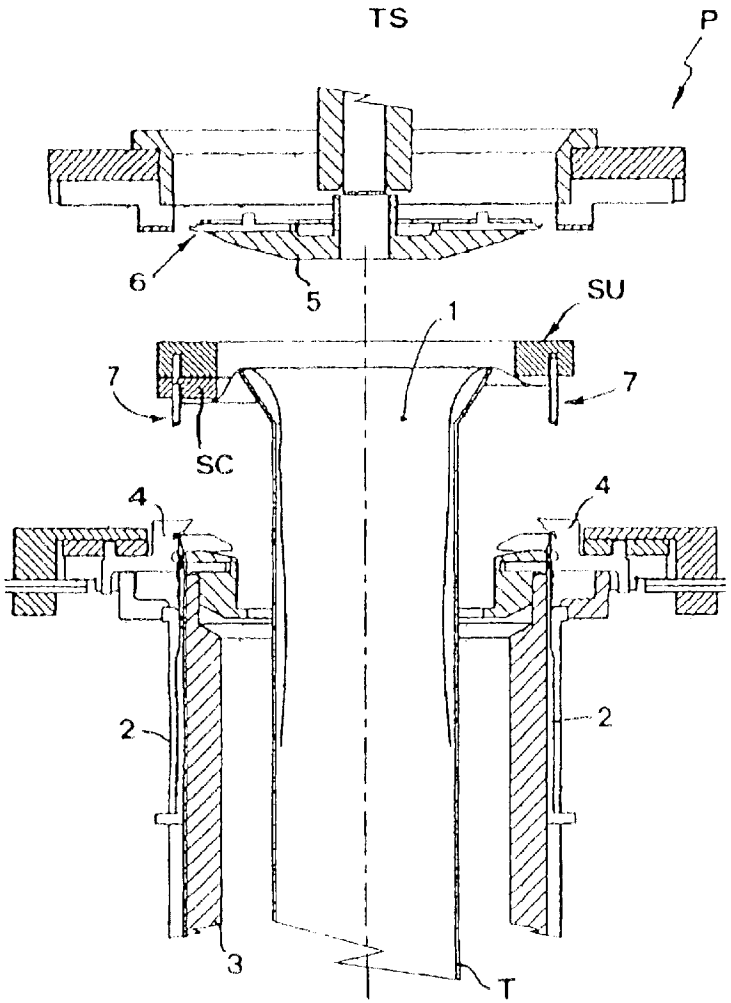
FIG. 21 shows the lifting of the movable carrier of FIG. 19 with the article being disengaged from the knitting needles and engaged with the removal members associated with same carrier.

Thereafter, the said carrier (PE') is lowered as shown in FIG. 20 by procedures similar to those provided for the method already described, and subsequently lifted, as shown in FIG. 21, simultaneously to the tube (T), so that the mouth of the latter will result at a level higher than that of the free ends of the removal members (7). Also in this case, the lifting of tube (T) is not strictly necessary for carrying out this step, but it may serve to assist the lifting of the article (1) together with carrier (PE') and to prevent one or more stitches from disengaging from relevant removal members (7). Moreover, and likewise the previous method, a safety device (8) may be used which consists of a portion of a circular crown borne at the end of a support arm (as shown in FIG. 22).

Figure 23:
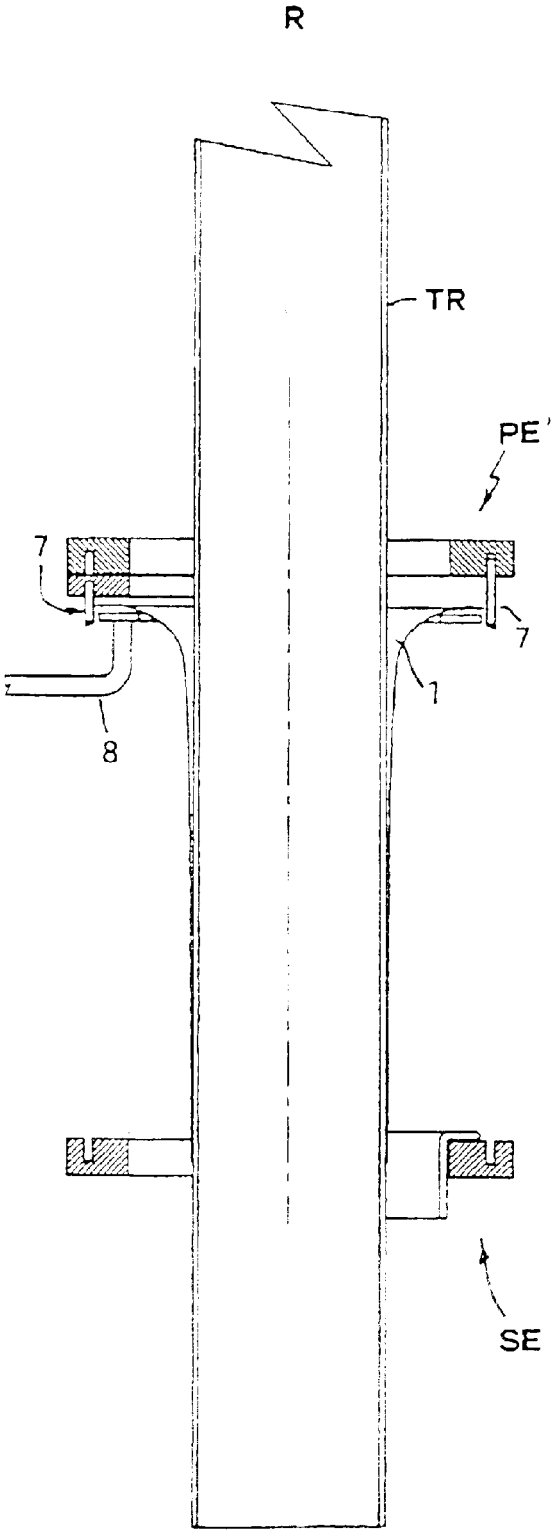
FIG. 23 shows the introduction of an eversion tube inside the article at a hook-up station separated from the knitting station.
Figure 24:
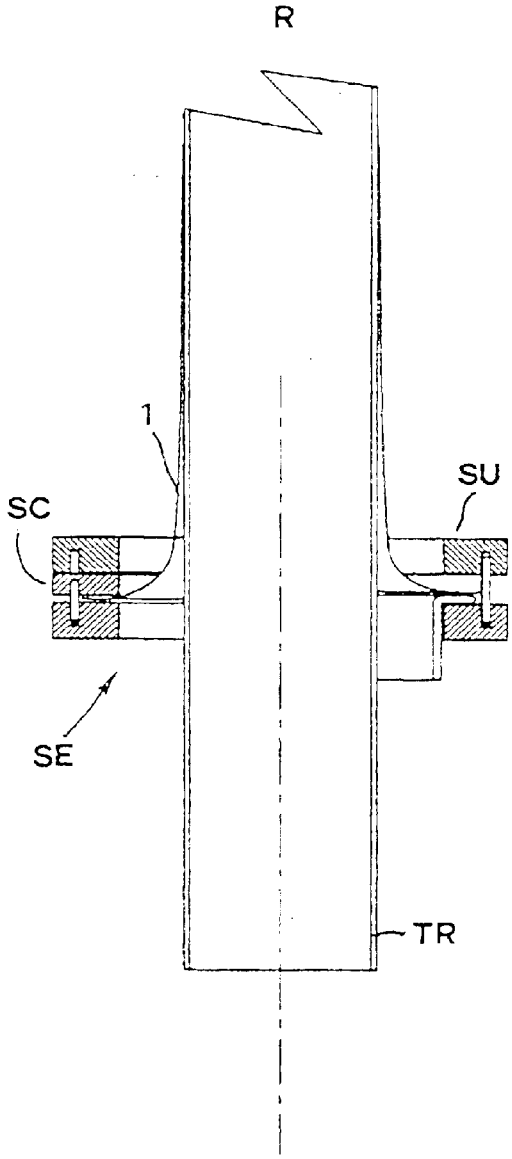
FIG. 24 shows the lifting of the eversion tube of FIG. 23, subsequently to the moving away of the safety device, and the drawing of a second movable carrier near the first one to allow the transfer of the stitch-removing members from the first movable carrier to the second one.

The first movable carrier (PE') is then moved to the hook-up station (R) and an everting tube (TR) is inserted therein (FIG. 23). The article (1) is then turned inside out, as shown in FIG. 24, after having moved away the device (8) if any. In this way, the article results oriented in a fashion contrary to the starting one, that is, with the part including the last rank turned downwards and the remaining part turned upwards, so that the stitches of the last rank result below all the other stitches of the article.

Figure 25:
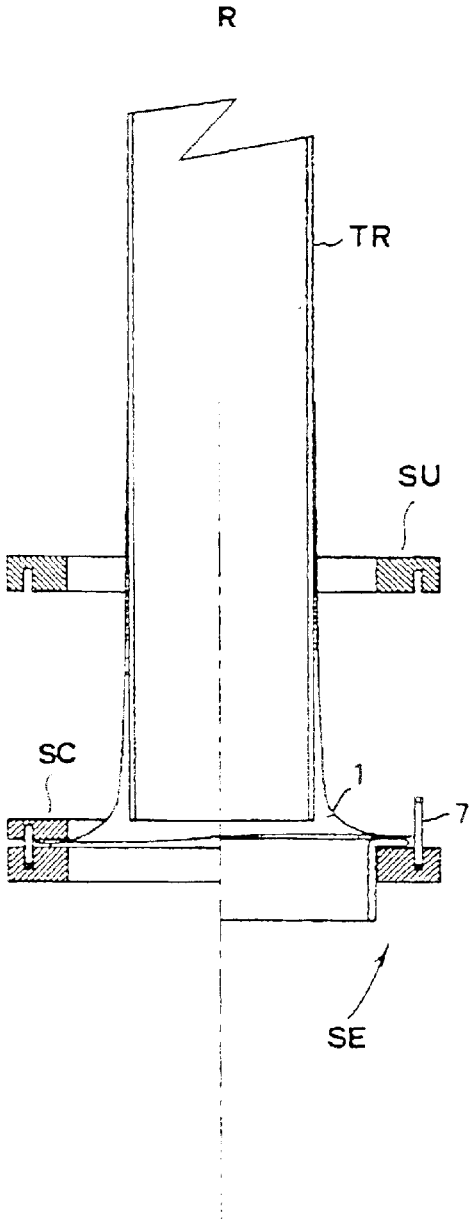
FIG. 25 shows the moving of the first movable carrier away from the second one.

Thereafter, a second movable carrier (SE) is drawn near the first one (PE') (as shown in FIG. 24) to transfer the removal members (7) of the first semirank, that is, those supported by the first semicrown (SU), to the second movable carrier (SE), by inserting them into the respective seats. This step may be performed by moving the second carrier (SE) close to the first (PE) as illustrated in FIG. 24 and, once the transfer is completed, by moving the semicrown (SU) of the first movable carrier (PE) away from the second carrier (SE), as illustrated in FIG. 25. In this step, the second semicrown (SC) remains close to the second movable carrier (SE) to maintain a condition of substantial coplanarity of all the stitches of the last knitted rank.

Figure 26:
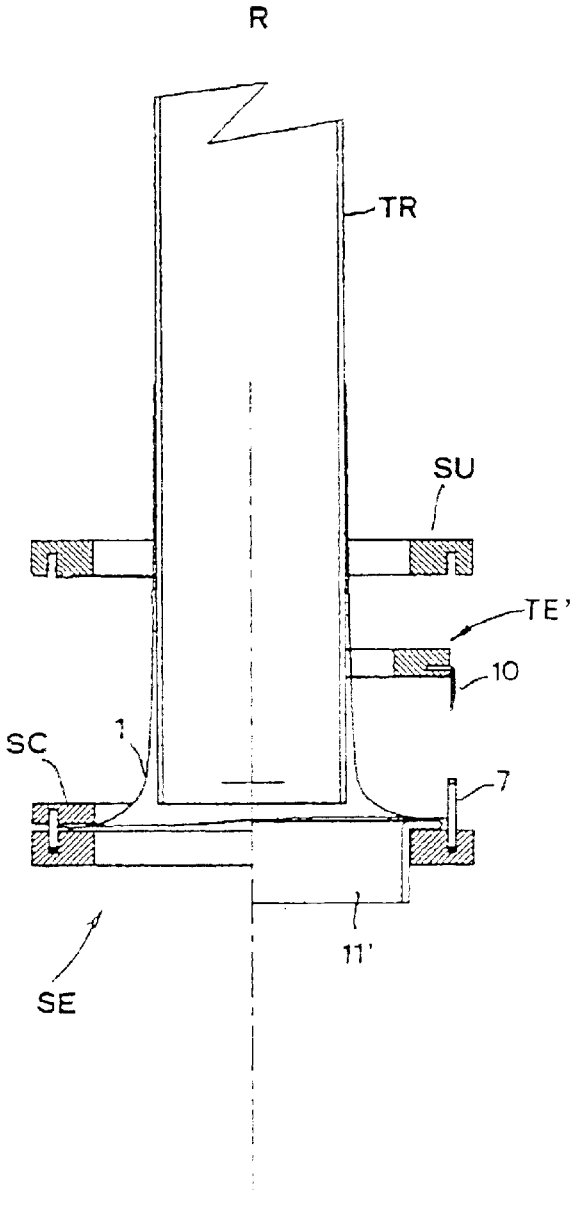
FIG. 26 shows the step of drawing a third movable carrier near a portion of the second movable carrier, the said third carrier exhibiting a plurality of hook-up spines.

At this point, as illustrated in FIG. 26, a third carrier (TE') is drawn near the tube (TR), said third carrier being made up of a semicrown provided with a plurality of retention members (10) intended to retain the stitches (MA) of the last rank of article (1) for a subsequent hook-up step, the same members being disposed according to a semicircumference. The said third carrier (TE') is positioned between the crown (SU) of carrier (PE') and the group formed by the semicrown (SC) and second movable carrier (SE). Prior to said positioning, the third carrier (TE') results located at a corresponding stand-by position outside the station (R). The handling of the arm (32) which supports the third carrier (TE') is achieved by means of an actuator in a manner similar to that described above for the third carrier (TE).

Figure 27:
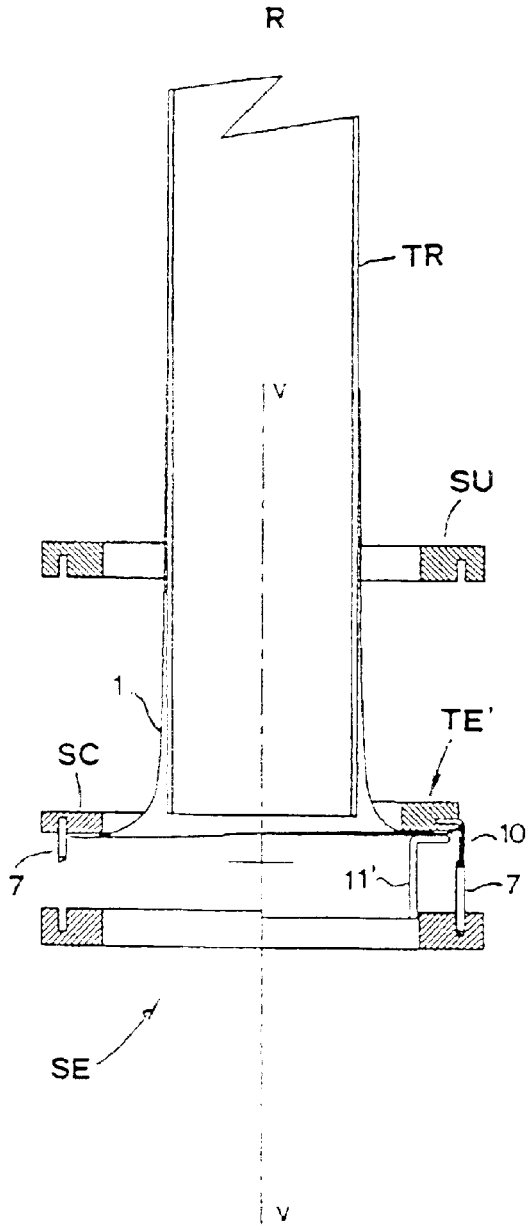
FIG. 27 shows the step of transferring the stitches of a semirank from the respective removal members, associated with the second movable carrier, to the spines of the third carrier.

The said stitch-retaining members for the hook-up (10) may consist, as in the example referring to the third movable carrier (TE) above described, of a plurality of hook-up spines (10). As illustrated in FIG. 27, the transfer of the stitches from the members (7) disposed upon the second movable carrier to the spines (10) can be made by using a collar flange (11') similar to that (11) previously described. Concurrently with the lifting of the flange (11') which, likewise the flange (11) previously described, pushes the stitches fitted on rods (7) upwards to transfer the same stitches onto the spines (10), there is occurs the lifting of the semicrown (SC) to maintain the condition of substantial coplanarity of all the stitches (MA) of the last rank.

Figure 28:
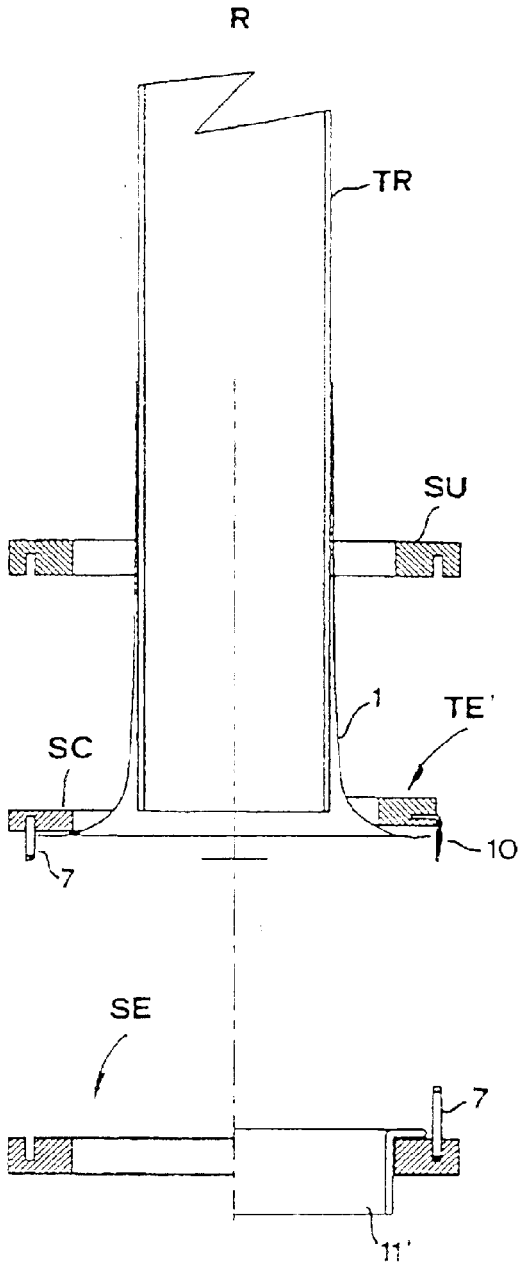
FIG. 28 shows the moving of the second movable carrier away from the third carrier.
Figure 29:
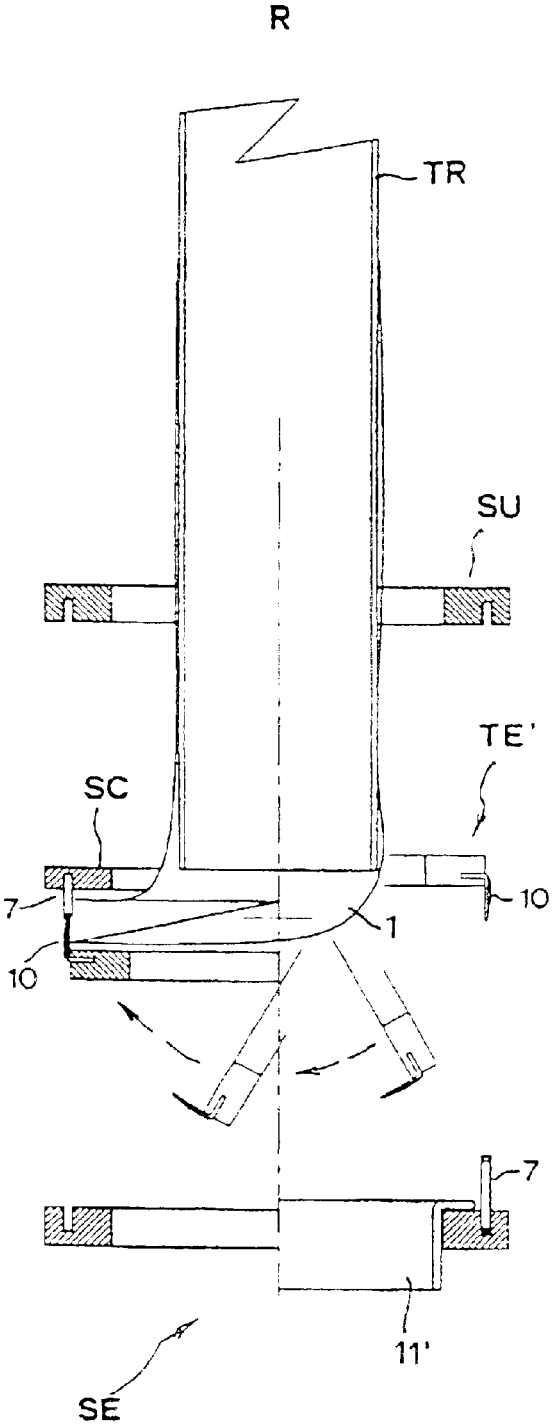
FIG. 29 shows the positioning of the stitches associated with said spines in correspondence of the stitches of the other semirank.
Figure 30:
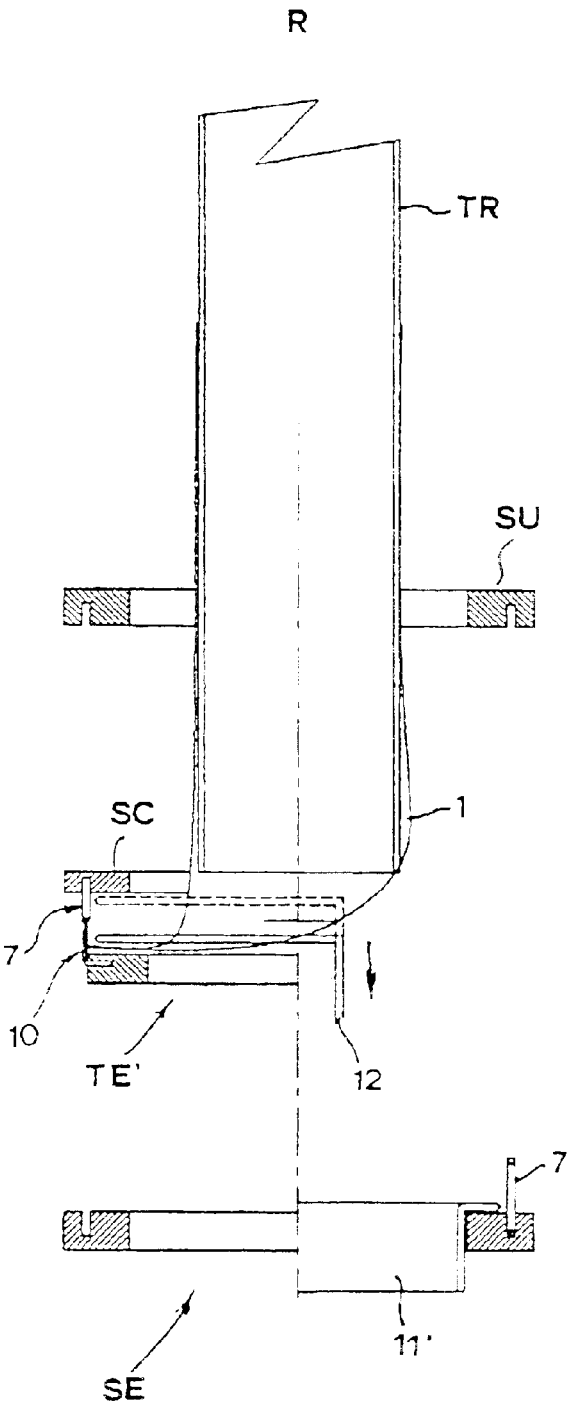
FIG. 30 shows the subsequent step of juxtaposing the stitches of said other semirank Over those fitted on said spines.
Figure 31:
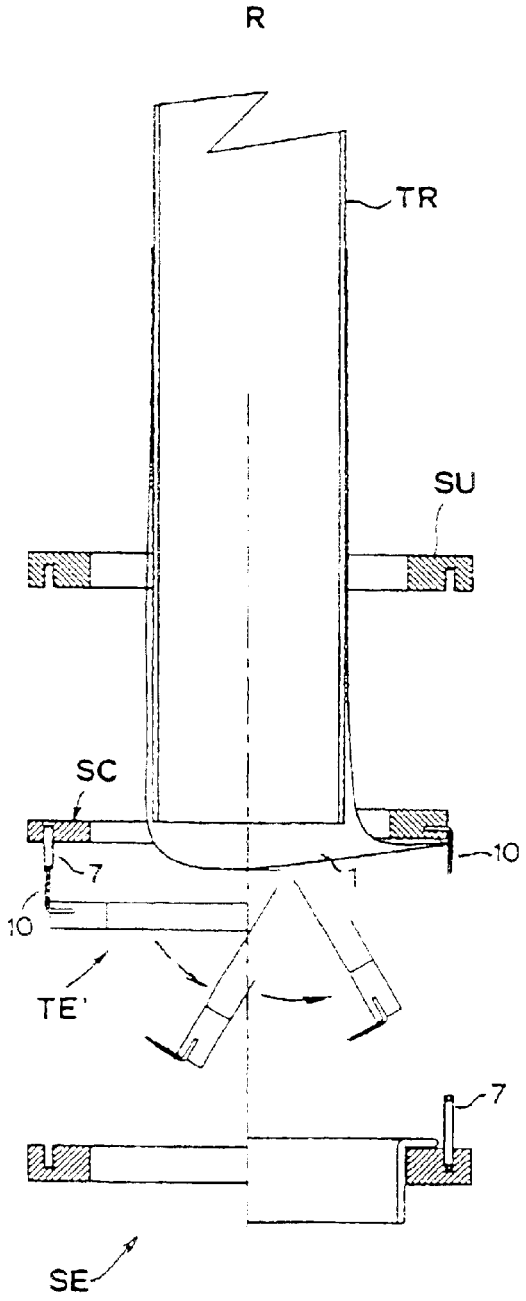
FIG. 31 shows the repositioning of the spines in the condition of FIG. 28.
Figure 32:
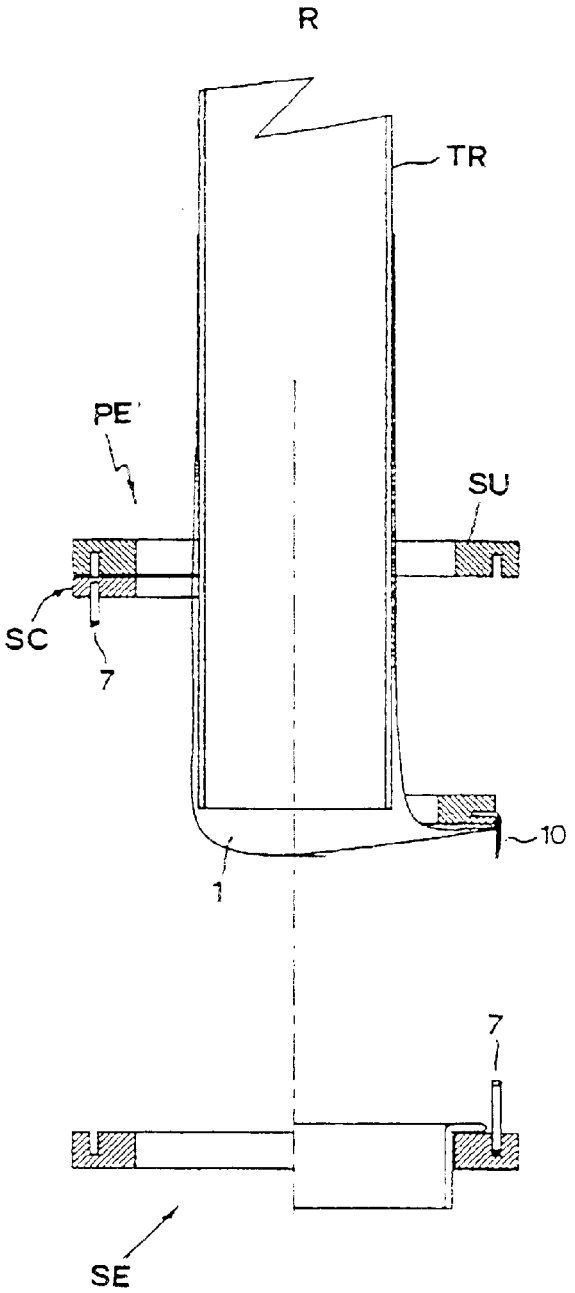
FIG. 32 shows the moving away of the first movable carrier being partially rearranged.
Figure 33:
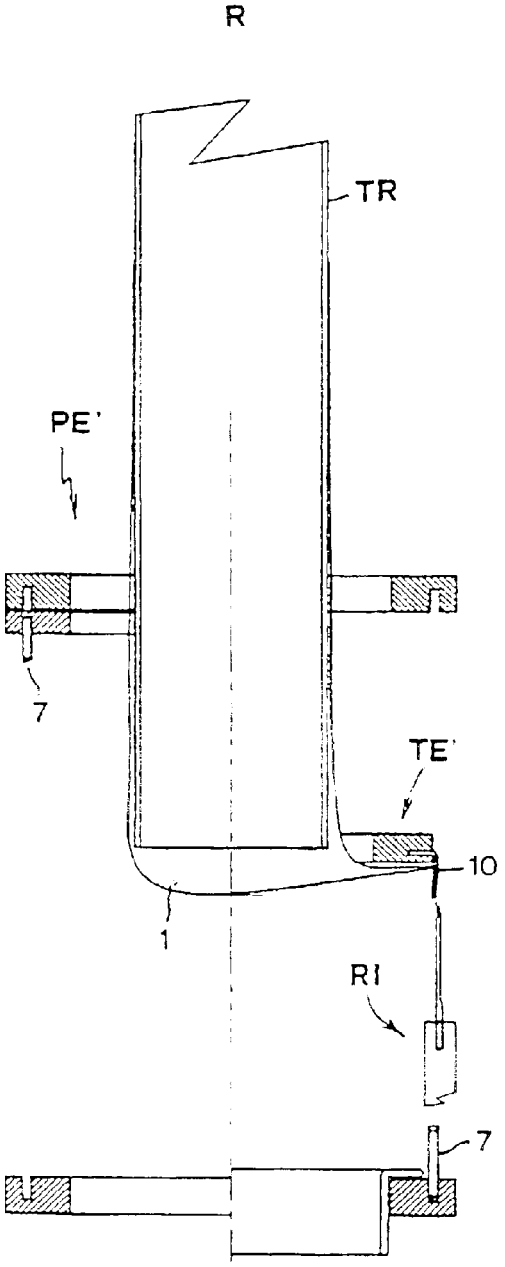
FIG. 33 shows the step of hooking-up the edges corresponding to the thus disposed semiranks of stitches.
Figure 34:
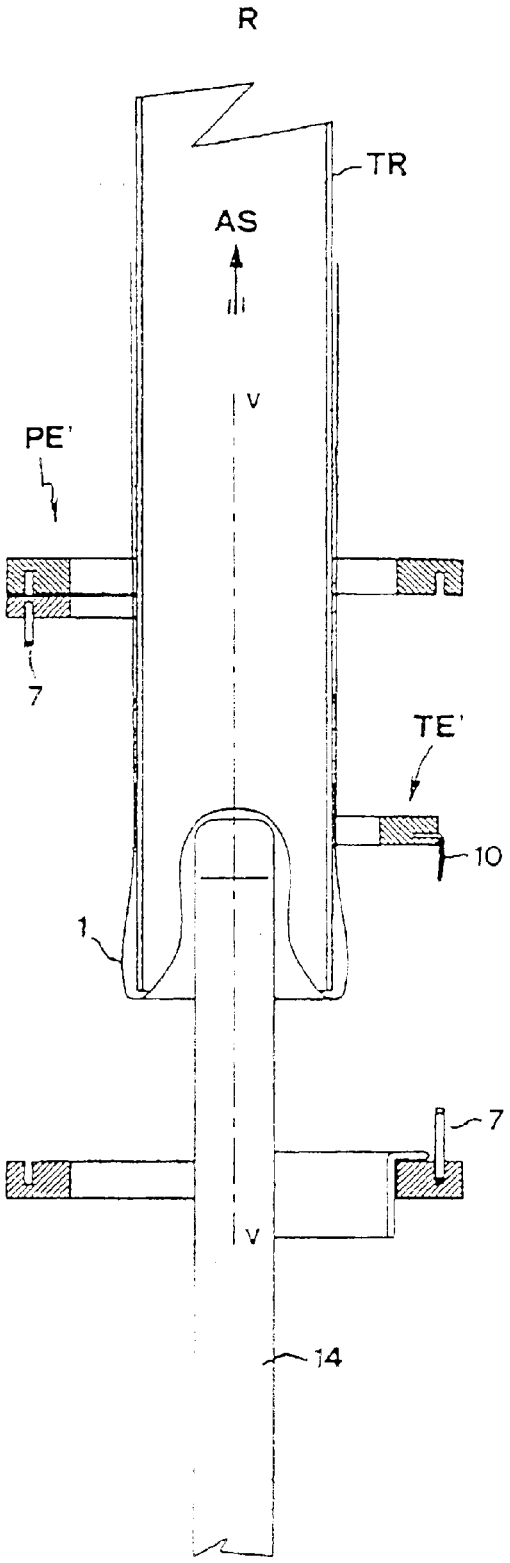
FIG. 34 shows the step of releasing the article from the hold of the spines.
Figure 35:
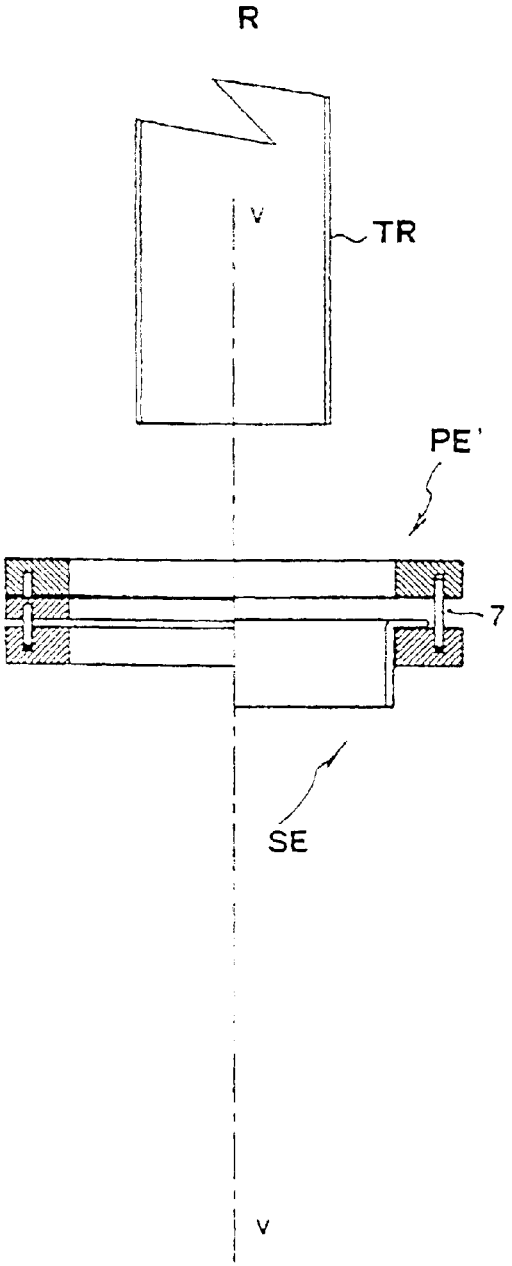
FIG. 35 shows the transfer of said stitch-removing members from the second movable carrier to the first carrier for the full rearrangement of the latter.
Figure 36:
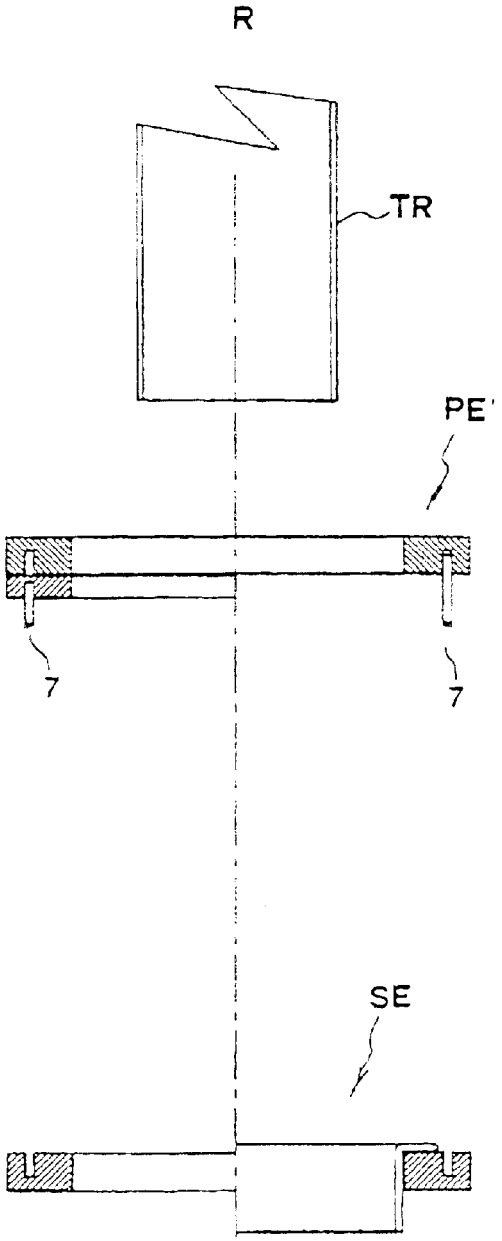
FIG. 36 shows the moving away of the second movable carrier with restoration of the initial conditions.
Figure 37:
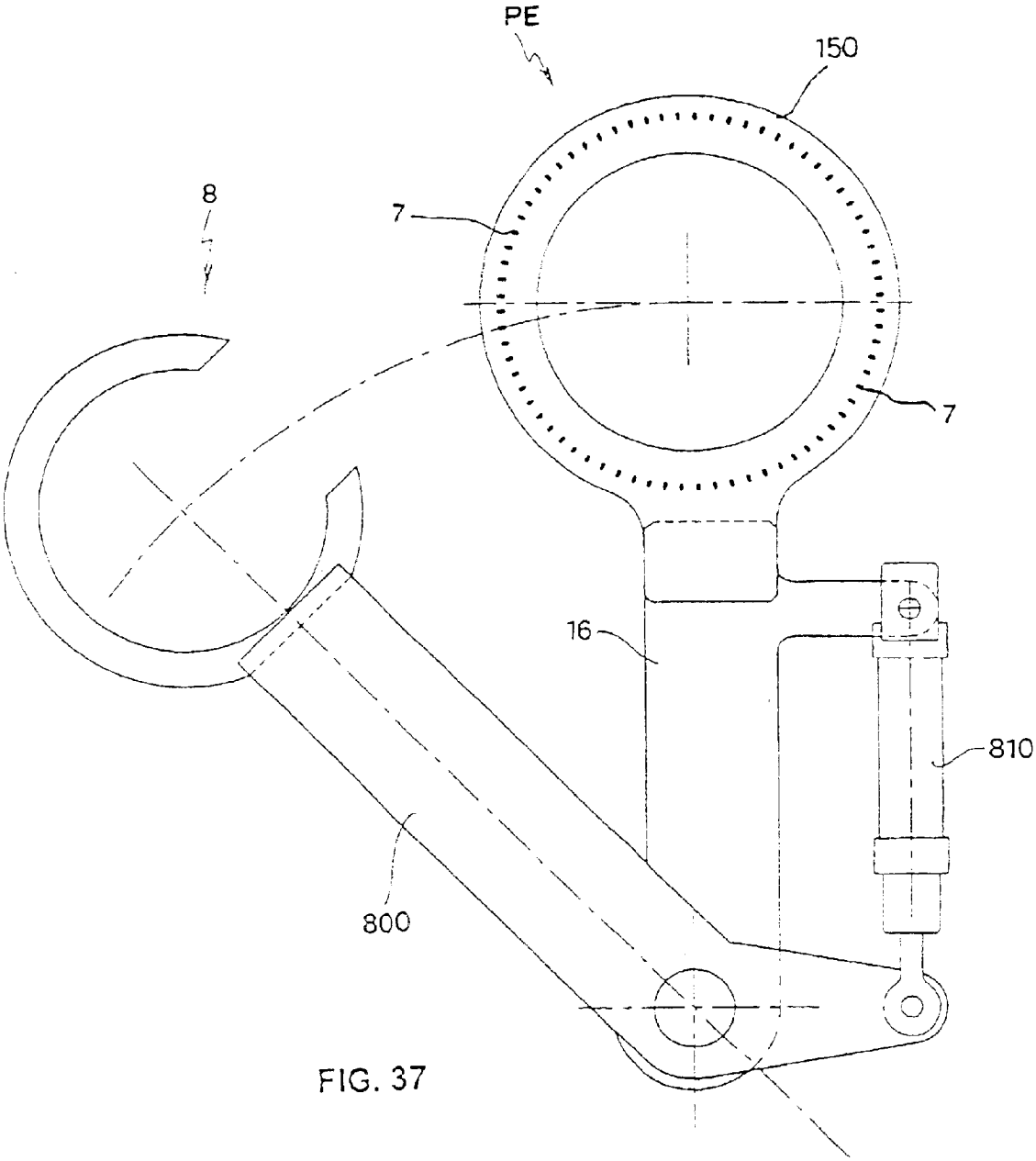
FIG. 37 shows a plan view of the first movable carrier illustrated in FIGS. 3A-18.

Upon completion of this step, the article results engaged via a semirank of stitches (MA) with the members (10) of the third movable carrier (TE'), and via the other semirank of stitches of the last knitted rank, with the members (7) of the removable semicrown (SC), that is, with the semirank's stitches fitted on the spines (10) and with the other semirank's stitches fitted on the members (7) presented by the semicrown (SC) (as shown in FIG. 28). At this point, as illustrated in FIGS. 29 and 30, the third carrier (TE') is rotated through 1800 (in clockwise direction in FIG. 29) in order to dispose the stitches of the first semirank coaxial and juxtaposed with respect to the stitches of the second semirank. The stitches (MA) fitted on the members (7) borne by the semicrown (SC) are then transferred onto the spines (10) of the third movable carrier (TE') by using, for example, the rod (12) which, as shown in FIG. 30, pushes the stitches fitted on the rods (7) downwards to transfer the same stitches onto the spines (10) of the third movable carrier (TE'). Upon completion of this step, the stitches of the two semiranks, into which it can be ideally considered subdivided the last rank of stitches, result fitted in pairs, coaxial and juxtaposed on the spines (10), ready for hooking-up. The third carrier (TE') is again rotated as far as its initial position (FIGS. 31 and 32) to allow starting the hook-up of stitches so disposed and ending it with the formation of one or more closing knots (FIG. 33). At the end of this step, the article (1), which initially exhibited both ends open, results now with one end closed by the hook-up operated on the inner or inside-out part. Finally, as illustrated in FIG. 34, the thus linked stitches are released; this step can be carried out by lowering the everting tube (TR) and using a rod (14) introduced into the same tube (TR) by such a length as to determine the turning right-side out of the article (1) which, in this way, is introduced into the tube (TR) and sucked to be ejected in right-side out condition (in FIG. 34, the direction of suction being indicated with AS). Afterwards, the third movable carrier (TE') is moved away, the tube (TR) is lifted, that is, brought back to its starting position as illustrated in FIG. 35, and the second carrier (SE) is firstly moved close to the first (PE') to allow the transfer of members (7) onto the semicrown (SU), and then moved back to the respective starting position, as illustrated in FIG. 36, so that the reset first carrier (PE'), again provided with all the members (7), is able to be repositioned in the knitting station (TS) for the treatment of a further article.

The said first modular carrier (PE') can be made by using a flange (SCC) supported by the arm (16) which, likewise the carrier (PE), allows the handling thereof between the station (TS) and station (R). The said flange (SCC), as illustrated in FIG. 54, has a lower semicircular portion (SCI)

having engaged therewith the semicrown (SC) which supports the shortest of members (7), and an upper cylindrical portion (SCS) connected without solution of continuity to the lower one (SCI). The upper portion (SCS) of the flange (SCC) is associated with an actuator (SA) supported by said arm (16) by means of a corresponding support (BS) fixed on the upper side of arm (16). Starting the actuator (SA) causes the semicrown (SC) of carrier (PE') to move to the lowered position of FIGS. 25-31 and, respectively, to the lifted position of FIGS. 19-24, 32-36 and 54.

As previously set forth, the present invention is applicable also to two-cylinder circular machines. With reference to FIGS. 64-70, a method according to the invention may include the operating steps described below.

Figure 64:
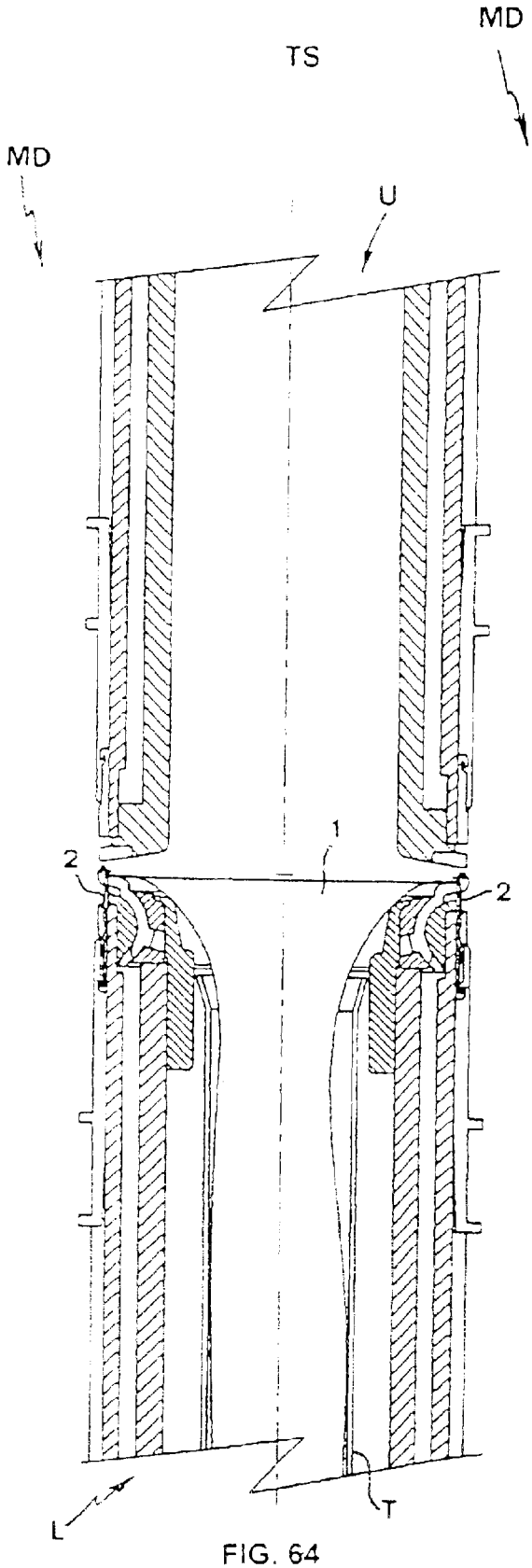
FIG. 64 is a schematic view in diametral section of two-cylinder circular machine in a condition of end-of-knitting of a stocking, with the upper cylinder being still down.

Likewise the method described with reference to FIGS. 1-18, this method provides for knitting a stock (1) starting from the leg part and ending the knitting with the formation of a rank of terminal stitches corresponding to the stocking's toe, which results open (FIG. 64). The knitting of the article (1) is carried out in a conventional way, but by using a two-cylinder circular machine (MD), with a lower cylinder (L) and an upper cylinder (U).

Such a machine is known per se and commercially available. For example, use can be made of a machine model "Sangiacomo INES", produced by the Company Sangiacomo SpA, or a machine model "Silver" produced by MATEC SpA or any other equivalent machine.

Figure 65:
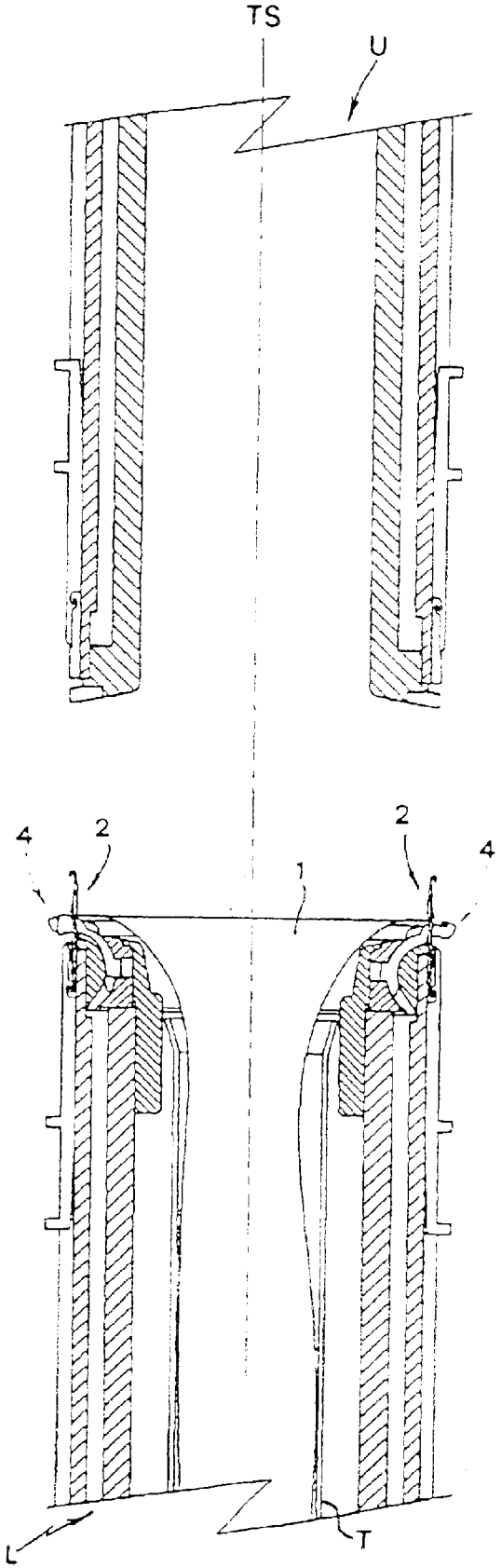
FIG. 65 shows the machine of FIG. 64 with the upper cylinder being lifted up, the stitches of the last knitted rank resulting in the so-called "unloaded" position.

In conformity to the implementation of this method, the upper cylinder (U), after the knitting step above described, is raised and moved away from the lower cylinder (L), as illustrated in FIG. 65. Under this condition, with the upper cylinder (U) being lifted up, the stitches of the last rank result in the so-called "unloaded" position, that is, as pointed out before, the said stitches result on the needles (2) associated with the lower cylinder (L) and disposed below the relevant latches.

Figure 66:
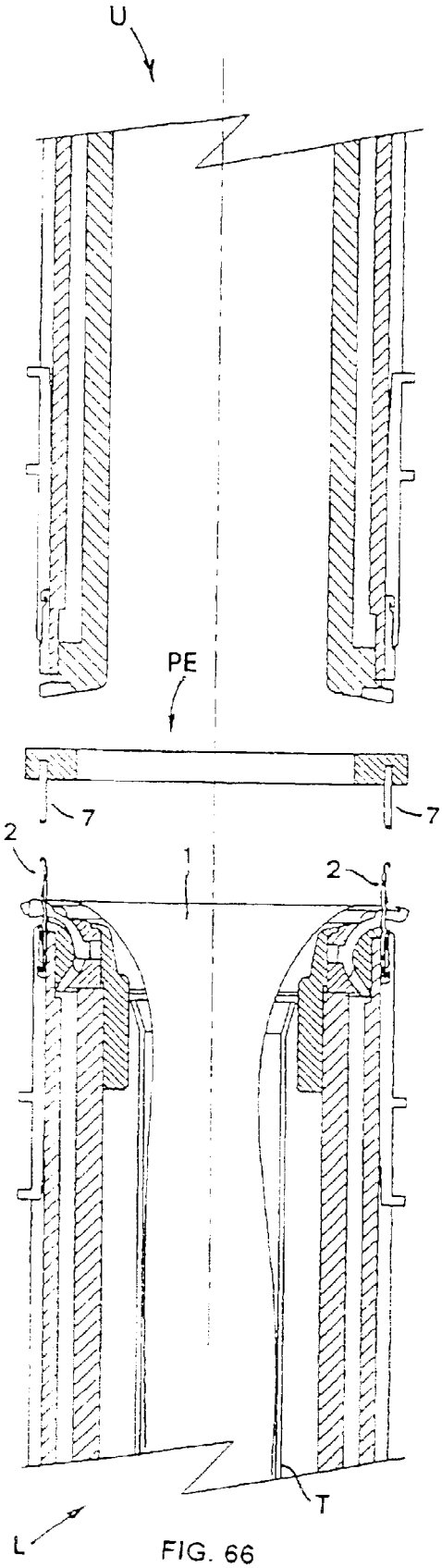
FIG. 66 shows a first movable carrier with stitch-removing members disposed above the needles of the lower cylinder of the machine of FIG. 64.
Figure 67:
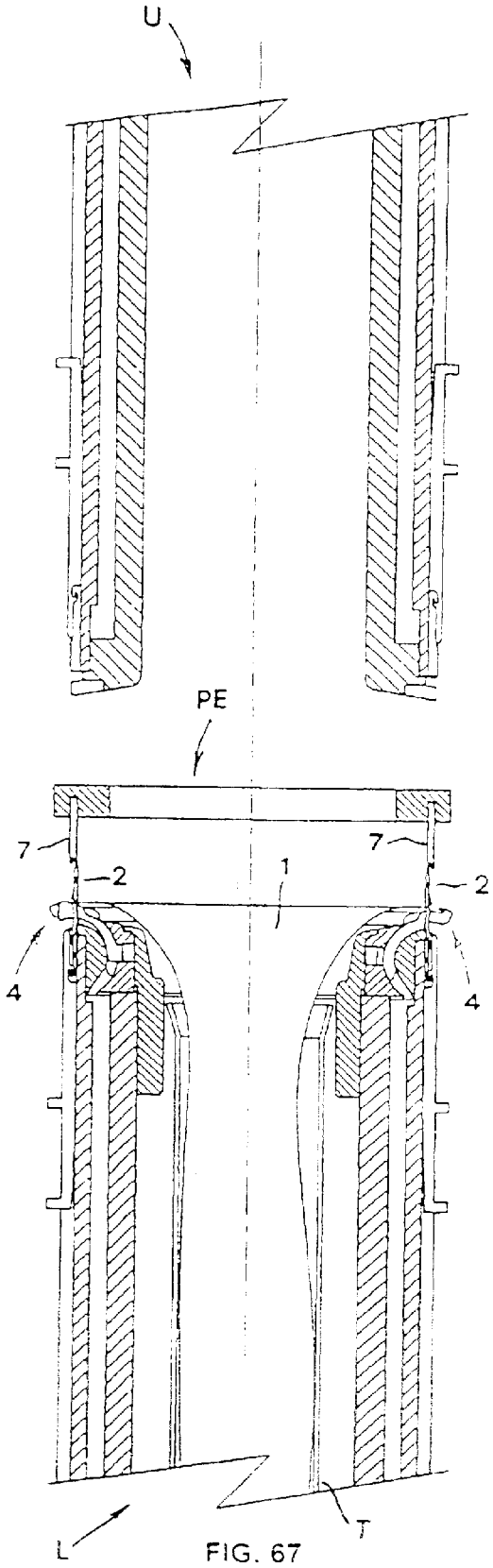
FIGS. 67 and 68 show the said first movable carrier as it goes down towards the lower cylinder to allow the transfer of the stitches of the last knitted rank from the needles to the removal members supported by the movable carrier.
Figure 68:
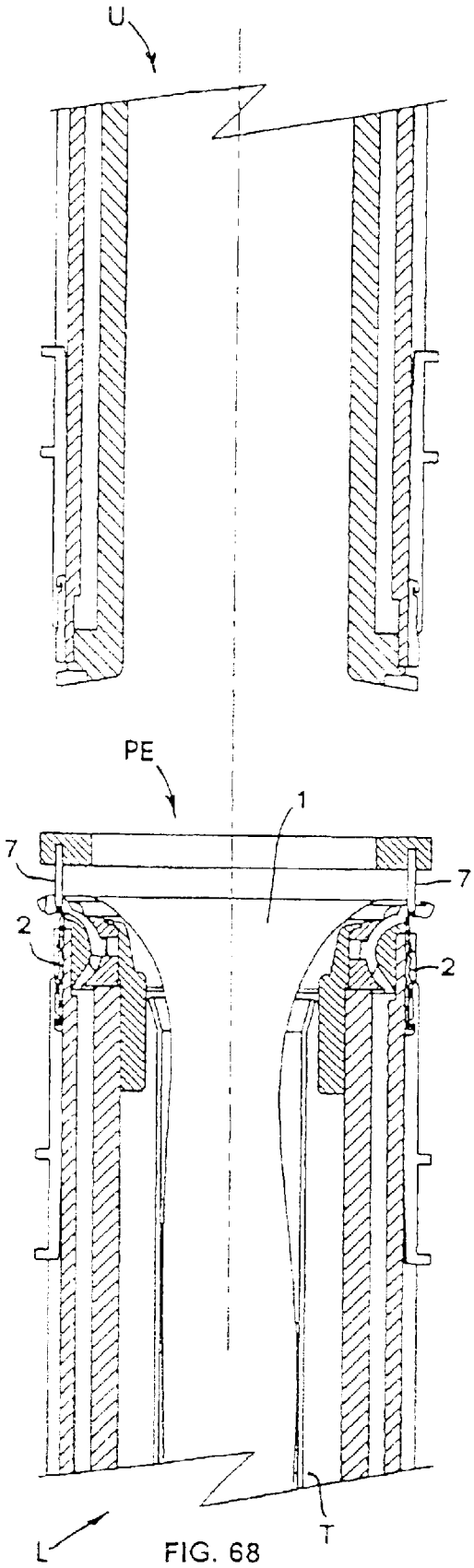

At this point, after the positioning of the first movable carrier (PE) between the two cylinders (U, L) of the machine (MD), as illustrated in FIG. 66, the stitches of the last rank of article (1) are transferred from the needles (2) to a plurality of corresponding removal members (7) disposed on said first movable carrier (PE) so that, at the end of this step, each stitch of the last rank will result transferred from the respective needle (2) to a corresponding removal member (7) (see FIGS. 67 and 68).

Figure 69:
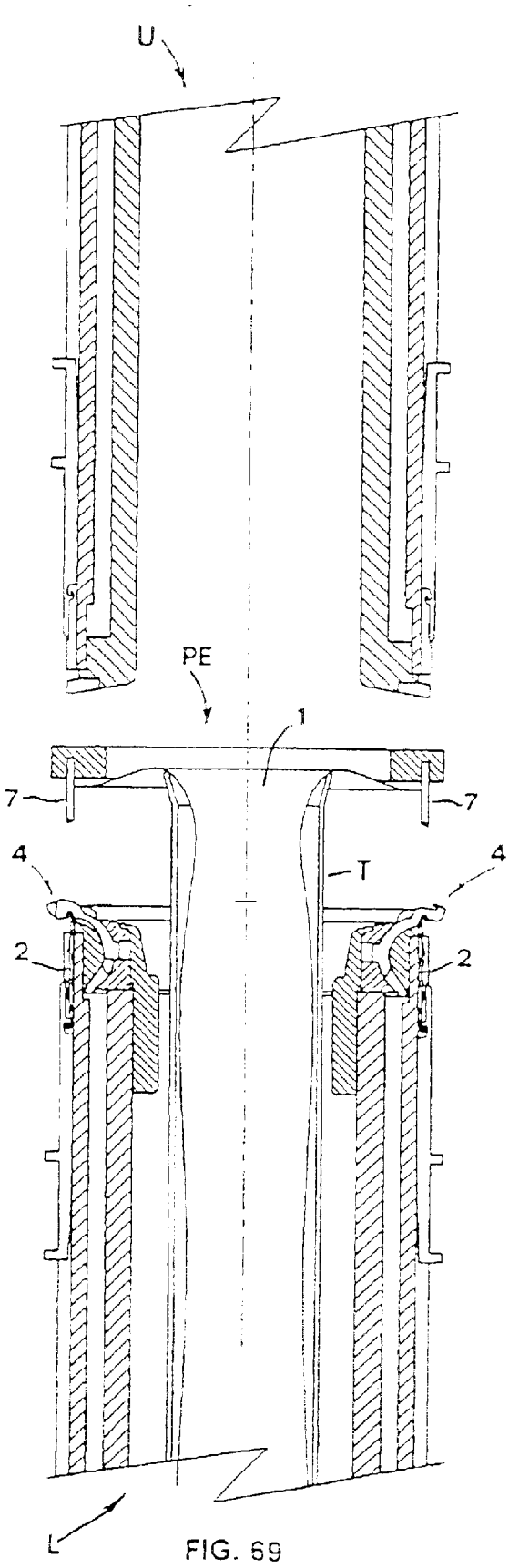
FIG. 69 shows the lifting of the movable carrier with the article being disengaged from the knitting needles of the lower cylinder and engaged with said removal members.
Figure 70:
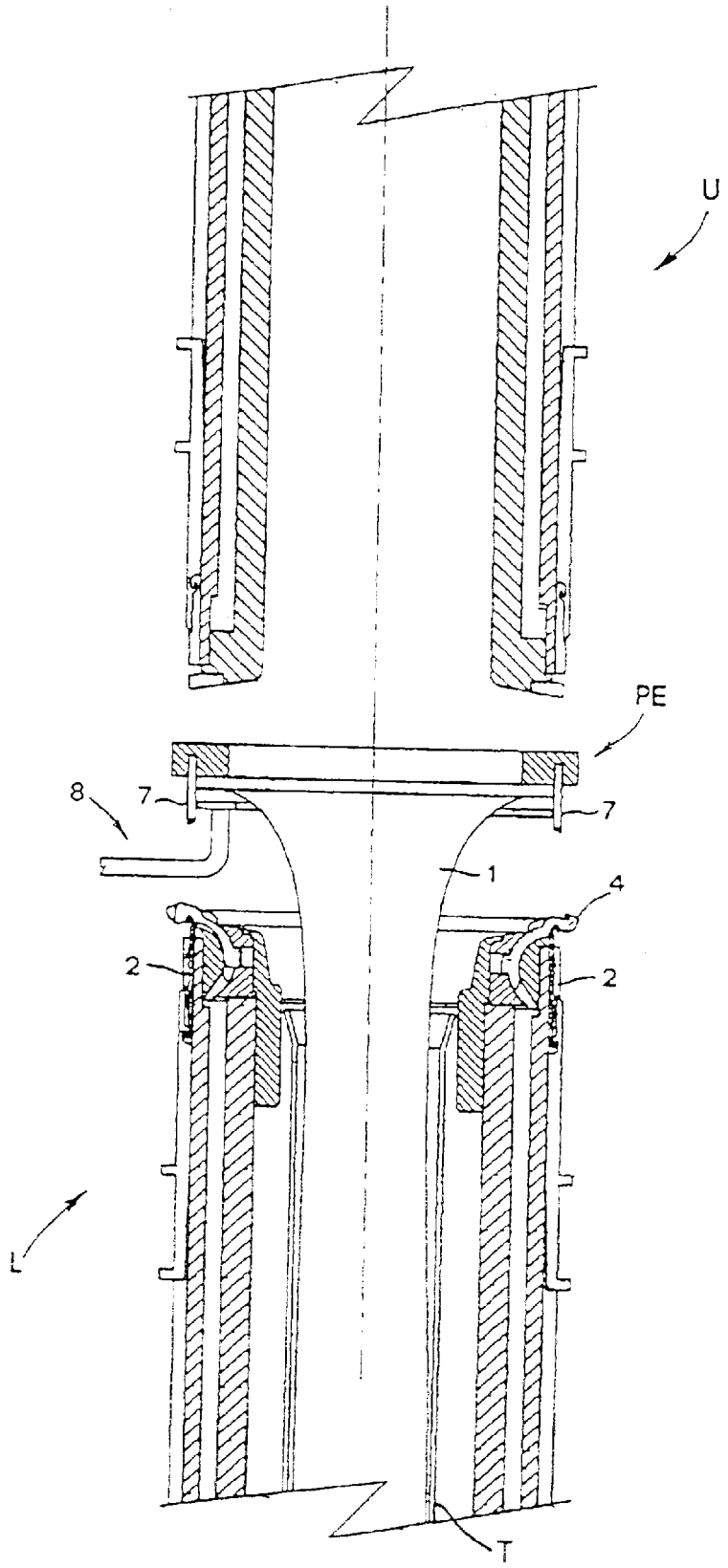
FIG. 70 shows the drawing of a safety device near the first movable carrier being lifted up.
Figure 72:
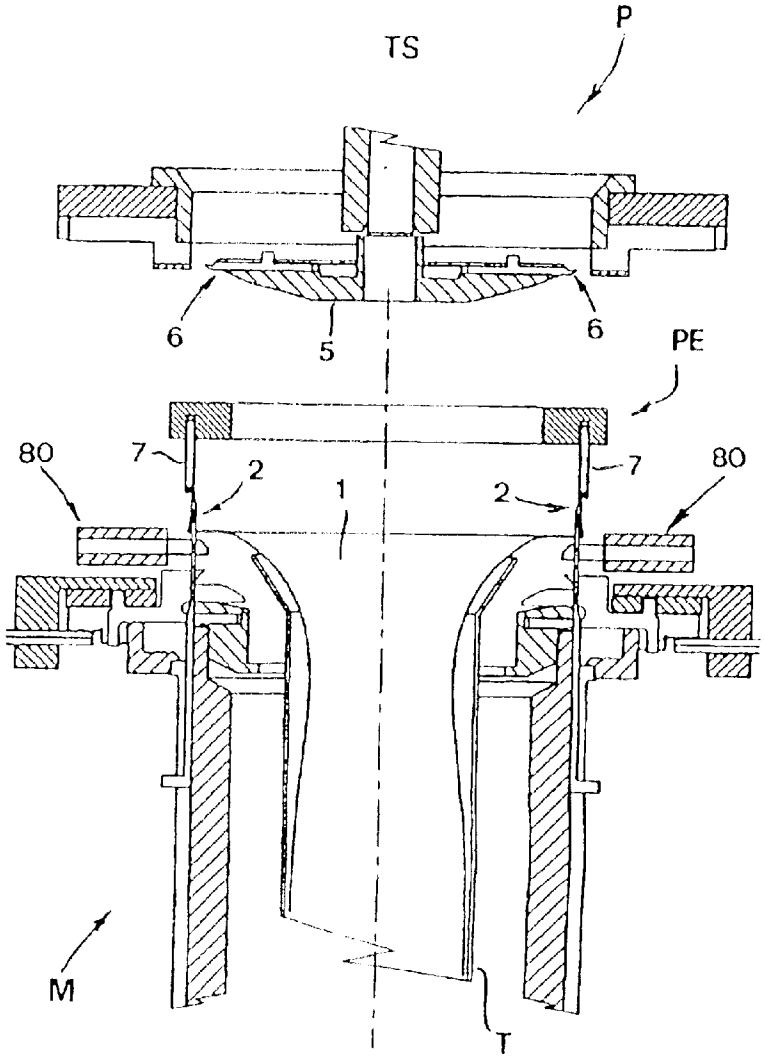
FIG. 72 shows a first movable carrier with the stitch-removing members being disposed onto the needles of the machine of FIG. 71 and with external means able to define a cast-off plane for the removal of the stitches.

Subsequently, the steps are mainly similar to those previously described, as illustrated for example in FIG. 69 which shows the lifting of the first movable carrier with the article disengaged from the knitting needles of the lower cylinder and engaged with the removal members (7), and in FIG. 70 which refers to the approach of a safety device (8) to the first movable carrier (PE).

In practice, in relation to the method described with reference to FIGS. 1-18, the only difference lies in the fact that the article (1) is produced by a two-cylinder machine (MD) instead of by a one-cylinder machine (M).

Figure 71:
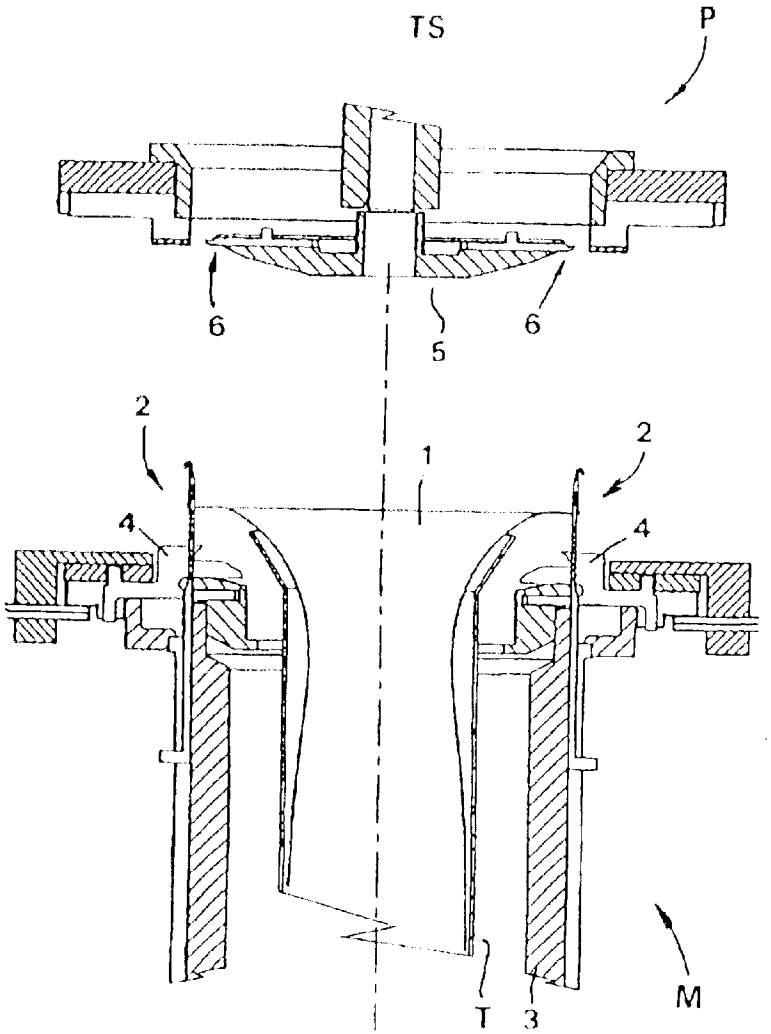
FIG. 71 is a schematic view in diametral section of one-cylinder circular machine with the plate and knitting needles being lifted up, the stitches of the last knitted rank resulting in the so-called "unloaded" position.
Figure 74:
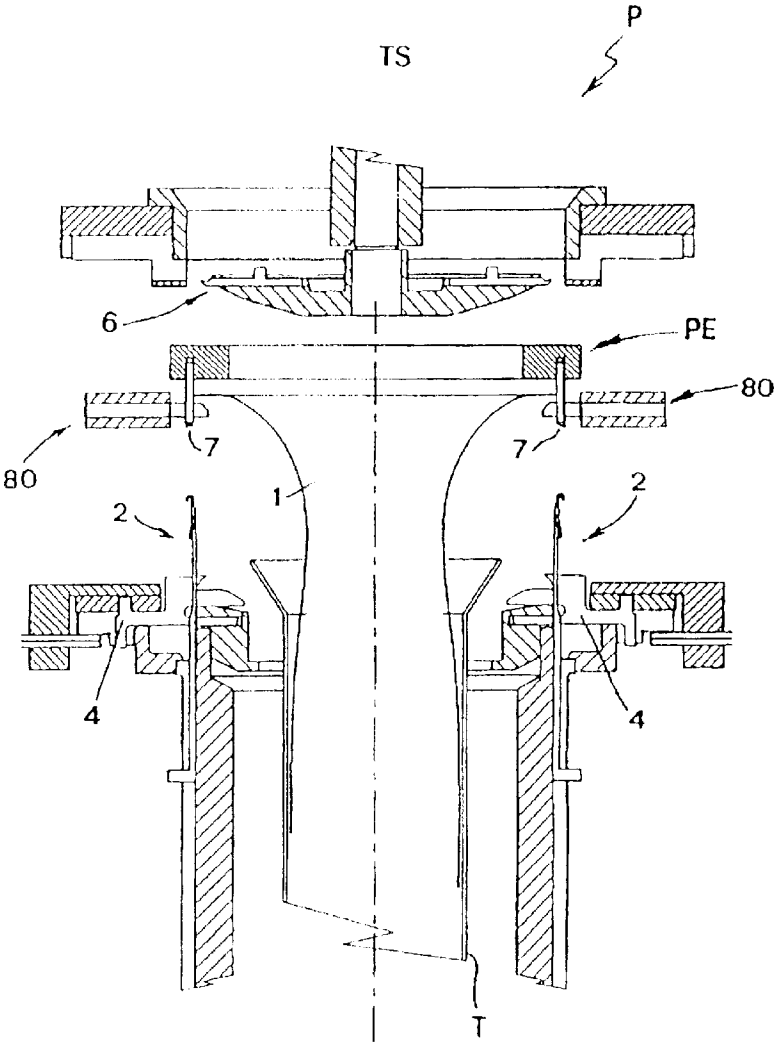
FIG. 74 shows the step of lifting the first movable carrier with the article being disengaged from the knitting needles and engaged with the said removal members, this step being the one in which the said means defining the cast-off plane act as a safety device to prevent the spontaneous release or hold-failure of the stitches.
Figure 73:
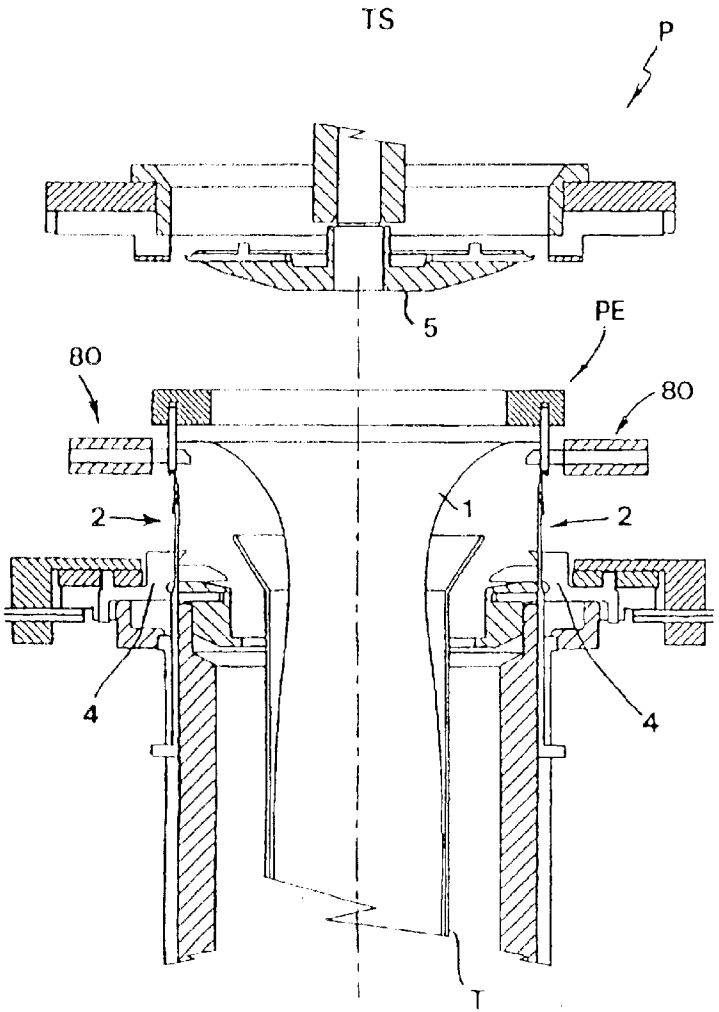
FIG. 73 shows the said first movable carrier in a step of transferring the last knitted rank from the needles of the machine of FIG. 71 to the removal members supported by the same movable carrier.
Figure 79:
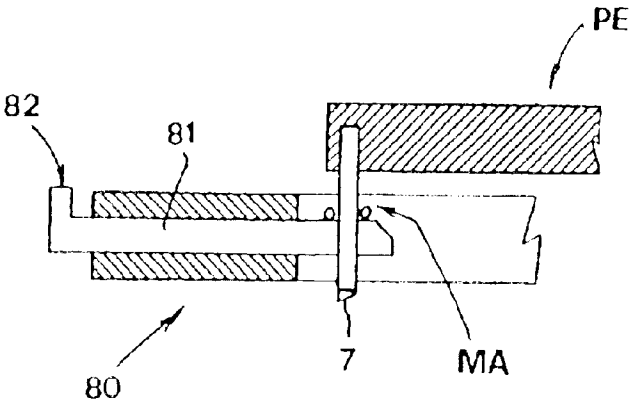
FIG. 79 shows the example of FIG. 77, with the said means apt to define a cast-off plane being activated after the removal similarly to what is illustrated in FIG. 74.

FIGS. 71-82 relate to further exemplary embodiments of the present invention which show possible (not limiting) solutions of some mechanical parts previously described. It should be noted that FIG. 71 is identical to FIG. 2A and is shown once more only for the sake of representation.

In particular, FIGS. 72-80 show means (80) able to define a cast-off plane for the removal of the stitches, which means are also able to act as a safety device by performing the same function as the device (8) previously described.

When the circular machine (M) (of single cylinder type in this case) has its plate and knitting needles lifted up, with the stitches of the last knitted rank in the so-called "unloaded" position (FIG. 71), a first movable carrier (PE) is disposed likewise that described above between the plate group (P) and the cylinder of needles (2). In this case, however, and as can be seen in FIGS. 72-76, the said means (80) consist of a support body (88) shaped like a circular crown inside which a plurality of rods are positioned each of which can be moved radially, for example by using a relevant heel (82) associated with a corresponding operating cam (not shown in the drawings for the sake of clarity). The said means (80) are disposed circumferentially around the needles (2) of cylinder (3), and the said rods (81) result radially movable from and to the longitudinal axis of the same cylinder.

Figure 80:
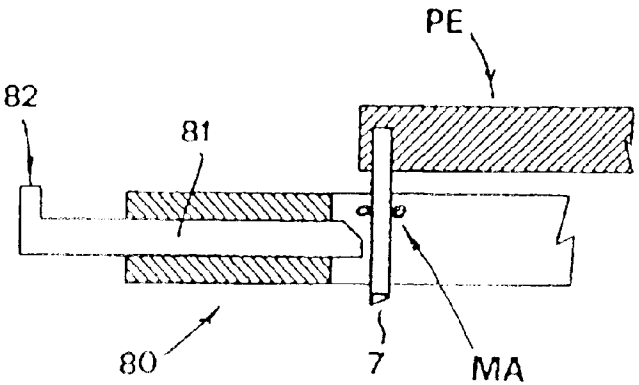
FIG. 80 shows the example of FIG. 79, with the said means apt to define a cast-off plane being activated after a removal like that illustrated in FIG. 76.
Figure 77:
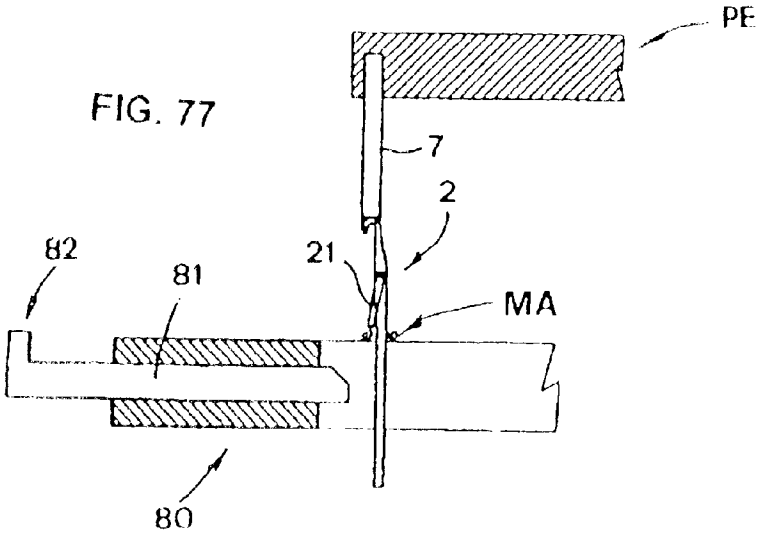
FIG. 77 is a side partial side view with parts in section of a first movable carrier with the stitch-removing members being moved close to the needles and with the means apt to define a cast-off plane being off.
Figure 78:
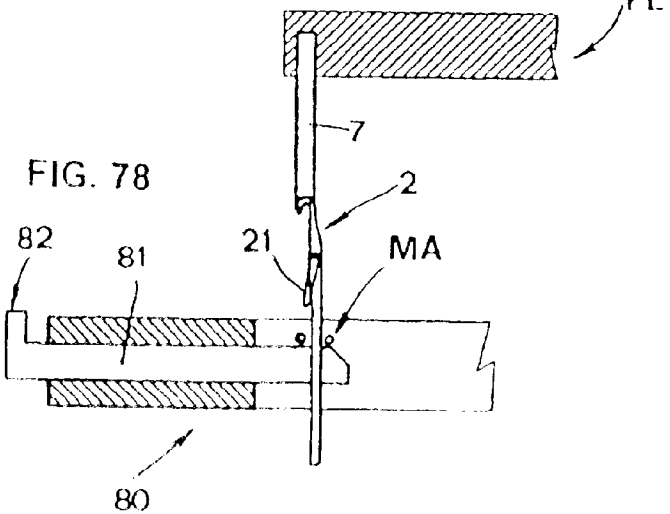
FIG. 78 shows the example of FIG. 77, with the said means apt to define a cast-off plane being activated likewise illustrated in FIG. 72.

The said rods (81) can be disposed either in an active configuration (as illustrated in FIGS. 72-75, 78 and 79) in which the means (80) define the cast-off plane (PA) and act as a safety device, or in inoperative configuration, illustrated in FIGS. 76, 77 and 80, wherein they result retracted, that is, kept outside the trajectory of needles (2).

Illustrated in FIGS. 81 and 82 is a further exemplary embodiment of the means apt to alternatively define a cast-off plane. In this case, the means are made up of a plurality of levers (88) disposed circumferentially and having fulcrum on a support crown (86) which develops around and externally to the needles (2). Each lever (88) has an inner portion (87) and an outer portion (89) disposed on opposite sides with respect to the fulcrum. Provided around the support crown (86) is a drive crown (90) able to be moved vertically with respect to said support crown (86). In its vertical travel, the drive crown (90) abuts onto the outer portion (89) of lever (88), thereby displacing upwardly the inner portion (87) which, in this configuration, defines a cast-off plane for the stitches (MA).

The said crown (90) is associated with a corresponding actuator (not shown) which determines the positioning thereof like that of FIG. 81 and, respectively of FIG. 82.

The example illustrated in FIGS. 91-111 refers to the application of a method according to the invention for the formation and development of a stocking (1) present in the upper cylinder (U) of a two-cylinder machine (FIG. 91) at the end of formation of the same stocking. Once this knitting step is completed, the needles (2) are associated with the upper cylinder (U), as shown in FIG. 92. Thereafter, the upper cylinder (U) is lifted, along with needles (2) and article (1), so as to create a space for the positioning of the first movable carrier (PE) between the upper and lower cylinders of the machine (FIGS. 93 and 94). Afterwards, the said carrier (PE) is lifted up until the members (7) supported by same carrier fit into the stitches of the last knitted rank by taking the place of the needles (2), as illustrated in FIGS. 95 and 96. Then, the carrier (PE) is lowered (FIG. 97) together with the tube (T) present in the upper cylinder (U) to fully disengage the stocking (1) from the same cylinder and possibly using the safety device (8) as shown in FIG. 98. At the end of this step, the carrier (PE) is disposed in the station (R), as illustrated in FIG. 99, the safety device (8) is moved away after introducing from below the eversion tube (TR) up into the stocking (1), the second carrier (SE) is drawn near the first carrier (FIG. 100) and the tube (TR) is lowered to turn the stocking (1) inside out. Afterwards, the members (7) are transferred to the second carrier (SE), so that the stocking (1) results engaged with the latter and no longer engaged with the first carrier (PE), and the second carrier (SE) is moved apart from the first (PE) to make. room for the third carrier (TE), as illustrated in FIGS. 101 and 102, after which the stitches of the last knitted rank are transferred onto the rods (9) and onto the spines (10) of the third carrier (TE)

so that each stitch of a semirank will result transferred onto a corresponding rod (9), and each stitch of the other semirank will result transferred onto a corresponding spine (10). Subsequently, the second carrier (SE) is moved away from the third carrier (FIG. 103) and the semicrown of rods (9) is rotated through 180° (FIG. 104) to dispose the stitches of the last rank in a position ready for the hook-up operation. At the end of this step, the toothed semicrown (12) is made to operate, as illustrated in FIG. 105, to transfer onto the spines (10) the stitches fitted on rods (9), after which the semicrown of rods (9) is brought back to the starting position (FIG. 106) and the hook-up device (RI) is made to link the stitches being disposed in pairs coaxial and juxtaposed on the spines (10). At this point, the tube (TR) is lifted (FIG. 108) to disengage the stitches from the spines (10). The stocking (1) can thus be ejected without being further turned inside out, since it is already in the right-side out condition after having been picked up from the upper cylinder (U) of the knitting machine. It should be understood, however, that the stocking can be turned inside out after this hook-up operation (FIG. 109) if necessary. Finally, the members (7) are brought back onto the first carrier (PE) thereby restoring the initial condition of the system (FIGS. 110 and 111).

Figure 127:
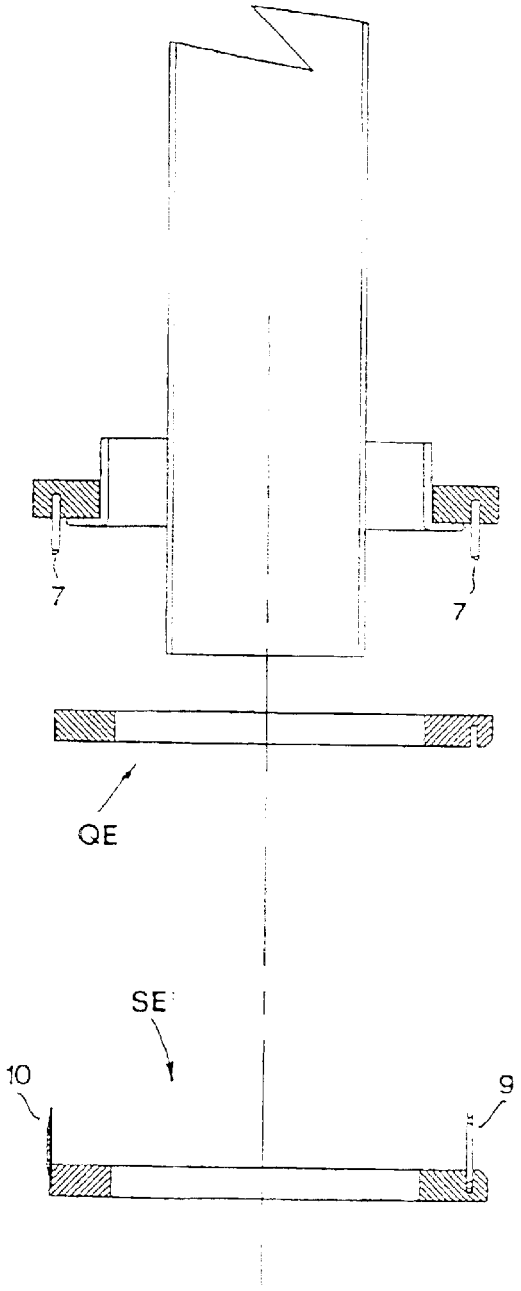

The modified embodiment shown diagrammatically in FIGS. 116-127, provides, subsequently to the steps already described with reference to FIGS. 1-6 (knitting of the article, removal of the stitches of last rank and transfer thereof to a station R other than that for knitting) for the following operating steps:

- at station (R), introducing an everter tube (TR) inside the article (1) (FIG. 116);
- turning the article (1) inside out by lifting the tube (TR), drawing the rods (9) and spines (10) near the members (7) having present thereon the terminal stitches of article (1) and, with the aid of crown (11) forcing said stitches to fit on the rods and on the corresponding spines by exerting, through the same crown (11), a thrust directed from top downwards on the stitches (FIG. 117), the said rods (9) and the said spines (10) being supported by a corresponding carrier (SE');
- moving the carrier (SE') away from carrier (PE) of members (7) to make room for another carrier (QE) between them (FIG. 118);
- drawing the carrier (QE) near the carrier (SE') and transferring the rods (9) and spines (10) from the carrier (SE') to the carrier (QE) (FIG. 119);
- moving the carrier (SE') away from carrier (QE);
- disposing in coaxial and juxtaposed relationship the stitches respectively engaged with rods (9) and spines (10), that is, in a preset configuration ready for hook-up (FIGS. 121 and 122);
- restoring the initial condition of carrier (QE) (FIG. 123);
- carrying out the hook-up of edges (L1, L2) to be joined (FIG. 124);
- releasing the stitches from the spines (10) having served as a support for said hook-up operation (FIG. 125);
- transferring the rods (9) and spines (10) from the carrier (QE) to carrier (SE') (FIG. 126);
- moving all the elements back to the respective original positions to allow the starting of a further operating cycle (FIG. 127).

In order to implement this operative procedure, the members (7) may be simply fixed to the carrier (PE), as their transfer onto other carriers of the apparatus is not required. In this case, however, the rods (9) and spines (10) are stably but removably associated with the carriers (SE') and (QE).

To this end, as illustrated in FIGS. 128-138, the carrier (SE') is made up of two semicrowns (HH, HK) each of which is provided with seats for receiving the rods (9) and respectively the spines (10). The rods (9) are shaped equally in correspondence of the respective ends and exhibit a lateral recess to allow the retention thereof by an elastically deformable gasket designated in the drawings of FIGS. 131-134 by the same numeral (152) as in FIGS. 38-41. The same holds true for the elements designated with numerals (150), (151), (153), (154), (155) and (156) which operate and interact as described with reference to FIGS. 38-41. The semicrown (HK) exhibits a plurality of seats (180) able to form corresponding dovetail guides for the spines (10), with a terminal stop means (181). The spines (10) in question may be retained within the respective seats by an elastic annular gasket (152) housed in a corresponding seat (182) of the semicrown (HK) and associated with a system for the introduction of compressed air through channels (155, 156) formed in the same semicrown (HK), likewise it has been previously described with reference to the example of FIGS. 38-41. The spines (10) have a substantial straight development, as can be seen in FIGS. 135-137, are provided with two recesses (900) to further ease the action of the elastic ring (152) upon the expansion of the latter, and have the same shape at both ends. On the side (910) intended for the introduction of spines (10) into the guides (180), the said spines have the same profile as guides (180). On the opposite side, the spines (10) exhibit a longitudinal recess (911) for the needle of the hook-up machine (RI).

The carrier (QE) is shaped like the carrier (SE') as far as the system for housing the rods (9) and spines (10) is concerned, and is shaped like the carrier (TE) illustrated in FIGS. 42-45 as far as the system for opening and tongs-like closing the semicrowns (310, 300) as well as the system for rotating the semicrown of rods (9) to dispose the stitches in hook-up condition are concerned.

The present invention further allows also for handling stitches of straight textile articles besides those of tubular shape.

Figure 142:
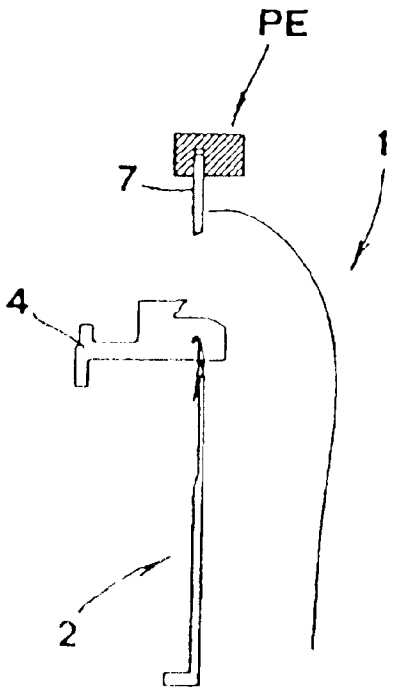
Figure 141:
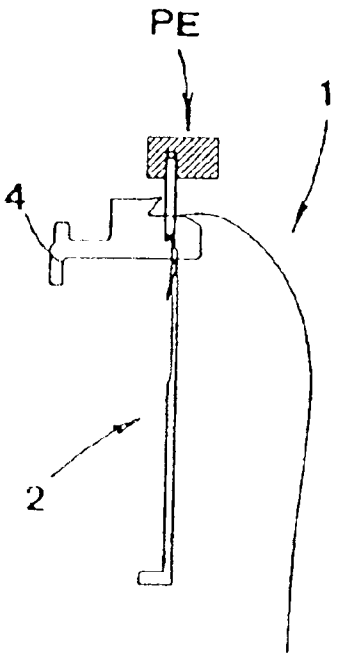
Figure 140:
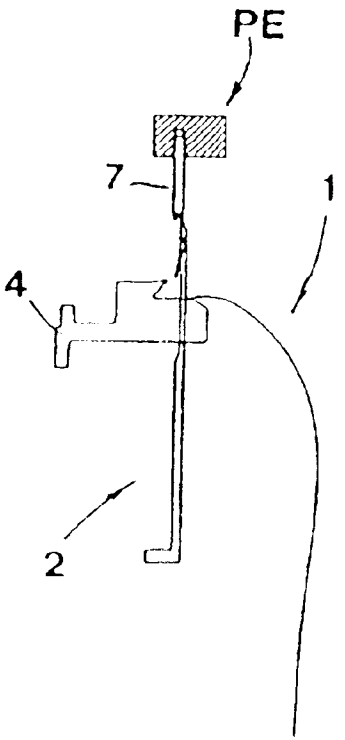
Figure 139:
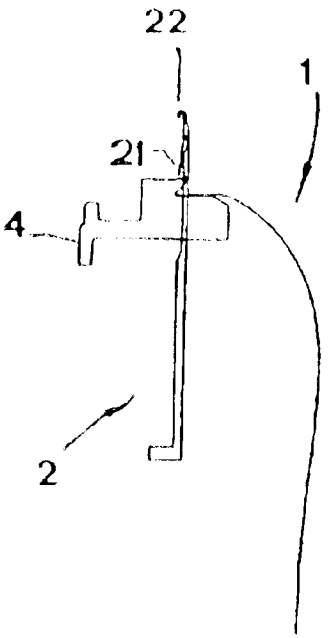
Figures 143, 144, 145, 146, 147:
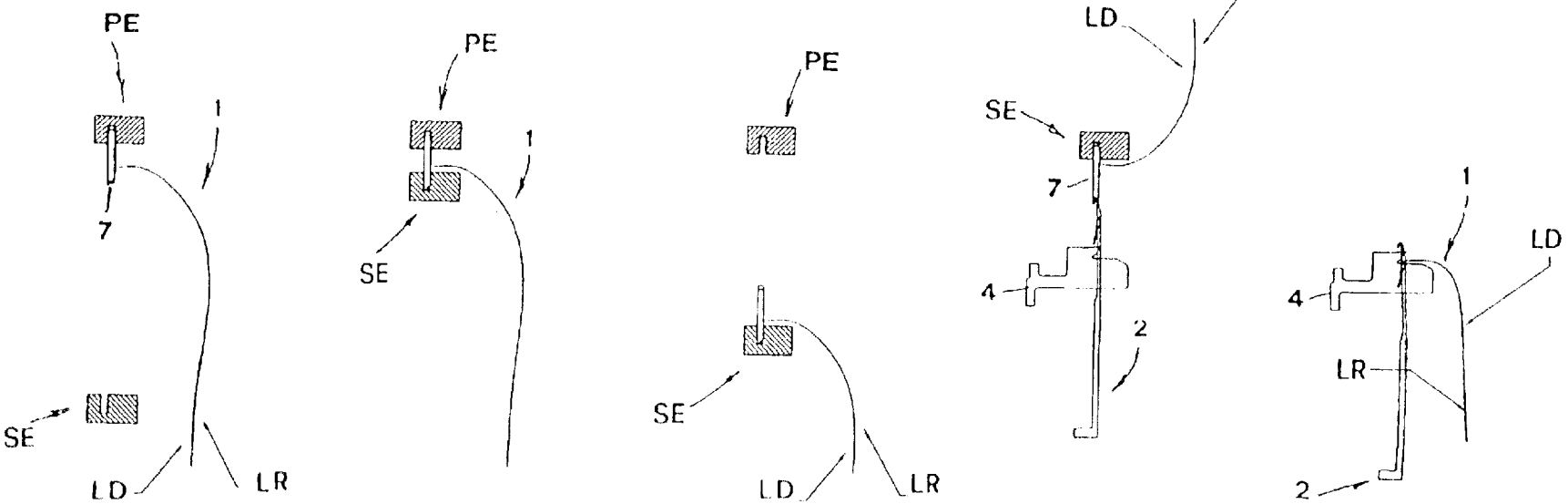

The example diagrammatically depicted in FIGS. 139-147 relates actually to the treatment of an article (1) knitted on a rectilinear instead of circular machine, to allow depositing the fabric onto either the same machine or a different machine in reverse orientation, that is, with the right-side out part (LD) being inside out (LR) so as to go on with the knitting to achieve a knitted article with right and reverse bands by means also of one single front, that is, by a machine (known per se to those skilled in the art) able to knit only on the right-side out. Shown in the example of FIGS. 139-147 is just the minimum knitting unit of the machine, that is, the individual needle (2) with the individual sinker (4), while it will be appreciated that the same steps and considerations apply whatever the number of needles the machine is provided with. With reference to this example, the operating method can be implemented as follows:

- knitting the article (1) as far as a preset height with a rectilinear machine having a simple front of latched needles (2) and movable sinkers (4) which, likewise what has been described with reference to the knitting of tubular articles, delimit a cast-off plane for the stitches (FIG. 139);
- lifting the needles (2) by placing the stitches of the last rank in unloaded position, that is, under the end of latches (21) and moving the head (22) of each needle (2) close to a corresponding member (7) intended for picking up the stitch last formed thereon (FIG. 140), the members (7) being stably but removably associated with a corresponding support carrier (PE);

lowering the carrier (PE) along with members (7) by determining the transfer of the last rank's stitches of needles (2) to the members (7) (FIG. 141);

disengaging the article (1) from the textile machine by lifting the carrier (PE) along with members (7) (FIG. 142);

transferring the carrier (PE) with article (1) to a station other than that for knitting (FIG. 143);

transferring the said members onto a second support carrier (SE) (FIGS. 144 and 145);

transferring the said second carrier (SE) to the knitting station (FIG. 146) and drawing the now free end of each member (7) close to the head (22) of a corresponding needle (2) by transferring the stitches from the members (7) to the needles (2);

moving away the said second carrier and going on with the knitting (FIG. 147).

It will be appreciated that this cycle can be repeated a preset number of times.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. Method of handling or moving the stitches of a textile article, the method comprising removing the stitches from the needles of a textile machine by which the transferring article is formed at a first station, transferring the article from said first station to a second operating station, said transfer being operated by engaging the said stitches with a plurality of members intended for the removal of same stitches from the needles of the textile machine and transferring said members from said first station to said second station, characterized in that it comprises the reversible transfer of at least one portion of said removal members from a first support or carrier which is being movable from said first and second stations to a second support or carrier intended for temporary retaining the said at least one portion of removal members along with the stitches being removed by them, and/or the reversible transfer of a plurality of members, intended for the temporary retention of the stitches and not involved in the removal of same stitches from said needles, between two movable supports or carriers.

2. Method of joining the two edges of a tubular knitted article, the said two edges being delimited by a plurality or rank of stitches (MA), method comprising the removal of said stitches (MA) from the needles (2) of a machine (M; MD) by means of which it is provided to form the article (1) at a first station (TS), the transfer of the article (1) from said first station (TS) to a second operating station, the said transfer being operated by engaging the said stitches (MA) with a plurality of members (7) intended for removing the stitches from the needles (2) of the knitting machine (M; MD) and transferring said members (7) from said first station to said second station, method comprising also joining or hooking-up the edges of the article (1) which are delimited by said rank of stitches (MA) subsequently the positioning of the latter in a preset hook-up configuration, characterized in that, prior to said hook-up step, it implies the reversible transfer of at least part of said removal members (7) from a first support or carrier (PE; PE') movable between said first and second station and a second support or carrier (SE) intended for temporarily retaining the said at least part of removal members (7) together with the stitches (MA) they have removed.

3. Method according to claim 2, characterized in that it includes transferring the stitches (MA) engaged with the removal members (7) transferred onto said second support (SE) by the same members to a plurality of members (10) mounted on a third support (TE; TE') and intended for retaining the said stitches (MA) during said hook-up step.

4. Method according to claim 2, characterized in that the said second station coincides with the station (R) wherein the hook-up step is performed.

5. Method according to claim 2, characterized in that the said configuration for hooking-up the stitches (MA) corresponds to a configuration in which the stitches (MA) of the last knitted rank which delimit the two edges of the article to be joined are disposed selectively juxtaposed and coaxial.

6. Method according to claim 2, characterized in that the said article (1) is a stocking.

7. Method according to claim 2, characterized in that the said stitches (MA) delimit the part corresponding to the stocking's toe.

8. Method according to claim 2, characterized in that it comprises making the stocking (1) starting from the hem and ending with the part corresponding to the toe.

9. Method according to claim 2, characterized in that the machine by which the article (1) is made is either a one-cylinder (M) or a two-cylinder (MD) circular knitting machine.

10. Method according to claim 2, characterized in that the said hook-up operation is performed on the article (1) being turned inside out.

11. Method according to claim 2, characterized in that the said hook-up operation is performed on the article (1) being turned right-side out.

12. Apparatus for handling or moving the stitches of a textile article by a corresponding textile machine provided with a plurality of knitting needles, apparatus comprising a plurality of members intended for the removal of same stitches from the needles of the machine by which the article is made and intended for transferring the same stitches from the station wherein the said knitting machine is located to a different operating station, characterized in that it comprises at least a first and a second supports or carriers provided with seats for receiving in a stable but removable manner the said stitch-removing members and/or a plurality of members, intended for the temporary retention of the stitches and not involved in the removal of same stitches from said needles.

13. Apparatus for carrying out the junction of the stitches (MA) of a terminal rank of a tubular article (1) knitted by a corresponding textile machine (M; MD) comprising a plurality of knitting needles (2), apparatus comprising a plurality of members (7) intended for removing the said stitches (MA) from the needles (2) of the machine (MA; MD) by which the article (1) is made and intended for transferring the same stitches from the station (TS) wherein the said machine (M; MD) is located to a different operating station, characterized in that it comprises a first and a second support or carrier (PE; PE'; SE) provided with seats (157, 191) for receiving the said members (7) in a stable but removable manner.

14. Apparatus according to claim 12, characterized in that it comprises means for engaging the said members (7) within said seats (157, 191) and respectively disengaging them therefrom.

15. Apparatus according to claim 13, characterized in that said means for engaging the said members (7) within said seats (157, 191) and disengaging them therefrom are mounted both on said first carrier (PE; PE') and on said second carrier (SE).

16. Apparatus according to claim 13 characterized in that said members (7) intended for removing said stitches (MA) are constituted by rod members.

17. Apparatus according to claim 13, characterized in that the said members (7) are angularly displaced between them likewise said knitting needles (2).

18. Apparatus according to claim 13, characterized in that the said first carrier (PE), and respectively the said second carrier (SE), comprise a structure with two concentric elements (150, 151; 19, 190) which delimit a plurality of seats (157; 191) to receive stably but removably the said removal members (7) therein.

19. Apparatus according to claim 13, characterized in that, disposed between said two concentric elements (150, 151; 19, 190) is an annular gasket (152) made from elastically deformable material and means able to increase and respectively reduce the diameter of said annular gasket in order to engage said members (7) with their relevant seats (157; 191) and respectively disengaging them therefrom.

20. Apparatus according to claim 19, characterized in that the said means able to increase and respectively reduce the diameter of said annular gasket (152) comprise an annular wedge (154) associated with a corresponding linear actuator.

21. Apparatus according to claim 19, characterized in that the said means able to increase and respectively reduce the diameter of said annular gasket (152) are fluid media.

22. Apparatus according to claim 13, characterized in that the said removal members (7) of stitches (MA) exhibit lateral recesses (72) in correspondence of points of interaction with the said gasket (152).

23. Apparatus according to claim 13, characterized in that the said first movable carrier (PE; PE') is fixed to a corresponding arm (16) associated with a corresponding actuator (172) which drives it into rotation about the axis of a shaft (17) supporting it, from and to the said first and second stations.

24. Apparatus according to claim 13, characterized in that the said first and second carriers (PE; PE', SE) can be positioned at different operating heights.

25. Apparatus according to claim 23, characterized in that the said arm (16) is associated with a corresponding linear actuator (18) which operates the lifting and, respectively, the lowering thereof.

26. Apparatus according to claim 13, characterized in that the said first support or carrier (PE') is of modular type.

27. Apparatus according to claim 13, characterized in that it comprises means (TE; TE') on which the staid stitches (MA) are to be disposed in a hook-up configuration, and means for transferring thereon the stitches already supported by said carrier or support (SE).

28. Apparatus according to claim 13, characterized in that the said means for transferring the stitches from the second to the third carrier comprise a flange (11; 11') movable between said second and third carrier.

29. Apparatus according to claim 13, characterized in that the said means (TE; TE') for supporting the stitches (MA) in hook-up configuration comprise a semicircular front of hook-up spines (10).

30. Apparatus according to claim 13, characterized in that the said means (TE; TE') for supporting the stitches (MA) in hook-up configuration comprise a semicircular front of hook-up spines (10) and a front of rods (9) angularly spaced apart likewise said knitting needles (2): the front of rods (9) being on a support (31) movable from and to the front of spines (10).

31. Apparatus according to claim 13, characterized in that the support (30) of spines (10) and the support (31) of rods (9) are borne by two corresponding arms (32, 33) connected to each other by a hinge (323).

32. Apparatus according to claim 13, characterized in that at least one of the ends (70, 71) of said rods (7) is either shaped like a cap or is provided with a notch.

33. Method according to claim 6, characterized in that the said stitches (MA) delimit the part corresponding to the stocking's toe.

34. Method according to claim 6, characterized in that it comprises making the stocking (1) starting from the hem and ending with the part corresponding to the toe.

35. Apparatus according to claim 13, characterized in that it comprises means for engaging the said members (7) within said seats (157, 191) and respectively disengaging them therefrom.

36. Apparatus according to claim 14, characterized in that said means for engaging the said members (7) within said seats (157, 191) and disengaging them therefrom are mounted both on said first carrier (PE; PE') and on said second carrier (SE).

37. Apparatus according to claim 18, characterized in that, disposed between said two concentric elements (150, 151; 19, 190) is an annular gasket (152) made from elastically deformable material and means able to increase and respectively reduce the diameter of said annular gasket in order to engage said members (7) with their relevant seats (157; 191) and respectively disengaging them therefrom.

38. Apparatus according to claim 19, characterized in that the said removal members (7) of stitches (MA) exhibit lateral recesses (72) in correspondence of points of interaction with the said gasket (152).

39. Apparatus according to claim 27, characterized in that the said means for transferring the stitches from the second to the third carrier comprise a flange (11; 11') movable between said second and third carrier.

40. Apparatus according to claim 27, characterized in that the said means (TE; TE') for supporting the stitches (MA) in hook-up configuration comprise a semicircular front of hook-up spines (10).

41. Apparatus according to claim 27, characterized in that the said means (TE; TE') for supporting the stitches (MA) in hook-up configuration comprise a semicircular front of hook-up spines (10) and a front of rods (9) angularly spaced apart likewise said knitting needles (2): the front of rods (9) being on a support (31) movable from and to the front of spines (10).

42. Apparatus according to claim 30, characterized in that the support (30) of spines (10) and the support (31) of rods (9) are borne by two corresponding arms (32, 33) connected to each other by a hinge (323).

43. Apparatus according to claim 16, characterized in that at least one of the ends (70, 71) of said rods (7) is either shaped like a cap or is provided with a notch.

* * * * *